US007775629B2

(12) United States Patent
Nukui et al.

(10) Patent No.: US 7,775,629 B2
(45) Date of Patent: Aug. 17, 2010

(54) IMAGE RECORDING APPARATUS

(75) Inventors: Kosuke Nukui, Nagoya (JP); Takatoshi Takemoto, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 902 days.

(21) Appl. No.: 11/646,166

(22) Filed: Dec. 27, 2006

(65) Prior Publication Data

US 2007/0146445 A1 Jun. 28, 2007

(30) Foreign Application Priority Data

Dec. 28, 2005 (JP) ..... 2005-377432
Dec. 28, 2005 (JP) ..... 2005-377995
Dec. 28, 2005 (JP) ..... 2005-378729
Dec. 28, 2005 (JP) ..... 2005-380109

(51) Int. Cl.
*B41J 23/00* (2006.01)

(52) U.S. Cl. ..... 347/37; 347/84

(58) Field of Classification Search ..... 347/37, 347/84–85; 400/285.5, 313, 315, 329, 355
See application file for complete search history.

(56) References Cited

U.S. PATENT DOCUMENTS 5,751,300 A * 5/1998 Cowger et al. ..... 347/6
6,220,700 B1 * 4/2001 Haigo ..... 347/85
2005/0083383 A1 4/2005 Tsuyama et al.

FOREIGN PATENT DOCUMENTS

| | | |
|---|---|---|
| EP | 1 574 340 | 9/2005 |
| EP | 1 726 445 | 11/2006 |
| JP | 63154354 | 6/1988 |
| JP | 6320835 | 11/1994 |
| JP | 10217496 | 8/1998 |
| JP | 2003011340 | 1/2003 |
| JP | 2005035033 | 2/2005 |
| JP | 2005088524 | 4/2005 |
| JP | 2006015706 | 1/2006 |
| WO | WO 99/47355 | 9/1999 |

* cited by examiner

*Primary Examiner*—Lamson D Nguyen
(74) *Attorney, Agent, or Firm*—Frommer Lawrence & Haug LLP

(57) ABSTRACT

An image recording apparatus that includes: a conductive cable and an ink supply tube each of which is fixed to a carriage at one end thereof and to an apparatus body at the other end thereof and is routed to form a curved portion; and a turn supporting member including an arm, a carrying portion provided on the arm, and a holding portion provided on the arm. The holding portion slidably holds a predetermined part of the ink tube. The flat cable is slidably supported on the carrying portion. The arm is supported on a turn supporting point on the apparatus body located at an inner part of the curved portion of each of the flat cable and the ink tube and is led from the turn supporting point in a substantially horizontal direction.

22 Claims, 23 Drawing Sheets

IMAGE RECORDING APPARATUS

CROSS-REFERENCE TO RELATED APPLICATION

This application claims priority from Japanese Patent Applications No. 2005-377432, No. 2005-377995, No. 2005-378729 and No. 2005-380109, which were filed on Dec. 28, 2005, the entire subject matter of which is incorporated herein by reference.

TECHNICAL FIELD

Aspects of the present invention relate to an image recording apparatus in which a recording head adapted to record an image on a recording medium is mounted on a carriage adapted to perform reciprocating movement in a direction intersecting with the recording medium, and in which an electrically conductive cable adapted to transmit a recording signal and an ink supply tube adapted to supply ink are connected to the carriage so that the electrically conductive cable and the ink supply tube follow the reciprocating movement of the carriage.

BACKGROUND

Hitherto, an apparatus which introduces ink to an actuator of a recording head and pressurizes and ejects ink by utilizing the bending of the actuator, such as a piezoelectric element or an electrostrictive element, according to an input signal or the local boiling of ink, which is caused by the actuator, such as a heating element, has been known as an image recording apparatus configured to record an image on a recording medium by ejecting ink according to an input signal.

For example, in an image recording apparatus referred to as a serial printer, the recording head is mounted on the carriage reciprocating in a direction perpendicular to a recording medium conveying direction. The serial printer records an image by reciprocating the carriage each time the recording medium is conveyed by a predetermined linefeed width. An electrically conductive flexible cable called a flat cable is connected to the carriage to control the recording head. The flat cable has a length sufficient to follow the reciprocating movement of the carriage without interfering therewith. The flat cable is disposed between the carriage and a main board and is bent substantially like a letter "U" (see, for example, JP-A-6-320835).

FIG. 23 shows a carriage 90 and a flat cable 91 of the conventional image recording apparatus. The carriage 90 reciprocates in a direction (a lateral direction, as viewed in FIG. 23) perpendicular to a conveying direction in which a sheet of recording paper is conveyed, while a recording head (not shown) mounted ejects ink to thereby form an image on the recording paper. The flat cable 91 is connected to the carriage 90 to transmit and receive electric signals to and from the main board. The flat cable 91 has an end portion 92 that is fixed to a frame (not shown) of the image recording apparatus and that is wired to the main board. Although not shown in FIG. 23, the carriage 90 is supported by guide members, such as a guide shaft and guide rails. A driving force is applied from a belt drive mechanism to the carriage 90.

As shown in FIG. 23, the flat cable 91 is led from the carriage 90 in a substantially horizontal direction and is bent substantially like a letter "U". When the carriage 90 reciprocates, the flat cable 91 follows this movement of the carriage 90. Thus, the central position of the substantially U-shaped curved portion is shifted. When the carriage 90 moves rightward, as indicated by double-dash-chain lines in FIG. 23, the shape of the flat cable 91 is changed to increase the radius of the U-shaped curved portion. When the carriage 90 moves leftward, the shape of the flat cable 91 is changed to decrease the radius of the U-shaped curved portion.

Also, in each of image recording apparatuses of the type that ink is supplied to a recording head through an ink tube, the ink tube extends from a carriage 90 and is routed substantially like a letter "U" to follow the reciprocating movement of the carriage 90, similarly to the flat cable 91 (see JP-A-10-217496, JP-A-2003-11340, JP-A-2005-35033, JP-A-63-154354 and JP-A-2005-88524).

SUMMARY

As described above, the flat cable and the ink tube, which are routed to follow the reciprocating movement of the carriage, have flexibility sufficient to change the radius and the position of each of the U-shaped curved portions. Thus, parts of the flat cable and the ink tube, which extend between the carriage and a stationary portion of an apparatus body, may hang down. Especially, in a case where the flat cable and the ink tube are routed in a substantially horizontal direction, the flat cable and the ink tube have a high tendency to hang down due to their own weights and the weight of ink. Additionally, in the case of a full-color printable printer, ink of a plurality of colors is supplied to the recording head. A plurality of ink tubes, the number of which corresponds to that of colors of ink, are provided therein. The plurality of ink tubes individually change shapes and follow the reciprocating movement of the carriage. However, sometimes, the shapes of the plurality of ink tubes are not integrally changed. Also, the plurality of ink tubes may spread apart from each other and may widely shake.

In a case where a space sufficient to reduce the thickness and the size of the apparatus is not present around the flat cable and the ink tube, as the carriage reciprocates, the flat cable or the ink tube may be damaged by touching another member. The damage of the flat cable causes breaking thereof. The damage of the ink tube causes ink leakage. Also, due to load generated when the flat cable or the ink tube touches another member, the movement speed of the carriage may become unstable, and that the picture quality of a recorded image may be degraded.

Aspects of the invention provide an image recording apparatus enabled to prevent each of an electrically conductive cable and an ink supply tube, which follow the movement of a carriage, from hanging down and widely shaking in an image recording apparatus having the carriage adapted to reciprocate in a direction intersecting with a recording medium conveying direction.

Also, an image recording apparatus is provided in which local stress is prevented from being generated on an ink supply tube when the ink supply tube follows the carriage and changes the shape thereof.

Further, an image recording apparatus is provided in which operation sounds sound of collision is prevented from being generated on an ink supply tube when the ink supply tube follows the carriage and changes the shape thereof.

As described above, the flat cable and the ink tube, which are routed to follow the reciprocating movement of the carriage, have flexibility sufficient to change the radius and the position of each of the U-shaped curved portions. Thus, for example, in a case where the carriage reciprocates at a high speed, the flat cable and the ink tube sometimes largely shake, or a plurality of ink tubes sometimes change shapes thereof and spread apart from each other. At that time, the flat cable may run aground or get into under the ink tubes to thereby cause engagement. Such engagement destabilizes the movement speed of the carriage and causes deterioration of a recorded imager. Thus, the flat cable may be damaged and broken.

In a case where the flat cable and the ink tube are routed in different directions, such engagement can be prevented. To that end, it is necessary to separately ensure a space sufficient to the extent that the flat cable changes the shape thereof and another space sufficient to the extent that the ink tubes change the shape thereof. This is contrary to the request for miniaturization of the apparatus. Especially, a sufficient space cannot be ensured around the flat cable and the ink tubes. Also, it is desired that a direction, in which the flat cable and the ink tubes are routed, is a horizontal direction.

Thus, aspects of the invention provide an image recording apparatus having a carriage adapted to reciprocating in a direction intersecting with a recording medium conveying direction, a flat cable, which follows the carriage, from running aground and getting into under an ink supply tube.

According to an aspect of the invention, there is provided an image recording apparatus, comprising: a recording head that records an image on a recording medium by ejecting ink droplets; a carriage that reciprocates in a direction intersecting a recording medium conveying direction, the recording head being mounted on the carriage; a conductive cable having flexibility to follow a reciprocating movement of the carriage and to change a shape thereof, the conductive cable being fixed to the carriage at one end thereof and to an apparatus body at the other end thereof, the conductive cable being routed to form a curved portion that turns around in a direction in which the carriage reciprocates, the conductive cable being adapted to transmit a recording signal to the recording head; an ink supply tube having flexibility to follow the reciprocating movement of the carriage and to change a shape thereof, the ink supply tube being fixed to the carriage at one end thereof and to the apparatus body at the other end thereof, the ink supply tube being routed in substantially a same direction as that, in which the conductive cable is routed, to form a curved portion that turns around, in the direction in which the carriage reciprocates, the ink supply tube being adapted to supply ink to the recording head; and a turn supporting member including an arm, a carrying portion provided on the arm, and a holding portion provided on the arm, the holding portion being adapted to slidably hold a predetermined part of the ink tube, the flat cable being slidably supported on the carrying portion, the arm being turnably and axially supported on a turn supporting point on the apparatus body located at an inner part of the curved portion of each of the flat cable and the ink tube, the arm being led from the turn supporting point in a substantially horizontal direction.

Thus, in the image recording apparatus, the carrying portion of the arm to be turned by utilizing the inner part of the curved portion of each of the flat cable and the ink tube as a turn supporting point is adapted to slidably support the conductive cable. Also, the holding portion of the arm is adapted to slidably hold the predetermined part of the ink supply tube. Consequently, as the shape of the ink supply tube changes, the arm is turned. The conductive cable and the ink supply tube, which follow the reciprocating movement of the carriage, are supported by the carrying portion and the holding portion of the arm. Accordingly, the conductive cable is prevented from hanging down. Also, the ink supply tube is prevented from acting violently and from hanging down. Additionally, the conductive cable and the ink supply tube do not touch another member. Thus, the conductive cable and the ink supply tube are prevented from being damaged. Also, the reciprocating movement of the carriage is stabilized. Moreover, because the carrying portion of the arm slidably holds the conductive cable thereon, an excessive load is not applied onto the conductive cable. Thus, the conductive cable is prevented from being damage.

According to another aspect of the invention, there is provided an image recording apparatus, comprising: a recording head that records an image on a recording medium by ejecting ink droplets; a carriage that reciprocates in a direction intersecting a recording medium conveying direction, the recording head being mounted on the carriage; an ink supply tube having flexibility to follow a reciprocating movement of the carriage and to change a shape thereof, the ink supply tube being fixed to the carriage at one end thereof and to a fixing portion of an apparatus body at the other end thereof, the ink supply tube being routed to form a curved portion that turns around in a direction in which the carriage reciprocates, the ink supply tube being adapted to supply ink to the recording head; a turn supporting member including an arm, and a holding portion provided on the arm, the holding portion being adapted to slidably hold a predetermined part of the ink tube, the arm being turnably and axially supported on a turn supporting point on the apparatus body located at an inner part of the curved portion, the arm being led from the turn supporting point in a substantially horizontal direction; and a regulating wall erected along the direction in which the carriage reciprocates and including a concave cutout portion adapted to prevent the holding portion from abutting against the regulating wall, the regulating wall being adapted to abut against at least a predetermined part of the ink supply tube to thereby regulate the ink supply tube from expanding in a direction away from the carriage.

Thus, the image recording apparatus is configured so that the concave cutout portion adapted to prevent the holding portion from abutting against the regulating wall is formed in the regulating wall which abuts against the predetermined part of the ink supply tube slidably held at least by the holding portion of the turn supporting member. Thus, even when the predetermined part of the ink supply tube abuts against the regulating wall, the holding portion of the turn supporting member does not abut against the regulating wall. Consequently, no sounds of the collision between the holding portion and the regulating wall are prevented from being generated when the ink supply tube changes the shape thereof. Also, local stress to be applied to the ink supply tube is prevented from being generated by the holding portion.

According to still another aspect of the invention, there is provided an image recording apparatus, comprising: a recording that records an image on a recording medium by ejecting ink droplets; a carriage that reciprocates in a direction intersecting a recording medium conveying direction, the recording head being mounted on the carriage; a flat cable having flexibility to follow a reciprocating movement of the carriage and to change a shape thereof, the flat cable being fixed to the carriage at one end thereof and to an apparatus body at the other end thereof, the flat cable being routed to form a curved portion that turns around in a direction, in which the carriage reciprocates, the flat cable including front and rear surfaces extending in a substantially vertical direction, the flat cable being adapted to transmit a recording signal to the recording head; a plurality of ink supply tubes having flexibility to follow the reciprocating movement of the carriage and to change shapes thereof, one end side part of each of the ink supply tubes being horizontally arranged along the recording medium conveying direction and fixed to the carriage, the other end side part of each of the ink supply tubes being vertically arranged and fixed to the apparatus body, each of the ink supply tubes being routed in substantially a same direction as that, in which the flat cable is routed, to form a curved portion that turns around in a direction in which the carriage reciprocates, each of the ink supply tubes being adapted to supply ink to the recording head, wherein one of the front and rear surfaces of the flat cable abuts against a closest one of the plurality of ink supply tubes at the curved portion.

Thus, the image recording apparatus is configured so that one end sides of a plurality of ink supply tubes are fixed to the carriage and are arranged horizontally along the recording medium conveying direction, that the other end sides of the plurality of ink supply tubes are fixed to the fixing portions of the apparatus body are vertically arranged, that the curved portions adapted to turn around in the direction, in which the carriage reciprocates, are formed. Also, the flat cable is configured to extend in the same direction as the direction, in which the ink supply tubes extend, so that one of the front and rear surfaces of the flat cable is able to abut against the closest one of the plurality of ink supply tubes at the curved portion. Thus, the flat cable does not run aground or get into under the plurality of ink supply tubes in the vicinity of the curved portion thereof. Consequently, the top or bottom end of the flat cable is prevented from touching the ink supply tube and from being damaged or broken.

According to still another aspect of the invention, there is provided an image recording apparatus, comprising: a recording head that records an image on a recording medium by ejecting ink droplets; a carriage that reciprocates in a direction intersecting a recording medium conveying direction, the recording head being mounted on the carriage; an ink supply tube having flexibility to follow a reciprocating movement of the carriage and to change a shape thereof, the ink supply tube being fixed to the carriage at one end thereof and to a fixing portion of an apparatus body at the other end thereof, the ink supply tube being routed to form a curved portion that turns around in a direction in which the carriage reciprocates, the ink supply tube being adapted to supply ink to the recording head; a turn supporting member including an axis portion serving as a turn supporting point, an arm extending substantially horizontally from the axis portion, and a holding portion provided on the arm, the holding portion being adapted to slidably hold a predetermined part of the ink tube; and a support board disposed on the apparatus body such that the entirety of the arm including vicinity of the holding portion is positioned above the support board in a part of a turning range of the turn supporting member, the support board having a shaft hole for supporting the axis portion at an inner part of the curved portion, wherein the holding portion is formed into a shape, in which the ink supply tube is held from at least three directions, by being curved from the arm, and a part of the holding portion is formed at a side opposite to the support board with respect to a plane of rotation of the arm.

Thus, the image recording apparatus is configured so that a part of the holding portion of the turn supporting member is formed opposite to the supporting substrate with respect to the plane of rotation of the arm. Consequently, when the vicinity of the holding portion of the arm is accommodated in the support board, no part of the holding portion abuts against the support board. Accordingly, the generation of sounds of the collision between the holding portion of the turn supporting member and the support substrate is prevented.

DETAILED DESCRIPTION

Hereinafter, an aspect of the invention is described with reference to the accompanying drawings. Incidentally, the present aspect is only an example of an apparatus according to the invention. It is apparent to those skilled in the art that the present aspect can appropriately be modified without departing from the spirit and scope of the invention.

Figure 1:
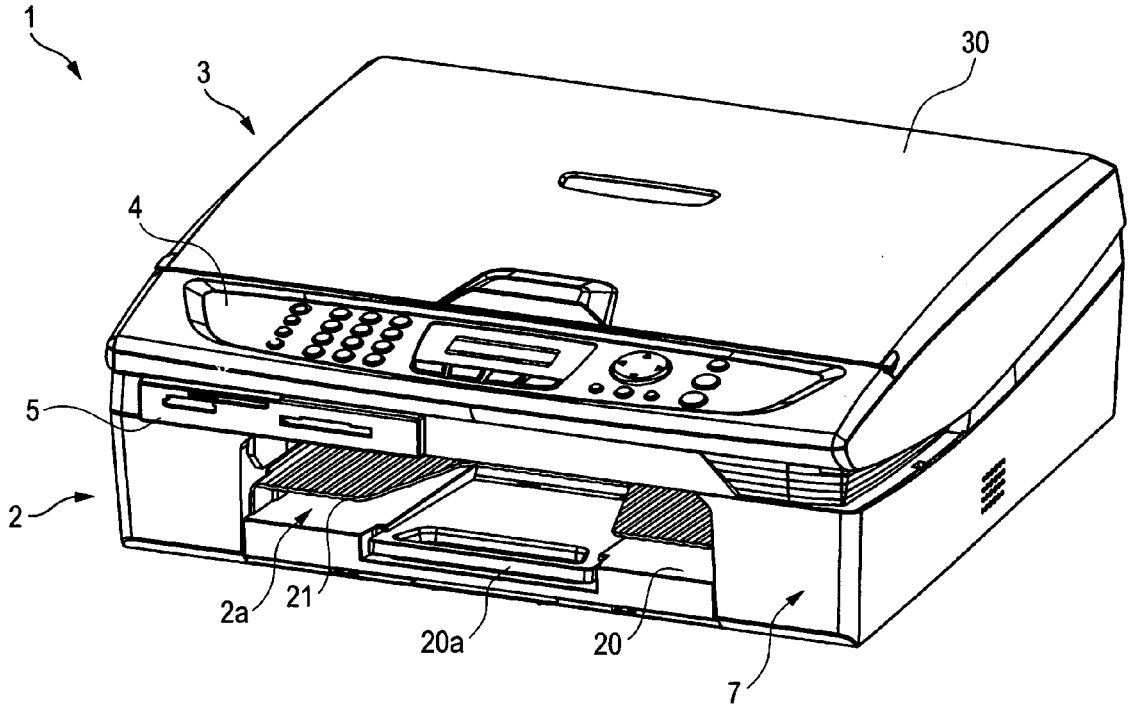
FIG. 1 is a perspective view illustrating the outer appearance of a multifunction apparatus according to an aspect of the invention.
Figure 2:
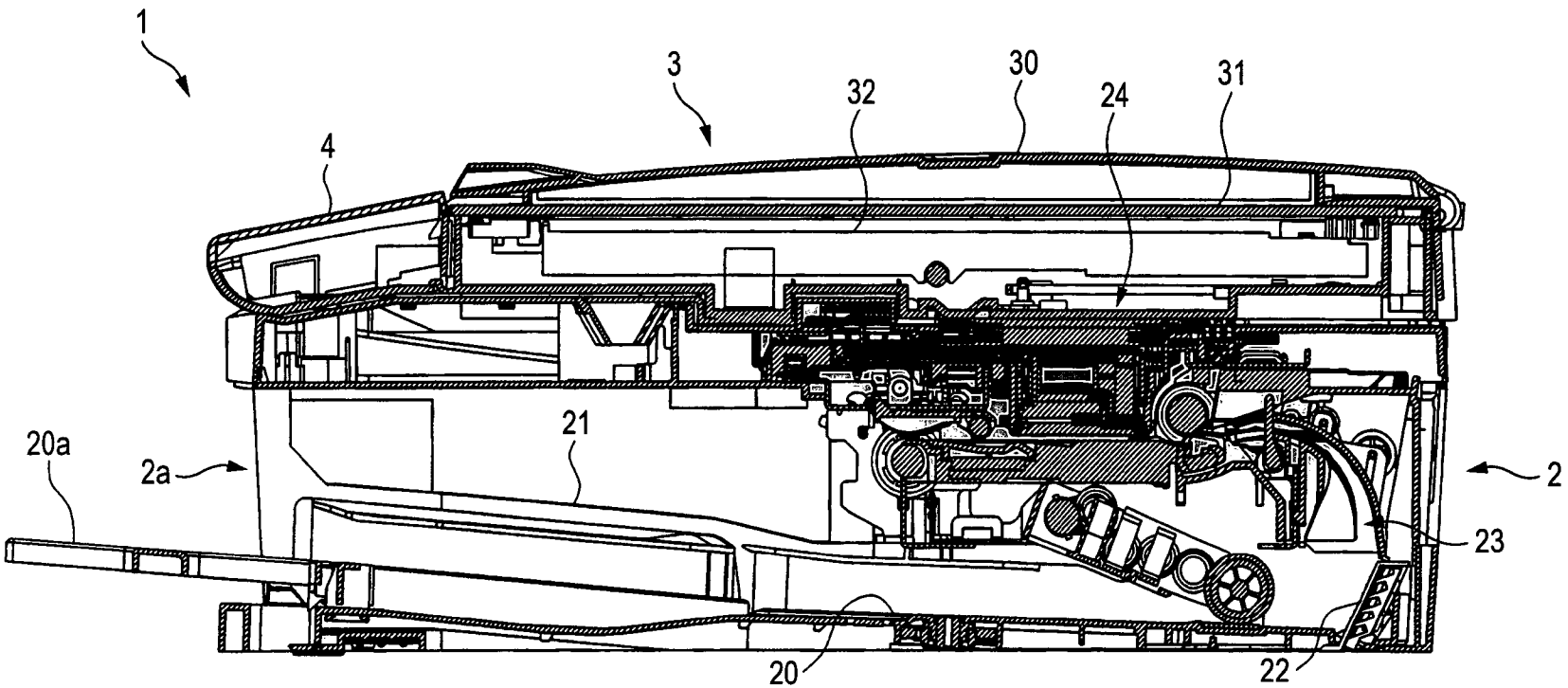
FIG. 2 is a longitudinal cross-sectional view illustrating the internal configuration of the multifunction apparatus.

FIG. 1 is a perspective view illustrating the outer appearance of a multifunction apparatus 1 according to an aspect of the invention. FIG. 2 is a longitudinal cross-sectional view illustrating the internal configuration of the multifunction apparatus 1. The multifunction apparatus 1 is a multi-function device (MFD) that integrally has a printer portion 2, which is provided at a lower part thereof, and a scanner portion 3 provided at an upper part thereof. The multifunction apparatus 1 has a printer function, a scanner function, a copy function, and a facsimile function. The printer portion 2 of the multifunction apparatus 1 corresponds to an image recording apparatus. The functions other than the printer function are optional. The image recording apparatus may be implemented as, for example, a single-function printer that dose not have a scanner portion 3 and that has neither the scanner function nor the copy function.

The printer portion 2 of the multifunction apparatus 1 is connected mainly to external information devices, such as a computer, and records an image and a document on sheets of recording paper according to print data that is transmitted from the computer and that includes image data and document data. Incidentally, the multifunction apparatus 1 can be connected to a digital camera and can record image data outputted from the digital camera on recording paper. Alternatively, the multifunction apparatus 1 can be loaded with a storage medium, such as a memory card, and also can record image data, which is stored in a storage medium, on recording paper.

As shown in FIG. 1, the multifunction apparatus 1 has an outer shape of a substantially rectangular parallelepiped that is wide and thin and that has a width and a depth, which are larger than height. The lower part of the multifunction apparatus 1 is the printer portion 2. An opening 2*a* is formed in a front part of the printer portion 2. A paper feed tray 20 and a paper discharge tray 21 are provided inside the opening 2*a* as double-deck trays consisting of upper and lower trays. Sheets of recording paper serving as a recording medium are stored on the paper feed tray 20. Recording paper sheets having various sizes which are equal to or less than A4 size, for example, B5 size, and a postcard size, are accommodated on the paper feed tray 20. The paper feed tray is adapted so that a tray surface is enlarged by drawing out a slide tray 20*a*, as shown in FIG. 2, as need arises. Thus, for example, sheets of legal-size recording paper can be accommodated thereon. The recording paper sheets accommodated on the paper feed tray 20 are fed into the printer portion 2. Then, a desired image is recorded on the recording paper at the printer portion 2. Subsequently, the recording paper, on which the image is recorded, is discharged to the paper discharge tray 21.

The upper part of the multifunction apparatus 1 is the scanner portion 3 that is constituted as what is called a flat bed scanner. As shown in FIGS. 1 and 2, a platen glass 31 and an image sensor 32 are provided under an original-document cover 30. An original document, from which an image is read, is placed on the platen glass 31. An image sensor 32 employing a depth direction (a lateral direction shown in FIG. 2) as a main scanning direction is provided under the platen glass 31 to be able to reciprocate in a direction of width (a direction perpendicular to paper on which FIG. 2 is drawn) of the multifunction apparatus 1.

An operation panel 4 used to operate the printer portion 2 and the scanner portion 3 is provided at an upper front part of the multifunction apparatus 1. The operation panel 4 includes various operation buttons and a liquid crystal display portion. The multifunction apparatus 4 operates according to an operation instruction sent from the operation panel 4. In a case where the multifunction apparatus 1 is connected to the external computer, the multifunction apparatus 1 also operates according to instructions transmitted from this computer through a printer driver or a scanner driver. A slot portion 5 is provided in an upper-left front part of the multifunction apparatus 1. Various small memory cards serving as storage media can be loaded into the slot portion 5. A predetermined operation is performed on the operation panel 4 to thereby read image data stored in the small memory card that is loaded into the slot portion 5. Information on the read image data is displayed in the liquid crystal display portion of the operation panel 4. A given image can be recorded on recording paper by the printer portion 2 according to the display of this information.

Hereinafter, the inner configuration of the multifunction apparatus 1, especially, the configuration of the printer portion 2 is described with reference to FIGS. 2 to 14. The paper feed tray 20 is provided at a bottom part of the multifunction apparatus 1. A separating inclined plate 22 is provided at an innermost part of the paper feed tray 20. The separating inclined plate 22 separates recording paper sheets overlappedly fed from the paper feed tray 20 and upwardly guides the uppermost recording paper. A paper conveyance path 23 extends upwardly from the separating inclined plate 22 and then turns and extends toward the front side of the multifunction apparatus 1 from the rear side thereof. The paper conveyance path 23 further extends to the paper discharge tray 21 through an image recording unit 24. Therefore, the recording paper accommodated on the paper feed tray 20 is guided to the image recording unit 24 by the paper conveyance path 23 to turn around upwardly from below. After an image is recorded thereon by the image recording unit 24, the recording paper is discharged to the paper discharge tray 21.

Figure 3:
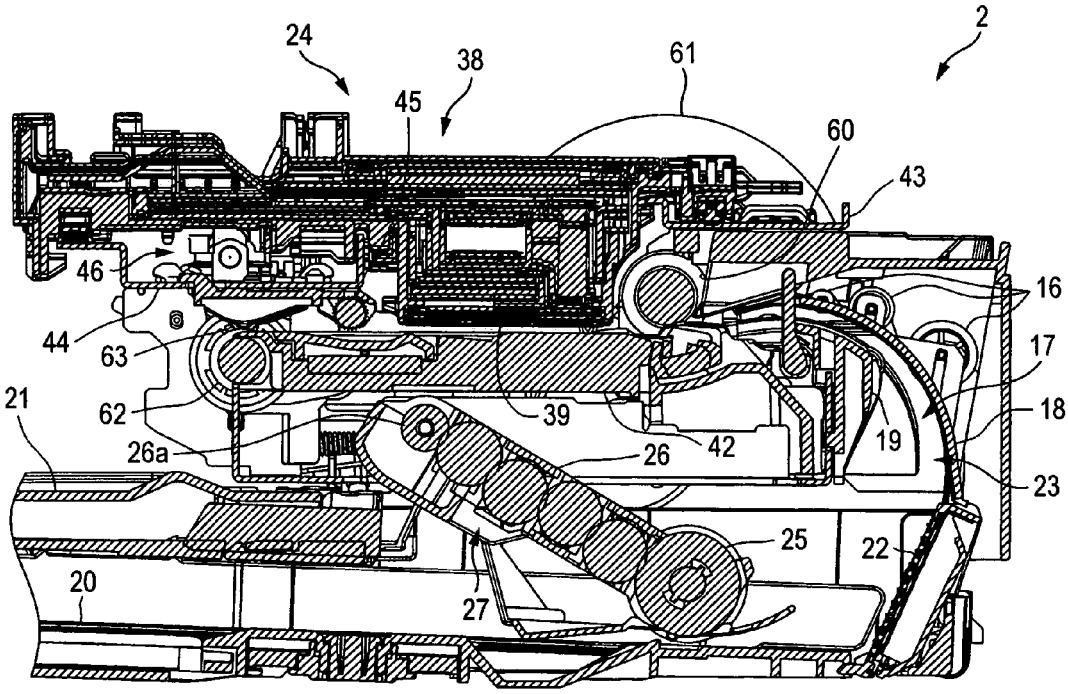
FIG. 3 is an enlarged cross-sectional view illustrating the configuration of a printer portion.

FIG. 3 is a partially enlarged cross-sectional view illustrating the configuration of the printer portion 2. As shown in FIG. 3, a paper feed roller 25 supplying recording paper sheets stacked on the paper feed tray 20 to the paper conveyance path 23 is provided above the paper feed tray 20. The paper feed roller 25 is axially supported on an end part of a paper feed arm 26. A driving force transmitting mechanism 27 including a plurality of engaged gears transmits a driving force of an LF (Load Factor) motor 71 (see FIG. 7) to the paper feed roller 25. Thus, the paper feed roller 25 is rotated by the transmitted driving force.

The paper feed arm 26 is disposed by using a base shaft 26*a* as a turning shaft, and moves up and down to be able to come close to and apart from the paper feed tray 20. As shown in FIG. 3, the paper feed arm 26 is downwardly turned due to the own weight thereof or by being pushed with a spring to touch the paper feed tray 20. The paper feed arm 26 is configured to be able to upwardly retreat when the paper feed tray 20 is inserted and removed. The paper feed roller 25 axially supported on an end of the paper feed arm 26 is pressure-contacted with the recording paper stacked on the paper feed roller 25 by downwardly turning the paper feed arm 26. When the paper feed roller 25 is rotated in this state, the uppermost recording paper is sent out to the separating inclined plate 22 by a frictional force acting between the roller surface of the paper feed roller 25 and the recording paper. A leading end of the recording paper abuts against the separating inclined plate 22. Then, the recording paper is upwardly guided and is sent out to the paper conveyance path 23. Sometimes, the recording paper placed just under the uppermost recording paper is also sent out by friction and/or electrostatic action when the uppermost recording paper is sent out by the paper feed roller 25. However, the recording paper placed just under the uppermost recording paper abuts against the separating inclined plate 22 and is consequently stopped.

The paper conveyance path 23 includes an outer guide surface and an inner guide surface, which are opposed at a predetermined distance, in a part other than a part where the image recording unit 24 is disposed. For example, the curved portion 17 of the paper conveyance path 23 disposed at the rear side of the multifunction apparatus 1 is constructed by fixing an outer guide member 18 and an inner guide member 19 to a frame of the apparatus 1. Rotating rolls 16 are rotatably provided, especially, at places, at each of which the paper conveyance path 23 is curved, so that the roller surface of each of the rotating rolls 16 is exposed to the outer guide surface, and that the direction of width of the paper conveyance path 23 is set to be an axial direction. The recording paper slide-contacted with the guide surface is smoothly conveyed at the places, at each of which the paper conveyance path 23 is curved, by the rotatable rotating rollers 16.

As shown in FIG. 3, the image recording unit 24 is provided on the paper conveyance path 23. The image recording unit 24 has a carriage 38 on which an inkjet recording head 39 is mounted. The carriage 38 reciprocates in a main scanning direction. Cyan (C) ink, magenta (M) ink, yellow (Y) ink, and black (Bk) ink are respectively supplied through an ink tube 41 (an ink supply tube (see FIG. 4) from ink cartridges provided in the multifunction apparatus 1 independent of the ink recording head 39. An image is recorded on recording paper, which is conveyed on a platen 42, by selectively discharging the color ink from the inkjet recording head 39 as micro ink droplets, while the carriage 38 reciprocates. Incidentally, FIGS. 3 and 4 do not show all the ink cartridges respectively storing ink liquids of the colors.

Figure 4:
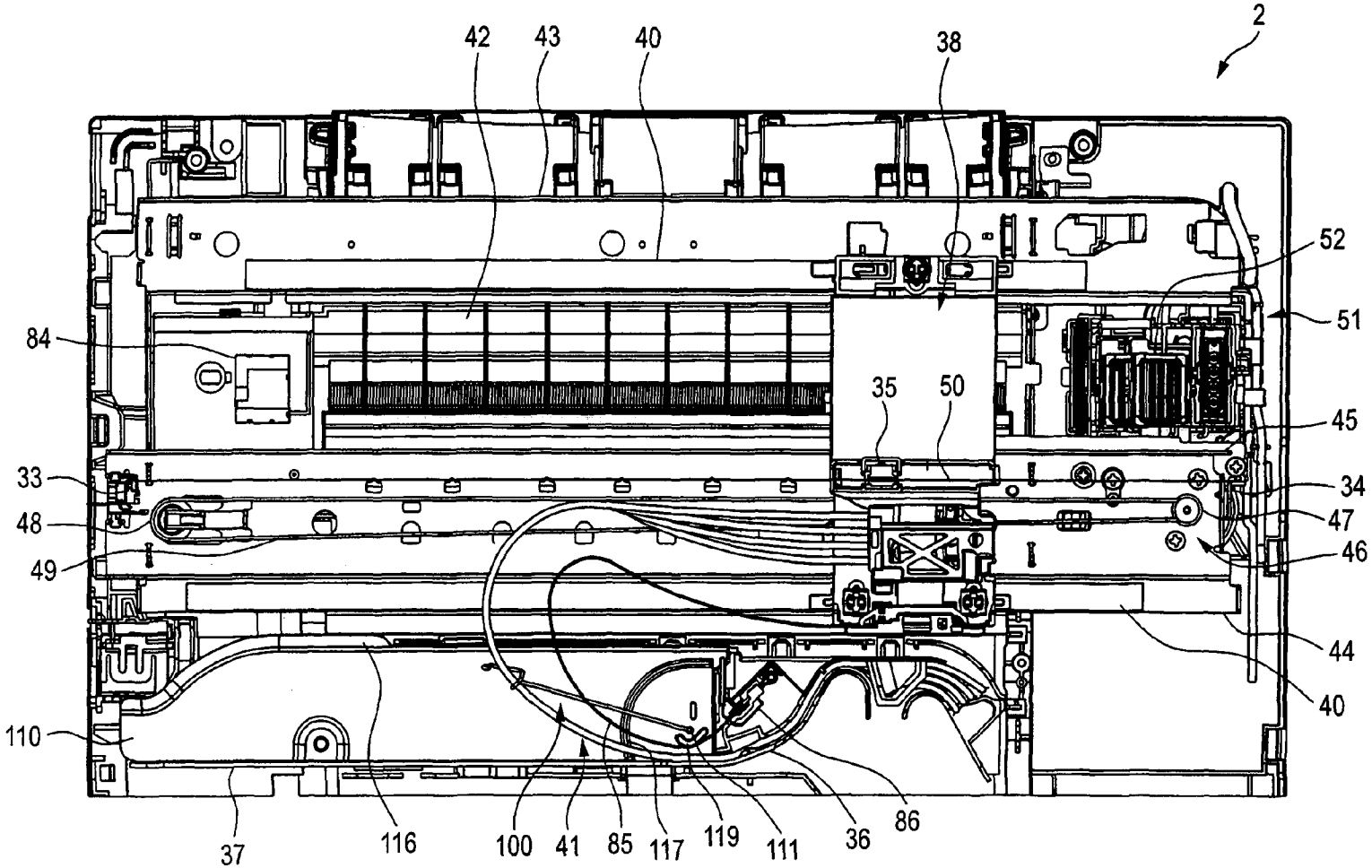
FIG. 4 is a plan view illustrating the printer portion.

FIG. 4 is a plan view illustrating the configuration of the printer portion 2. FIG. 4 mainly shows the configuration of a part extending from the substantially center to the rear side of the printer portion 2. As shown in FIG. 4, paired guide rails 43 and 44 are provided above the paper conveyance path 23 to be apart at a predetermined distance from each other, and to extend in a direction perpendicular to a recording medium conveying direction (a lateral direction, as viewed in FIG. 4). The guide rails 43 and 44 constitute a part of a frame that is provided in a casing of the printer portion 2 and supports members of the printer portion 2. The carriage 38 is placed to straddle a pair of the guide rails 43 and 44, and to be slidable in a direction perpendicular to the recording medium conveying direction. Thus, the guide rails 43 and 44 are arranged substantially horizontally in the recording medium conveying direction. Consequently, the height of the printer portion 2 is reduced to thereby decrease the thickness of the apparatus.

The guide rail 43 disposed at the upstream side in the recording medium conveying direction is shaped like a flat plate whose length in the direction of width (the lateral direction, as viewed in FIG. 4) of the paper conveyance path 23 is longer than the range of the reciprocating movement of the carriage 38. A sliding tape 40 is stuck onto the top surface of the guide rail 43 along an edge portion at the downstream side in the conveying direction thereof. The sliding tape 40 serves to reduce the sliding friction caused between the guide rail 43 and the carriage 38. An end portion at the upstream side in the conveying direction of the carriage 38 is placed on the sliding tape 40 and is slid in the longitudinal direction of the sliding tape 40.

An edge portion at the upstream side in the conveying direction of the guide rail 44 is upwardly bent at a substantially right angle, as shown in FIG. 3. The carriage 38 supported on the guide rails 43 and 44 supports the edge portion 45 slidably by sandwiching the edge portion 45 with sandwiching members, such as a roller pair. Consequently, the carriage 38 is positioned in the recording paper conveying direction, and is enabled to slide in a direction intersecting with (according to the present aspect, in a direction perpendicular to) the recording paper conveying direction. That is, the carriage 38 is slidably supported on the guide rails 43 and 44 and reciprocates in the direction intersecting with the recording paper conveying direction. Although not illustrated in FIGS. 3 and 4, a lubricant agent, such as grease, is applied onto the edge portion 45 to enable smooth sliding movement thereof.

A belt drive mechanism 46 is disposed on the top surface of the guide rail 44. The belt drive mechanism 46 is configured so that an inwardly-toothed endless-loop-like timing belt 49 is stretched between a drive pulley 47 and a driven pulley 48, which are provided in the vicinities of both ends in the direction of width of the paper conveyance path 23. A driving force is inputted from a CR motor 73 (see FIG. 7) to the shaft of the drive pulley 47. A rotation of the drive pulley 47 causes the timing belt 49 to circumferentially move. Instead of using the endless-belt-like timing belt, an ended belt may be used as the timing belt 49 by fixing both end portions of the ended belt to the carriage 38.

The carriage 38 is fixed to the timing belt 49 at the bottom thereof. Accordingly, the carriage 38 reciprocates on the guide rails 43 and 44 according to the circumferential movement of the timing belt 49 with respect to the edge portion 45. The inkjet recording head 39 is mounted on the carriage 38 and is caused to reciprocate by employing the direction of width of the paper conveyance path 23 as a main scanning direction.

An encoder strip 50 of a linear encoder 77 (see FIG. 7) is disposed on the guide rail 44. The encoder strip 50 is shaped like a belt made of a transparent resin. A pair of support portions 33 and 34 is formed at both end portions in the direction of width (that is, in a direction in which the carriage 38 reciprocates) of the guide rail 44 to be erected from the top surfaces thereof. Both end portions of the encoder strip 50 are caught by the support portions 33 and 34, respectively, so that the encoder strip 50 is provided to hang along the edge portion 45. Although not shown in the figure, a plate spring is provided at one of the support portions 33 and 34. The end portion of the encoder strip 50 is caught by this plate spring. Looseness is prevented by this plate spring from occurring in the encoder strip 50 due to a tensile force acting in the longitudinal direction of the encoder strip 50. In a case where an external force acts upon the encoder strip 50, the plate spring elastically deforms, so that the encoder strip 50 bends.

A pattern, in which a light transmitting portion and a light shielding portion are alternately arranged in a longitudinal direction at a predetermined pitch, is printed on the encoder strip 50. An optical sensor 35 serving as a transmission type sensor is provided at a place on the top surface of the carriage 38, which corresponds to the encoder strip 50. The optical sensor 35 reciprocates along the longitudinal direction of the encoder strip 50 together with the carriage 38 and detects the pattern on the encoder strip 50 while performing a reciprocating movement. A head control board operative to control the ejection of ink is provided in the inkjet recording head 39. The head control board outputs a pulse signal according to a detection signal outputted from the optical sensor 35. The position and the speed of the carriage 38 are determined according to this pulse signal. Thus, the reciprocating movement of the carriage 38 is controlled. The head control board is covered with a head cover of the carriage 38 and is not shown in FIG. 4.

As shown in FIGS. 3 and 4, the platen 42 is disposed under the paper conveyance path 23 to face the inkjet recording head 39. The platen 42 is placed over a central portion, through which recording paper passes, in a range in which the carriage 38 reciprocates. The width of the platen 42 is sufficiently larger than the maximum width of conveyable recording paper, that is, the maximum width of recording paper in a direction perpendicular to the conveying direction. Consequently, both sides of the recording paper always pass through on the platen 42.

As shown in FIG. 4, maintenance units, such as a purge mechanism 51 and a waste ink tray 84, are disposed in a range through which no recording paper passes, that is, outside a range in which images are recorded by the inkjet recording head 39. The purge mechanism 51 is operative to remove air bubbles and foreign substances from a nozzle 53 (see FIG. 5) of the inkjet recording head 39. The purge mechanism 51 includes a cap 52 with which a nozzle 53 of the inkjet recording head 39 is covered, a pump mechanism to be connected to the inkjet recording head 39 through the cap 52, and a movement mechanism operative to move the cap 52 close to and away from the nozzle 53. The pump mechanism and the movement mechanism are placed under the guide rail 44 and are not shown in FIG. 4. When air bubbles are removed from the inkjet recording head 39, the carriage 38 is moved so that the inkjet recording head 39 is placed above the cap 52. In such a state, the cap 52 is upwardly moved and is attached closely to the bottom surface of the inkjet recording head 39 to seal up the nozzle 53. The inner pressure of a space enclosed by the cap 52 is reduced by the pump mechanism to a negative pressure. Consequently, ink is sucked from the nozzle 53 of the inkjet recording head 39. Air bubbles and foreign substances in the nozzle 53 are removed together with the ink by being sucked.

The waste ink tray 84 is used to receive ink outputted from the inkjet recording head 39 by performing an idle ejection called "flashing". The waste ink tray 84 is formed on the top surface of the platen 42, in a reciprocating range, in which the carriage 38 reciprocates, and outside an image recording range. A felt mat is laid down in the waste ink tray 84. Flashed ink is absorbed into and is held by the felt mat. These maintenance units perform maintenance operations of removing the gas bubbles and color mixing ink from the inside of the inkjet recording head 39 and preventing the inside of the inkjet recording head 39 from being dried.

As shown in FIG. 1, a door 7 is openably and closably provided at the front of a casing of the printer portion 2. When the door 7 is opened, a cartridge mounting portion is exposed to the front of the apparatus. Thus, ink cartridges can be mounted therein and also can be demounted therefrom. Although not shown in this figure, the cartridge mounting portion is partitioned into four accommodating chambers, into each of which an associated one of ink cartridges respectively holding cyan ink, magenta ink, yellow ink, and black ink is accommodated. Four ink tubes respectively corresponding to these colors of the ink are routed from the cartridge mounting portion to the carriage 38. Thus, ink of each of these colors is supplied to the inkjet recording head 39 mounted in the carriage 38 from a corresponding one of the ink cartridges mounted in the cartridge mounting portion. However, the configuration of the cartridge mounting portion is not the feature of the invention. Therefore, the configuration of the cartridge mounting portion is not described in detail.

Each of the ink tubes 41 is made of a synthetic resin and has flexibility sufficient to follow the reciprocating movement of the carriage 38 to bend. Each of the ink tubes 41 is drawn out of the cartridge mounting portion to the vicinity of the center of the apparatus along the direction of width thereof, and is temporarily fixed to a fixing clip 36 of the apparatus body. Apart of each of the ink tubes 41 extends from the fixing clip 36 to the carriage 38 and is not fixed to the apparatus body. The shape of this part of the ink tubes 41 changes by following the reciprocating movement of the carriage 38. In FIG. 4, the other part of each of the ink tubes 41 extending from the fixing clip 36 to the cartridge mounting portion (not shown) is omitted.

As shown in FIG. 4, the former part of each of the ink tubes 41, which extends from the fixing clip 36 to the carriage 38, is routed to form the curved portion that turns around in a reciprocating direction, in which the carriage 38 reciprocates. That is, the ink tube 41 is routed to have a substantially U-shape in plan view. The four ink tubes 41 are arranged horizontally along the recording paper conveying direction in the carriage 38, and are led out in the reciprocating direction in which the carriage 38 reciprocates. On the other hand, the four ink tubes 41 are fixed by being arranged to be vertically stacked in the fixing clip 36. The fixing clip 36 is a cross-sectionally U-shaped member that is upwardly opened. Each of the ink tubes 41 is inserted from an opening of the fixing clip 36, so that the four ink tubes 41 are surrounded by and are integrally supported by the fixing clip 36. Consequently, the four ink tubes 41 extends from the carriage 38 to the fixing clip 36 by being twisted so that the horizontally arranged ink tubes 41 come to be vertically arranged, and that all the four ink tubes 41 are curved like a substantially U-shape as a whole.

The part of each of the four ink tubes 41, which extends from the carriage 38 to the fixing clip 36, is formed to have a substantially equal length. The ink tube 41 disposed at the most upstream side in the recording paper conveying direction on the carriage 38 is placed at the uppermost side in the fixing clip 36. The ink tube 41 disposed at the second most upstream side in the recording paper conveying direction on the carriage 38 is placed at the second uppermost side in the fixing clip 36. Such a placement of the ink tube is repeatedly performed on the ink tubes 41 in sequence from the ink tube 41 disposed at the most upstream side in the recording paper conveying direction to the ink tube 41 disposed at the most downstream side in the recording paper conveying direction. Thus, the ink tubes 41 disposed on the carriage 38 from the ink tube 41 disposed at the most upstream side in the recording paper conveying direction to the ink tube 41 disposed at the most downstream side in the recording paper conveying direction are placed at places from the place, which corresponds to the uppermost side in the fixing clip 36, and to the place, which corresponds to the lowermost side in the fixing clip 36, in sequence. The lengths of the ink tubes 41 are substantially equal to one another. Thus, according to the placement of the ink tubes 41 in the recording paper conveying direction of the carriage 38, the ink tubes 41 are curved so that the center of the curved portion, which is substantially U-shaped, is shifted in the recording paper conveying direction. Consequently, the curved portions of the four ink tubes 41 are arranged in an oblique line from the curved portion of the uppermost ink tube to that of the lowermost ink tube. This reduces the possibility of causing the interference among the ink tubes 41 when the shapes of the ink tubes 41 are changed by following the movement of the carriage 38. Because the four ink tubes 41 are configured to have the substantially same length, it is unnecessary to dispose an ink tube 41 having a specific length at a specific place of the carriage 38 or the fixing clip 36. The assembly of a plurality of ink tubes 41 is easily achieved. The present embodiment has been described as the apparatus including the four ink tubes 41. However, in a case where the number of the ink tubes 41 is increased, similarly, the ink tubes 41 disposed on the carriage 38 from the ink tube 41 disposed at the most upstream side in the recording paper conveying direction to the ink tube 41 disposed at the most downstream side in the recording paper conveying direction are sequentially placed at places from the place, which corresponds to the uppermost side in the fixing clip 36, and to the place, which corresponds to the lowermost side in the fixing clip 36, in sequence.

A recording signal is transmitted from the main board of a control portion 64 (see FIG. 7) to the head control board of the inkjet recording head 39 through a flat cable (or electrically conductive cable) 85. The main board is disposed on the front side (or near side, as viewed in FIG. 4) of the apparatus. However, the main board is not shown in FIG. 4. The flat cable 85 is a thin-band-like cable formed by covering a plurality of electrically conductive cables, through which electric signals are transmitted, with a synthetic resin film, such as a polyester film and by also insulating the plurality of electrically conductive cables with a synthetic resin film. The flat cable 85 electrically connects the main board (not shown) and the head control board (not shown).

The flat cable 85 has flexibility sufficient to follow the reciprocating movement of the carriage 38 to bend. As shown in FIG. 4, a part of each of the flat cable 85 extends to a fixing clip 86 from the carriage 38 and is routed to form a curved portion that turns around in a reciprocating direction, in which the carriage 38 reciprocates. That is, the flat cable 85 is routed to have a substantially U-shape in plan view in a case where a direction, in which the front and rear surfaces of the thin-band-like cable extend, is set to be a vertical direction. That is, a normal to the front and rear surfaces of the thin-band-like cable extends in a horizontal direction, and the front and rear surfaces extended in the vertical direction. Additionally, a direction in which the flat cable 85 extends from the carriage 38, and a direction in which the ink tubes 41 extend, are the same as that in which the carriage 38 reciprocates.

As described above, one end of the flat cable 85 is electrically connected to the head control board (not shown) mounted on the carriage 38. The other end of the flat cable 85, which is fixed to the fixing clip 86, extends to and is electrically connected to the main board. The curved part of the flat cable 85, which is substantially U-shaped, is fixed to no members. Similarly to the ink tubes 41, the flat cable 85 follows the reciprocating movement of the carriage 38 and changes the shape. Thus, the ink tubes 41 and the flat cable 38, each of which follows the reciprocating movement of the carriage 38 and change the shape, are supported by a turn supporting member 100. The configuration of the turn supporting member 100 will be described later in detail.

A regulating wall 37 is provided at the apparatus front side of each of the ink tubes 41 and the flat cable 85 to extend in the direction of width of the apparatus (that is, a lateral direction in FIG. 4). The regulating wall 37 has a wall surface that abuts against the ink tubes 41 and that extends in the vertical direction. The regulating wall 37 is linearly erected along the reciprocating direction of the carriage 38. The regulating wall 37 is provided to extend in a direction in which the ink tubes 41 extends from the fixing clip 36 serving to fix the ink tubes 41. The regulating wall 37 has a height sufficient to the extent that all the four ink tubes 41 can abut against the regulating wall 37.

The ink tubes 41 extend from the fixing clip 36 along the regulating wall 37 and abut against the apparatus rear side wall surface of the regulating wall, so that the ink tubes 41 are regulated from expanding to the front side of the apparatus, that is, expanding in a direction apart from the carriage 38. In a state in which the ink tubes 41 abut against the regulating wall 37 (see FIG. 13), a part of each of the ink tubes 41, which extends from the fixing clip 36 to the curved portion, is maintained in the vertical arrangement in the fixing clip 36. Thus, the ink tubes 41 are surely maintained in a desired oblique arrangement at the curved portions that are substantially U-shaped.

The fixing clip 36 is provided in the vicinity of the substantial center in a direction of width of the apparatus and fixes the ink tubes 41 to extend toward the regulating wall 37. That is, the vertically extending wall surface of the regulating wall 37 and the direction, in which the ink tubes 41 extend from the fixing clip 36, form an obtuse angle that is less than 180° in plan view. Although the ink tubes 41 have flexibility, the ink tubes 41 have elasticity (that is, bending stiffness). Thus, the ink tubes 41 are pushed against the wall surface of the regulating wall 37 by causing the ink tubes 41 to extend from the fixing clip 36 at a certain angle with respect to the regulating wall 37. Consequently, a region, in which the ink tubes 41 are pushed against along the regulating wall 37, is increased in the range in which the carriage 38 reciprocates. Accordingly, a region, in which the part extending to the carriage 38 from the curved portion of each of the ink tubes 41 expands toward the apparatus rear side, that is, toward the carriage 38, can be decreased.

The fixing clip 86 is provided in the vicinity of the substantially center in the direction of width of the apparatus and at the inner side of the curved portion of the fixing clip 36. The fixing clip 86 fixes the flat cable 85 so that the flat cable 85 extends toward the regulating wall 37. That is, the vertically extending wall surface of the regulating wall 37 and the direction, in which the flat cable 85 extends from the fixing clip 86, form an obtuse angle that is less than 180° in plan view. Although the flat cable 85 has flexibility, the flat cable 85 has elasticity (that is, bending stiffness). Thus, the flat cable 85 is pushed against the wall surface of the regulating wall 37 by causing the flat cable 85 to extend from the fixing clip 86 at a certain angle with respect to the regulating wall 37. Consequently, a region, in which the flat cable 85 is pushed against along the regulating wall 37, is increased in the range in which the carriage 38 reciprocates. Accordingly, a region, in which the part extending to the carriage 38 from the curved portion of each of the flat cable 85 expands toward the apparatus rear side, that is, toward the carriage 38, can be decreased.

Figure 5:
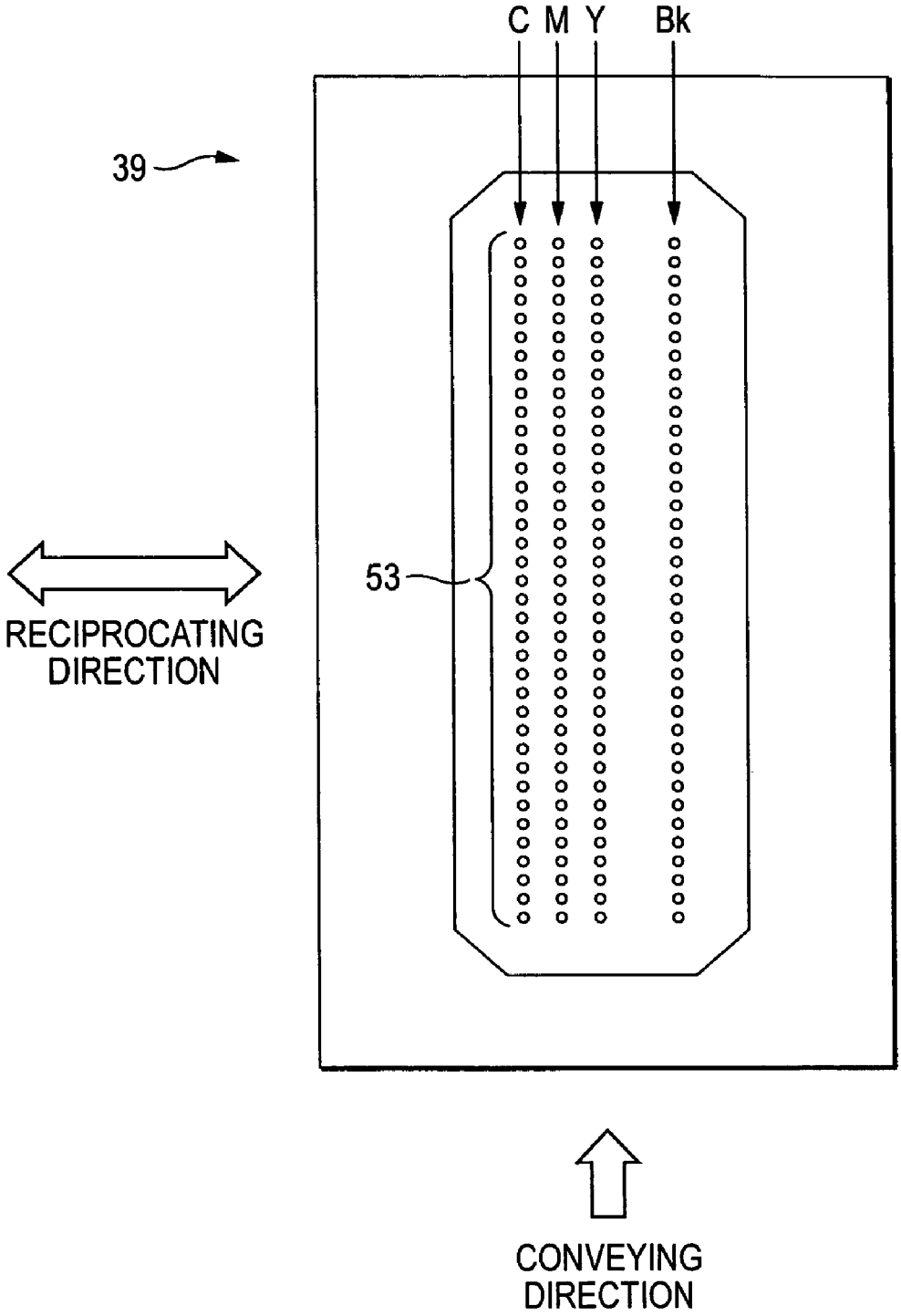
FIG. 5 is a bottom view illustrating a nozzle formed surface of an inkjet recording head.

FIG. 5 is a bottom view illustrating a nozzle formed surface of the inkjet recording head 39. As shown in FIG. 5, a row of nozzles corresponding to each of the colors of ink, which are cyan (C), magenta (M), yellow (Y), and black (Bk), are provided in the bottom surface of the inkjet recording head 39 to be arranged in the recording paper conveying direction. A lateral direction, as viewed in FIG. 5, is the reciprocating direction in which the carriage 38 reciprocates. The nozzles 53 of the rows respectively corresponding to the colors C, M, Y, and Bk of ink are arranged in the recording paper conveying direction. Lines of the nozzles 53 respectively corresponding to the colors C, M, Y, and Bk of ink are arranged in the reciprocating direction in which the carriage 38 reciprocates. The pitch, at which the nozzles 53 are arranged in the conveying direction, and the number of the nozzles 53 arranged in the conveying direction are appropriately set in consideration of the resolution required to record an image. The number of rows of the nozzles 53 can be changed according to the number of kinds of color ink.

Figure 6:
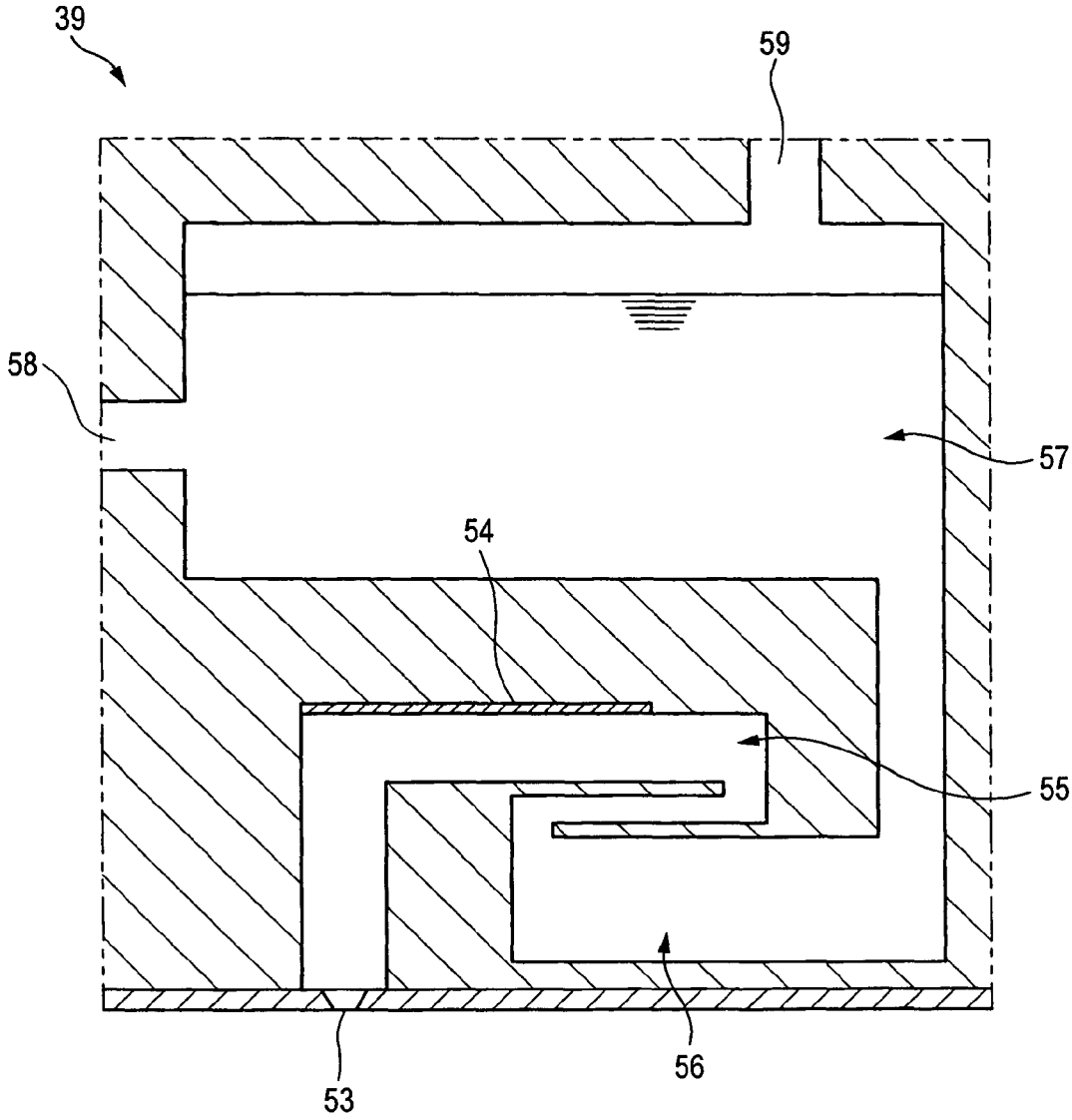
FIG. 6 is a schematic cross-sectional view illustrating the configuration of the inkjet recording head.

FIG. 6 is a schematic partially-enlarged cross-sectional view illustrating the configuration of the inkjet recording head 39. As shown in FIG. 6, a cavity 55 provided with a piezoelectric element 54 is formed at the upstream side of the nozzles 53 formed in the bottom surface of the inkjet recording head 39. The piezoelectric element 54 is deformed by applying a predetermined voltage thereto. Thus, the piezoelectric element 54 reduces the capacity of the cavity 55. The change in the capacity of the cavity 55 causes the ejection of ink contained in the cavity 55 as ink droplets from the nozzles 53.

The cavity 55 is provided corresponding to each of the nozzles 53. A manifold 56 is formed over a plurality of cavities 55. The manifold 56 is formed corresponding to each of the colors C, M, Y, and Bk of ink. A buffer tank 57 is provided at the upstream side of each of the manifolds 56. The buffer tank 57 is provided corresponding to each of the colors C, M, Y, and Bk of ink. Ink flowing each of the ink tubes 41 is supplied from an ink supply pot 58 to a corresponding one of the buffer tanks 47. The supplied ink is temporarily stored in the corresponding buffer tank 57. Thus, gas bubbles generated in the ink in the ink tubes 41 are trapped therein. This prevents the gas bubbles from entering the cavities 55 and the manifolds 56. The gas bubbles trapped in the buffer tanks 57 are sucked and removed by the pump mechanism. The ink supplied from the corresponding buffer tank 57 to the corresponding manifold 56 is distributed to the corresponding cavity 55.

Thus, an ink flow path is configured so that ink of each of the colors, which is supplied from the corresponding ink cartridge to the corresponding ink tube 41, flows into the corresponding cavity 55 through the corresponding buffer tank 57 and the corresponding manifold 56. The ink of each of the colors C, M, Y, and Bk, which is supplied through such an ink flow path, is ejected due to the deformation of the piezoelectric element 54 from the corresponding nozzle 53 onto recording paper as ink droplets.

As shown in FIG. 3, a pair of a conveying roller 60 ad a pinch roller is provided at the upstream side of the image recording unit 24. Although the pinch roller is hidden by another member and is not shown in FIG. 3, the pinch roller is disposed under the conveying roller 60 in a pressure-contacted state. The conveying roller 60 and the pinch roller sandwich recording paper conveyed on the paper conveying path 23 and convey the recording paper onto the platen 42. A pair of a discharge roller 62 and a spur roller 63 is provided at the downstream side of the image recording unit 24. The discharge roller 62 and the spur roller 63 sandwich the recording paper on which an image is recorded, and convey the recording paper to the paper discharge tray 21. A driving force is transmitted from the LF motor 71 (see FIG. 7) to the discharge roller 62 and the spur roller 63 to thereby intermittently drive the discharge roller 62 and the spur roller 63 at a predetermined linefeed width. A rotation of the conveying roller 60 is performed in synchronization with a rotation of the discharge roller 62. A rotary encoder 76 (see FIG. 7) provided at the conveying roller 60 detects the pattern printed on a encoder disk 61 that rotates together with the conveying roller 60 using an optical sensor. The rotation of each of the conveying roller 60 and the discharge roller 62 is controlled according to a detection signal outputted from the rotary encoder 76.

The spur roller 63 is pressure-contacted with the recording paper, on which an image is recorded. Thus, the roller surface of the spur roller 63 is formed to be uneven like a spur to prevent the image recorded on the recording paper from being degraded. The spur roller 63 is provided to be slidable in a direction in which the spur roller 63 is in contact with and is separated from the discharge roller 62. The spur roller 63 is pushed by a coil spring to be pressure-contacted with the discharge roller 62. When a sheet of recording paper enters between the discharge roller 62 and the spur roller 63, the spur roller 63 is retreated against a pushing force by a thickness of the recording paper. Then, the spur roller 63 and the discharge roller 62 sandwich the recording paper so that the recording paper is pressure-contacted with the discharge roller 62. Consequently, the torque of the discharge roller 62 is surely transmitted to the recording paper. The pinch roller is provided similarly with respect to the conveying roller 60. The pinch roller and the conveying roller 60 sandwich the recording paper so that the recording paper is pressure-contacted with the conveying roller 60. Thus, the torque of the conveying roller 60 is surely transmitted to the recording paper.

Figure 7:
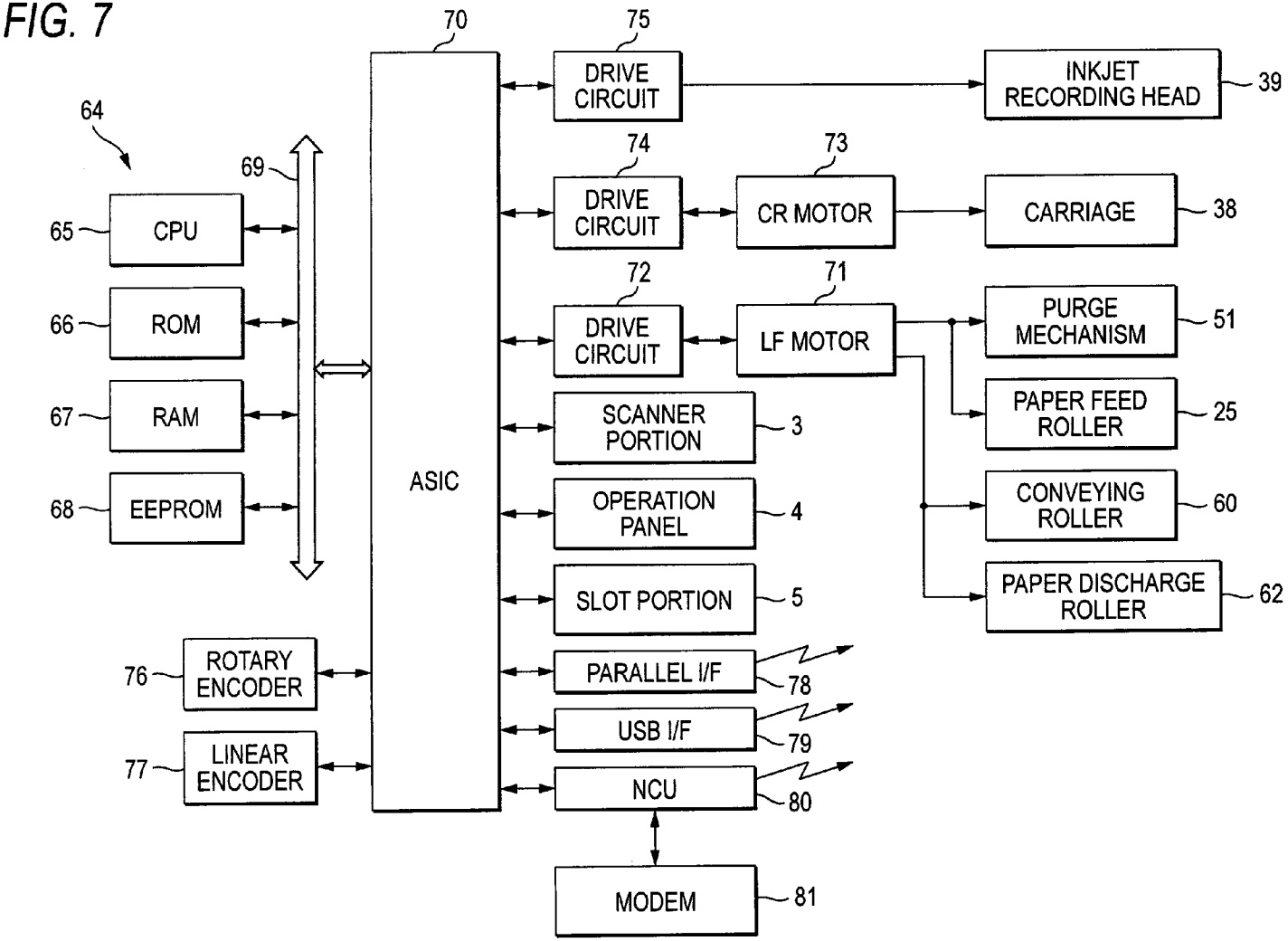
FIG. 7 is a block view illustrating the configuration of a control portion of the multifunction apparatus.

FIG. 7 is a block view illustrating the configuration of the control portion 64 of the multifunction apparatus 1. The control portion 64 controls not only an operation of the printer portion 2 but an operation of the entire multifunction apparatus 1 including also the scanner portion 3. The control portion 64 is configured by the main board to be connected to the flat cable 85. The configuration relating to the scanner portion 3 is not the configuration of a primary part of the apparatus according to the invention. Therefore, the detailed description of the configuration relating to the scanner portion 3 is omitted herein. The control portion 64 is constituted by a microcomputer including mainly a CPU (Central Processing Unit) 65, a ROM (Read Only Memory) 66, a RAM (Random Access Memory) 67, and an EEPROM (Electrically Erasable and Programmable ROM) 68. The control portion 64 is connected to an ASIC (Application Specific Integrated Circuit) 70 through a bus 69.

Programs adapted to control various operations of the multifunction apparatus 1 are stored in the ROM 66. The RAM 67 is used as a storage area or a work area in which various data used to execute the programs are tentatively stored. Information on setting, which is to be held even after power off, and data representing flags are stored in the EEPROM 68.

The ASIC 70 generates a phase excitation signal, which energizes the LF (conveying) motor 71, according an instruction sent from the CPU 65, and provides the phase excitation signal to a drive circuit 72 adapted to drive the LF motor 71. The ASIC 70 controls the rotation of the LF motor 71 by feeding a drive signal to the LF motor 71 through the drive circuit 72.

The drive circuit 72 is operative to drive the LF motor 71 connected to the paper feed roller 25, the conveying roller 60, the paper discharge roller 62, and the purge mechanism 51. The drive circuit 72 receives an output signal of the ASIC 70 and generates an electric signal used to rotate the LF motor 71. The LF motor 71 rotates when receiving the electric signal. The torque of the LF motor 71 is transmitted to the paper feed roller 25, the conveying roller 60, the paper discharge roller 62, and the purge mechanism 51 through a known drive mechanism including a gear and a drive shaft.

The ASIC 70 generates a phase excitation signal, which energizes the CR (carriage) motor 73, according an instruction sent from the CPU 65, and provides the phase excitation signal to a drive circuit 74 adapted to drive the CR motor 73. The ASIC 70 controls the rotation of the CR motor 73 by feeding a drive signal to the CR motor 73 through the drive circuit 74.

The drive circuit 74 is operative to drive the CR motor 73. The drive circuit 74 receives an output signal of the ASIC 70 and generates an electric signal used to rotate the CR motor 73. The CR motor 73 rotates when receiving the electric signal. The torque of the CR motor 73 is transmitted to the carriage 38 through the belt drive mechanism 46. Consequently, the carriage 38 is caused to reciprocate. Thus, the reciprocating movement of the carriage 38 is controlled by the control portion 64.

A drive circuit 75 causes the inkjet recording head 39 to selectively eject ink of each of the colors onto recording paper with predetermined timing. The drive circuit 75 receives output signals generated in the ASIC 70 according to a drive control procedure outputted from the CPU 65 and drive-controls the inkjet recording head 39. The drive circuit 75 is mounted on the head control board. Signals are transmitted by the flat cable 85 from the main board, which constitutes the control portion 64, to the head control board.

The ASIC 70 is connected to the rotary encoder 76 which detects an amount of rotation of the conveying roller 60, and to the linear encoder 77 which detects the position of the carriage 38. The carriage 38 is moved to one end of each of the guide rails 43 and 44 by turning on a power supply for the multifunction apparatus 1. Then, data representing a position detected by the linear encoder 77 is initialized. When the carriage 38 moves on the guide rails 43 and 44 from an initial position, the optical sensor 35 provided on the carriage 38 detects the pattern printed on the encoder strip 50. The control portion 64 grasps the number of pulse signals according to the detected pattern as an amount of movement of the carriage 38. The control portion 64 control the rotation of the CR motor 73 according to the amount of movement of the carriage 38 to control the reciprocating movement of the carriage 38.

The ASIC 70 is connected to the scanner portion 3, the operation panel 4 used to issue operation instructions, a slot portion 5 into which various kinds of small memory cards are inserted, and a parallel interface 78 and a USB (Universal Serial Bus) interface 79, which are used to transmit and receive data to and from external information apparatuses, such as personal computers, through a parallel interface cable and a USB cable. Also, an NCU (Network Control Unit) 80 and a modem 81, which are used to perform the facsimile function, are connected to the ASIC 70.

Figure 8:
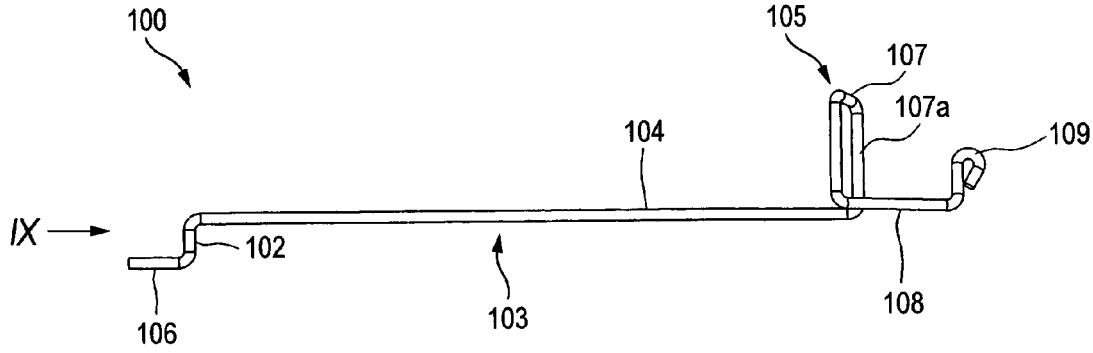
FIG. 8 is a front view illustrating the configuration of a turn supporting member.
Figure 9:
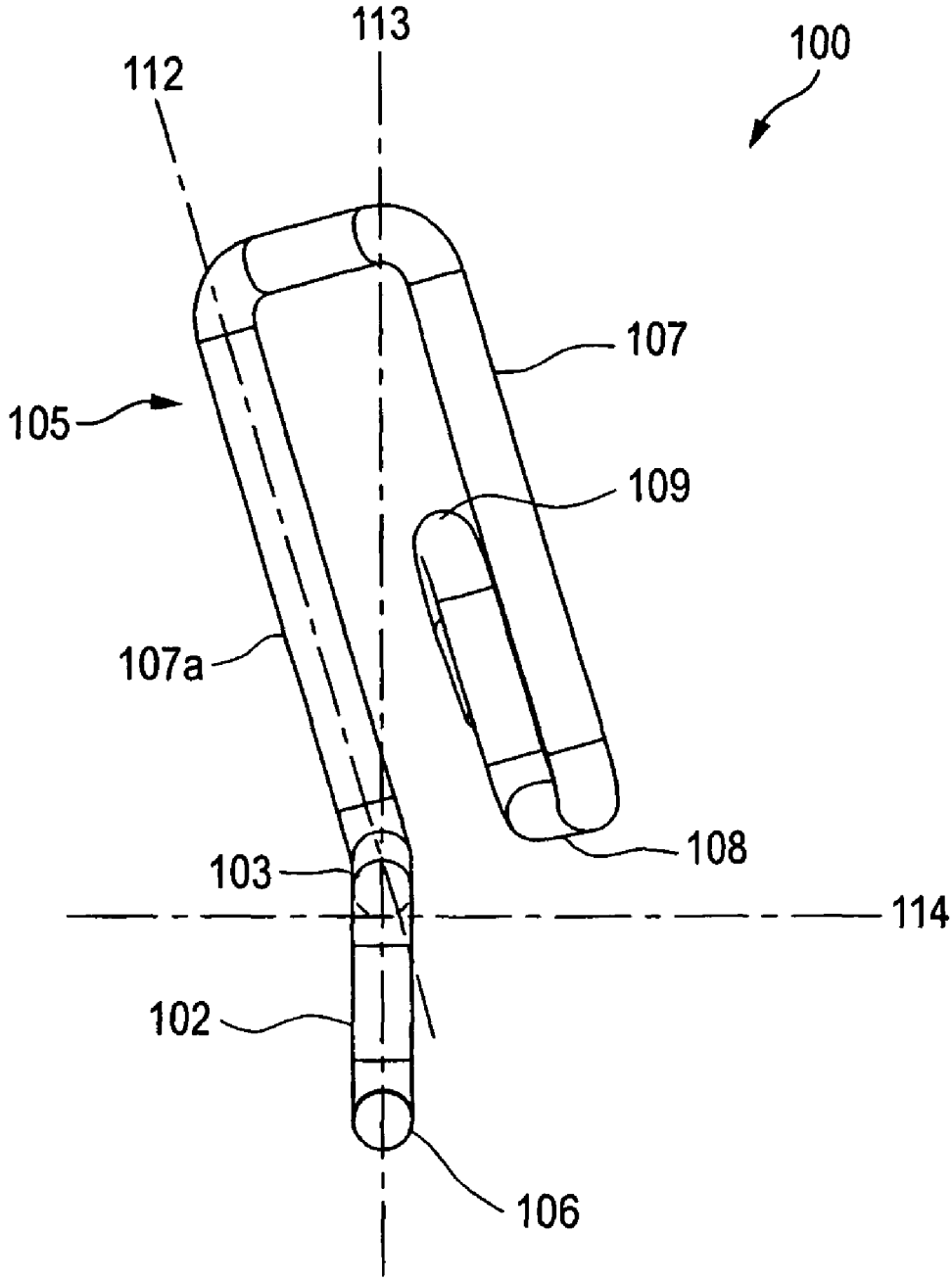
FIG. 9 is a side view illustrating the turn supporting member, which is taken in the direction of an arrow IX shown in FIG. 8.

Hereinafter, the turn supporting member 100 adapted to support the ink tubes 41 and the flat cable 85 is described in detail. FIG. 8 is a front view illustrating the configuration of the turn supporting member 100. FIG. 9 is a side view illustrating the turn supporting member 100, which is taken in the direction of an arrow IX shown in FIG. 8.

The turn supporting member 100 includes an axis portion 102 serving as a turn supporting point, an arm 103 extending horizontally from the axis portion 102, a carrying portion 104 formed at the base end side of the arm 103, a holding portion 105 formed at a leading end side of the arm 103, and an auxiliary arm 106 extending from the axis portion 102 to be formed into a crank shape with respect to the axis portion 102 and the arm 103. These components of the turn supporting member 100 are integrally formed by bending a linear steel member.

The axis portion 102 and the arm 103 are bent at a substantially right angle. As shown in FIG. 4, the axis portion 102 is inserted into a shaft hole 111 of a support board 110 fixed to the apparatus body. Consequently, the axis portion 102 is axially supported in a substantially vertical direction. The arm 103 extends in a substantially horizontal direction. The axis portion 102 is enabled to slide in the shaft hole 111. The arm 103 turns in a substantially horizontal plane by employing the axis portion 102 as a turn supporting point.

The top surface of the arm 103 extending in a horizontal direction is the carrying portion 104 used to support the flat cable 85 thereon. The carrying portion 104 is in contact with the bottom end of the flat cable 85 configured so that a direction from the front surface to the rear surface thereof is the vertical direction. The flat cable 85 freely slides on the carrying portion 104 when following the carriage 38 to change the shape of the flat cable 85. Therefore, in a range in which the carriage 38 reciprocates, the length of the arm 103 constituting the carrying portion 104 is set to enable the carrying portion 104 to support the flat cable 85 thereon so that the flat can slide thereon.

The holding portion 105 formed at the leading end portion of the arm 103 holds the ink tubes 41. The holding portion 105 includes a ring 107 shaped like a rectangle elongated in an up-down direction, a bottom portion 108 projected from the ring 107 to the leading end thereof, and a curved portion 109 formed at the leading end of the bottom portion 108. In the ring 107, the dimensional relationship between an inside dimension width, an inside dimension height, and an outside diameter of each of the ink tubes 41 is set such that the arrangement of the ink tubes 41 is not changed in the ring 107, and that the ink tubes 41 can freely slide in a direction in which the ink tubes 41 extend. Assuming that the outside diameters of all the ink tubes 41 are A, the following relationships are satisfied:

$A \leqq$(the inside dimension width of the ring 107)$<2A$; and $4A \leqq$(the inside dimension height of the ring 107)

The ring 107 is formed by bending the linear steel member constituting the turn supporting member 100 so that the linear steel member is erected from the arm 103, and that the ring 107 is shaped like a longitudinally elongated rectangle. The bottom portion 108 of the ring 107 extends substantially horizontally in the direction in which the arm 103 extends. The curved portion 109 is formed by upwardly bending the leading end part of the bottom portion 108 and subsequently bending the leading end part thereof outwardly like a circular arc in the direction in which the arm 103 extends.

As shown in FIG. 9, an axis line 112 (the center line of the linear steel member) of the erected part 107*a* of the ring 107, which is erected from the arm 103, is inclined with respect to an axis line 113 of the axis portion 102. That is, the axis line 113 of the axis portion 102 extends in a vertical direction, while the axis line 112 of the erected part 107*a* of the ring 107 is inclined relative to the vertical direction. A side in the direction of inclination of the erected part 107*a* is opposite to a side, at which the bottom portion 108 is disposed, with respect to the arm 103. The ring 107 is formed like a rectangle elongated in the direction of the axis line 112. Thus, the bottom portion 108 is placed at a position, whose height is equal to or higher than that of the arm 103, by inclining the axis line 112 toward the side opposite to the bottom portion 108. That is, the bottom portion 108 is positioned at a place higher than a virtual supporting plane of the arm 103.

The four ink tubes 41 are passed into the ring 107 of the holding portion 105 and are supported on the bottom portion 108. Thus, a predetermined part of each of the ink tubes 41 is slidably held by the holding portion 105. The ring 107 holds the four ink tubes 41 by surrounding the ink tubes 41 in a state in which the vertical arrangement of the surrounded four ink tubes 41 fixed to the fixing clip 36 is maintained. Consequently, when the four ink tubes 41 change the shapes thereof by following the ink tubes 41 do not widely shake. Also, the shapes of the ink tubes 41 are integrally changed in a state in which the vertical arrangement of the ink tubes 41 is maintained at the predetermined parts. The ink tubes 41 can slide in the direction, in which the ink tubes 41 extend, in a state in which the ink tubes 41 are surrounded by the ring 107. When the ink tubes 41 change the shapes, the ink tubes 41 moderately slide with respect to the ring 107. Thus, an excessive load is not generated in the ink tubes 41. On the other hand, the change in the shape of each of the ink tubes 41 is transmitted as the torque of the turn supporting member 100 by the friction between the ring 107 and each of the ink tubes 41.

Figure 12:
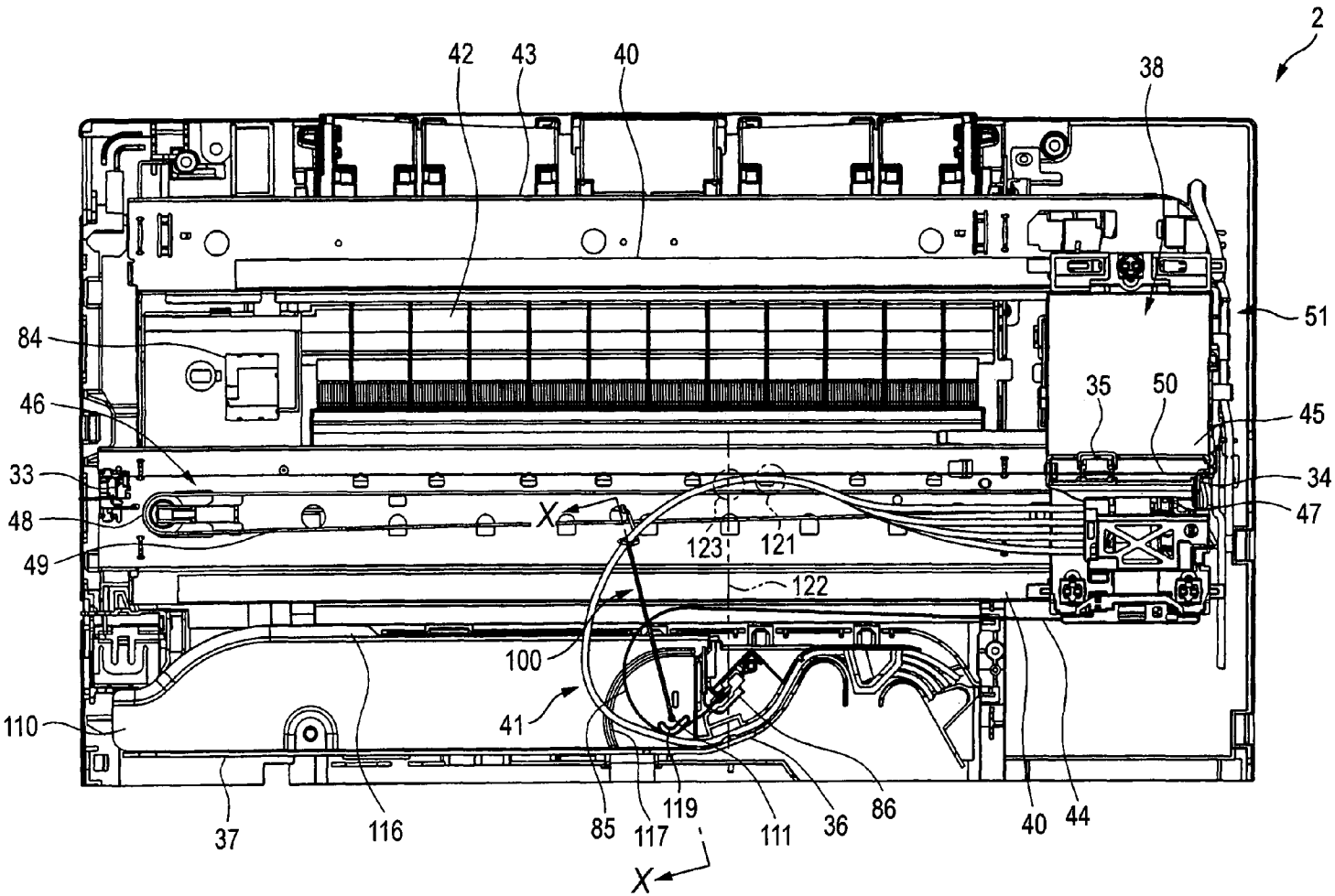
FIG. 12 is a plan view illustrating the configuration of the printer portion.

A position, at which the holding portion 105 holds the ink tubes 41, is adjusted to be fitted to the change in the shape of each of the ink tubes 41. In a case where the ink tubes 41 extend from the carriage 38 in a direction away from the fixing clip 36 when the carriage 38 is moved to a position (a capping position), at which the radius of the U-shaped curved portion of each of the ink tubes 41 is maximized, as shown in FIG. 12, it is advisable to cause the holding portion 105 to hold the ink tubes 41 at parts thereof located closer to the fixing clip 36 than a predetermined place 121 at which each of the ink tubes 41 is closest to the apparatus rear side. Conversely, in a case where the ink tubes 41 do not extend from the carriage 38 in a direction away from the fixing clip 36, it is advisable to cause the holding portion 105 to hold the ink tubes 41 at parts thereof located closer to the fixing clip 36 than a predetermined place 123 at which each of the ink tubes 41 intersects with a virtual line 122 extending to the apparatus rear side along the recording paper conveying direction is closest to the apparatus rear side.

In a case where the predetermined part, at which the holding portion 105 holds each of the ink tubes 41, is in a range in which each of the ink tubes 41 changes the shape thereof along the regulating wall 37, the predetermined part of each of the ink tubes 41 surrounded by the ring 107 can abut against the regulating wall 37 by changing the shape thereof. As described above, the ring 107 maintains the vertical arrangement of the four ink tubes 41. The ink tubes 41 arranged in the vertical arrangement abut against the regulating wall 37. This has advantages in that the four ink tubes 41 uniformly abut the regulating wall 37, and that stress is not concentrated only on a specific one of the ink tubes 41 when abutting against the regulating wall 37. Incidentally, a concave cutout portion 120 (see FIG. 11) is formed in a predetermined place in the regulating wall 37, against which the holding portion 105 abuts. The concave cutout portion 120 will be described later.

The four ink tubes 41 surrounded by the ring 107 is supported on the bottom portion 108 that is closer to the leading end than the ring 107. As described above, the bottom portion 108 is placed at a position higher than the arm 103. The lowest one of the ink tubes 41 supported on the bottom portion 108 is placed at a position higher than the bottom end of the flat cable 85 supported on the carrying portion 104.

The ink tubes 41 supported on the bottom portion 108 slide on a part of the bottom portion 108, which is located closer to the leading end side than the ring 107, when the ink tubes 41 follow the carriage 38 to change the shapes. That is, the ink tubes can freely slide on this part of the bottom portion 108 located between the ring 107 and the curved portion 109. The curved portion 109 is formed by upwardly bending the leading end side part of the bottom portion 108. This prevents the ink tubes 41 from slipping off the bottom portion 108. The curved portion 109 is curved outwardly in the direction, in which the arm 103 extends, like a circular arc. Thus, a leading end and a pointed part of the linear steel member do not touch the ink tubes 41. Consequently, the ink tubes 41 are prevented from being damaged.

Figure 10:
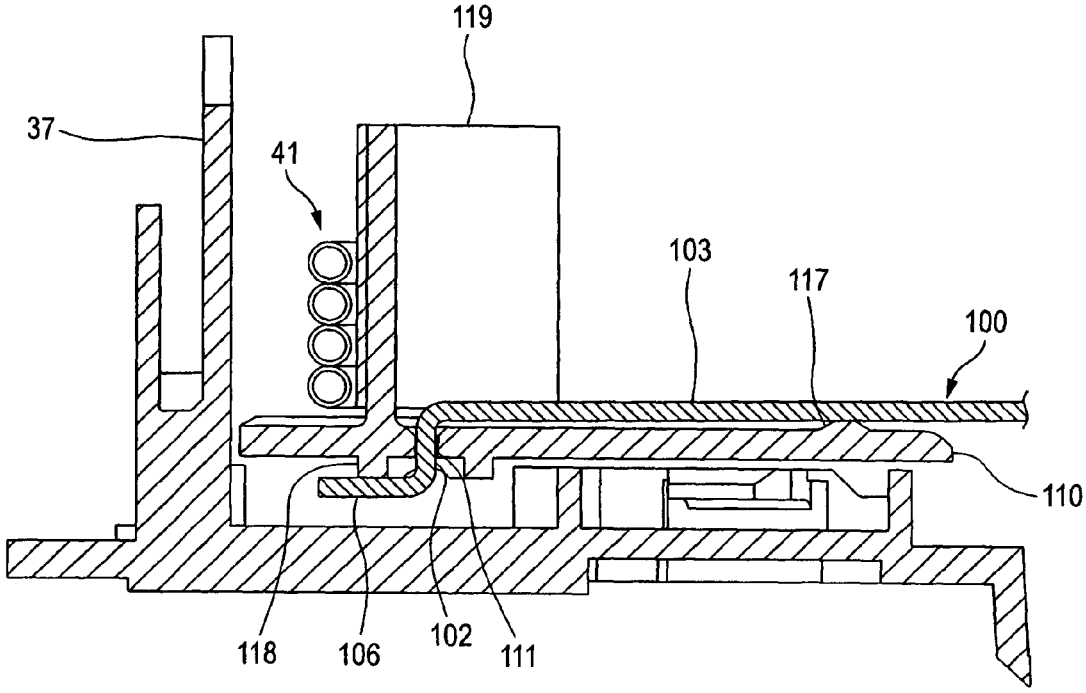
FIG. 10 is a cross-sectional view taken along line X-X shown in FIG. 12.
Figure 11:
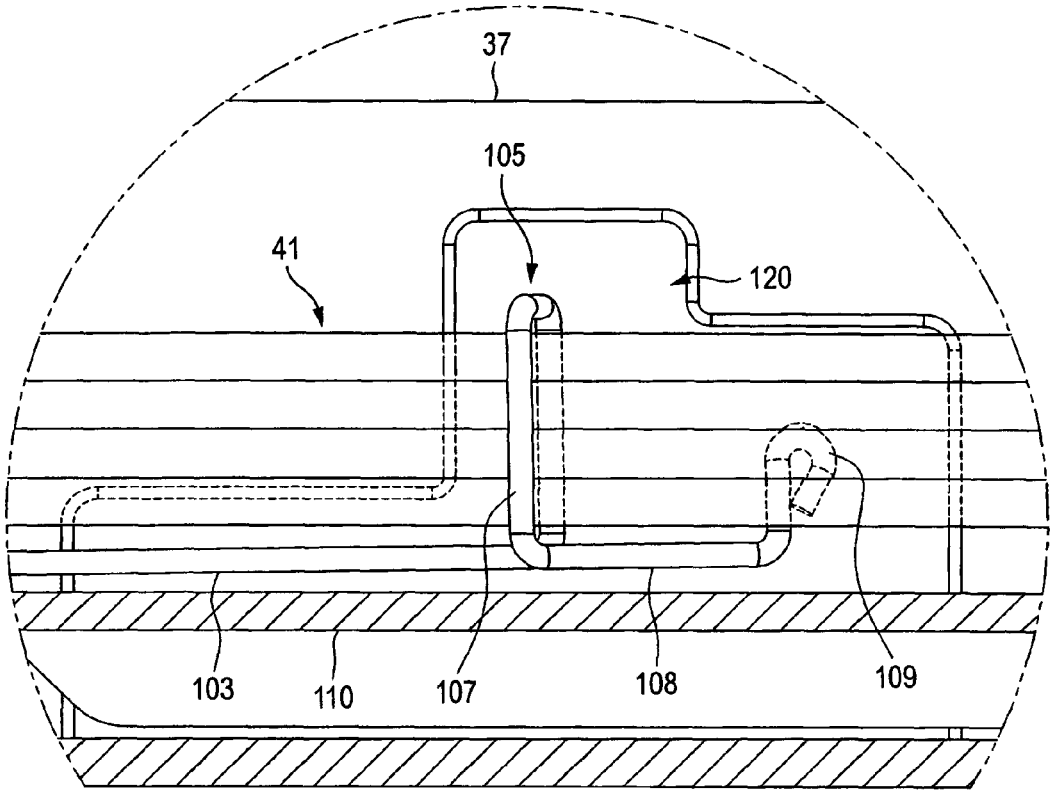
FIG. 11 is an enlarged view taken in the direction of an arrow XI shown in FIG. 13.

Hereinafter, the support board 110 adapted to support the turn supporting member 100 is described in detail. FIG. 10 is a cross-sectional view taken along line X-X shown in FIG. 12. FIG. 11 is an enlarged view taken in the direction of an arrow XI shown in FIG. 13. In FIG. 10, the drawing of the holding portion 105 provided at the leading end side of the turn supporting member 100 is omitted.

As shown in FIG. 4, the support board 110 is fixed to the apparatus body at a part closer to the apparatus rear side than the regulating wall 37, that is, at the side of the carriage 38. The support board 110 is a flat plate, whose is substantially equal in the length in the direction of width of the apparatus to the regulating wall 37. The support board 110 has a width in the direction of depth of the apparatus, which is within a range of width of a space extending from the regulating wall 37 to the guide rail 44. The shaft hole 111 adapted to axially support the axis portion 102 of the turn supporting member 100 is vertically bored in the support board 110. The shaft hole 111 is disposed inside the curves U-shaped in plan view, along which the ink tubes 41 and the flat cable 85 are routed. The axis portion 102 of the turn supporting member 100 is axially supported in the shaft hole 111. The arm 103 extends substantially horizontally toward the ink tubes 41 and the flat cable 85. The distance from the shaft hole 111 to an edge portion 116 of the support board 110, which extends in the direction of depth of the apparatus is shorter than the length from the base end (at the side of the axis portion 102) to the holding portion 105. Thus, as a result of turning the arm 103, a state, in which the entire arm 103 including the holding portion 105 is accommodated within the top surface of the support board 110 (see FIG. 13), is changed to a state in which the holding portion 105 goes away from the top surface of the support board 110 (see FIG. 12).

As shown in FIGS. 4 and 10, a first support rib 117 supporting the arm 103 is formed to extend around the shaft hole 111 in the top surface of the support board 110. The first support rib 117 is formed like a circular arc extending around the shaft hole 111. The first support rib 117 is formed over a range in which the arm 103 turns. The distance from the shaft hole 111 to the first support rib 111 is not limited to a specific value. Preferably, the first support rib 117 is formed close to the holding portion 105 as much as possible. This is because the height position of the holding portion 105 can accurately be determined. An end surface of the first support rib 117 abuts against the arm 103 within a range in which the arm 103 turns. The height of the end surface of the first support rib 117 is set at a certain value from the top surface of the support board 110 so that the height of the end surface of the first support rib 117 does not change within the range in which the arm 103 turns. The height of the first support rib 117 has a value at which the holding portion 105 can be maintained in a state in which, especially, the bottom portion 108 floats above the top surface of the support board 110.

A second support rib 118 supporting the auxiliary arm 106 is formed to extend around the shaft hole 111 in the bottom surface of the support board 110. Although not shown in the figures, the second support rib 118 is shaped like a circular arc extending around the shaft hole 111, similarly to the first support rib 117. The second support rib 118 is formed over the range in which the arm 103 turns. The distance from the shaft hole 111 to the second support rib 118 is not limited to a specific value. However, when the second support rib 118 is distant from the shaft hole 111, a supporting force of the auxiliary arm 106 is increased. An end surface of the second support rib 117 abuts against the auxiliary arm 106 within the range in which the arm 103 turns. The height of the second support rib 118 is set at a certain value from the support board 100 to prevent the height of the end surface of the second support rib 118 from changing within the range in which the arm 103 turns. The height of the second support rib 118 has a value at which the holding portion 105 can be maintained in a state in which, especially, the bottom portion 108 floats above the top surface of the support board 110.

The arm 103 is supported at a predetermined height by the first support rib 117 formed on the support board 110, so that the holding portion 105 is maintained in a state in which the holding portion 105 is floated above the top surface of the support board 110. Thus, the bottom portion 108 of the holding portion 105 does not abut against the top surface of the support board 110. Also, the holding portion 105 is maintained in a state, in which the holding portion 105 is floated above the top surface of the support board 110, by supporting the auxiliary arm 106 at a predetermined height with the second support rib 118. Consequently, the holding portion 105 is maintained in a state, in which the holding portion 105 is surely floated above the top surface of the support board 110, within the range in which the arm 103 turns, by utilizing the combination of the first support rib 117 and the second support rib 118.

As shown in FIGS. 4 and 10, a guide plate 119 is erected in the vicinity of the shaft hole 111 of the support board 110. The guide plate 119 is separated from the regulating wall 37 toward the carriage 38. The guide plate 119 is formed only within a predetermined range in the vicinity of the shaft hole 111. The guide plates performs functions only when the carriage 38 is moved to a side at which the U-shaped curved portion of the flat cable 85 is largely formed (see FIG. 12). The ink tubes 41 and the flat cable 85 are passed through between the guide plate 119 and the regulating wall 37. The ink tubes 41 and the flat cable 85 are caused to abut against the wall surface of the guide plate 119. Consequently, the ink tubes 41 and the flat cable 85 are inhibited from bending to the side of the carriage 38 from the fixing clips 36 and 86. Accordingly, the center of the U-shaped curved portion can be shifted toward the regulating wall 37 without causing buckling in the ink tubes 41 and the flat cable 85. The U-shaped curved portions of the ink tubes 41 and the flat cable 85 are prevented from being enlarged. Also, the length of each of the ink tubes 41 and the flat cable 85 from the fixing clip 36 or 86 to the carriage 38 can be minimized.

As shown in FIG. 11, the concave cutout portion 120 is formed in the regulating wall 37 to prevent the holding portion 105 of the turn supporting member 110, which holds the predetermined part of each of the ink tubes 41, from abutting against the regulating wall 37. In the present aspect, the concave cutout portion 120 is formed as a through hole passed through in the direction of thickness of the regulating wall 37. However, in a case where the regulating wall 37 is thick, the wall surface of the regulating wall 37 may be formed to be depressed. Alternatively, the regulating wall 37 may be separated into two parts by the concave cutout portion 120. The concave cutout portion 120 has a shape corresponding to a part of the arm 103, which is located in the neighborhood of the holding portion 105, and the ring 107, the bottom portion 108, and the curved portion 109 of the holding portion 105. However, in a case where all of these constituents do not abut against the regulating wall 37, the shape of the concave cutout portion 120 is not limited to a specific one. Consequently, in a state in which the ink tubes 41 abut against the wall surface of the regulating wall 37, a part of the turn supporting member 100, which is located in the vicinity of the holding portion 105, goes into the concave cutout portion 120, so that the holding portion 105 does not abut against the regulating wall 37. This advantage will be described in detail later.

Hereinafter, operations performed by the ink tubes 41, the flat cable 85, and the turn supporting member 100 in an image recording operation of the printer portion 2 are described. The carriage 38, on which the recording head 39 is mounted, is guided by transmitting a driving force of the CR motor 73 thereto through the belt drive mechanism 46. Also, the carriage 38 is guided by the guide rails 43 and 44, so that the carriage 38 reciprocates in a direction intersecting with the recording paper conveying direction. The recording head 39 ejects ink droplets of each of the colors, which are supplied from the ink tubes 41, on recording paper placed on the platen 42 with predetermined timing according to a signal transmitted from the control portion 64 through the flat cable 85. The intermittent conveyance of recording paper by the conveying roller 60 and the paper discharge roller 62, and the reciprocating movement of the carriage 38 are alternately repeated. Thus, a desired image is recorded on the recording paper.

Figure 13:
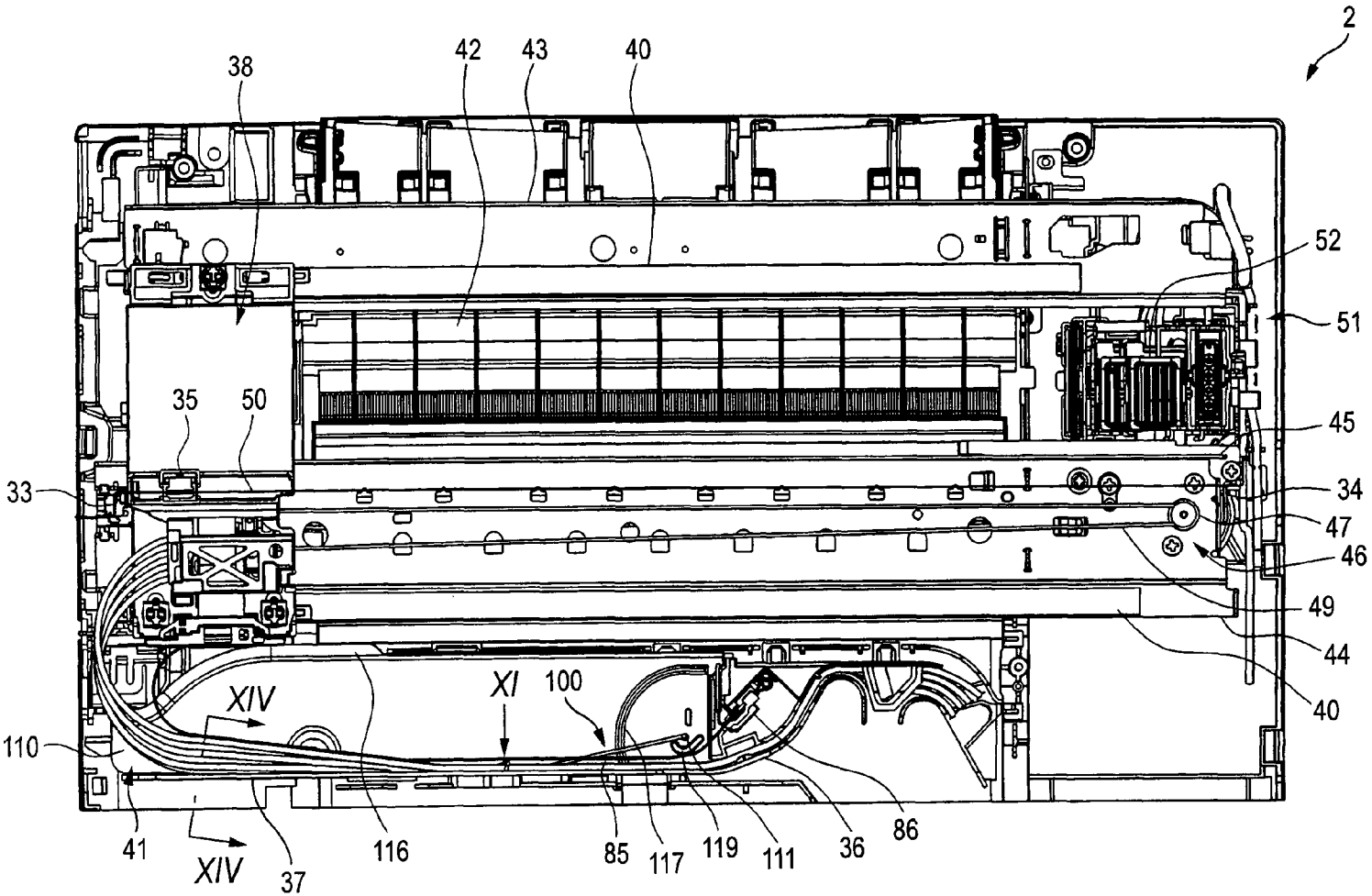
FIG. 13 is another plan view illustrating the configuration of the printer portion.

The ink tubes 41 and the flat cable 85, one end of each of which is connected to the carriage 38, change shapes while following the reciprocating movement of the carriage 38 to change the curvature of the U-shaped curved portion. FIG. 12 illustrates a case where the carriage 38 is placed at the capping position on the cap 52 (at the right side, as viewed in FIG. 12). FIG. 13 illustrates a case where the carriage 38 is placed at a flashing position (at the left side, as viewed in FIG. 13) on the waste ink tray 84. In the present aspect, the capping position is an initial position of the carriage 38.

In a case where the carriage 38 is placed at the capping position, as illustrated in FIG. 12, each of the ink tubes 41 and the flat cable 85 has a curved U-shape formed so that each of the ink tubes 41 and the flat cable 85 extends to the flashing position in the reciprocating direction in which the carriage 38 reciprocates, and is immediately reversed at that point. Each of the ink tubes 41 and the flat cable 85 has flexibility, and also has a certain degree of bending stiffness. Although elasticity of each of the ink tubes 41 and the flat cable 85 causes the U-shaped curved portion to largely expand onto the guide rail 44, the U-shaped curved portion abuts against the wall surface of the guide plate 119. Thus, each of the ink tubes 41 and the flat cable 85 is prevented from bending toward the carriage 38 at an acute angle. Also, the center of the U-shape curved portion is shifted toward the regulating wall 37. Consequently, the curved portion of each of the ink tubes 41 and the flat cable 85 can be prevented from being enlarged. A space needed to route the ink tubes 41 and the flat cable 85 can be reduced. Thus, the miniaturization of the apparatus can be achieved. The length of each of the ink tubes 41 and the flat cable 85 from the fixing clip 36 or 86 to the carriage 38 can be minimized.

As illustrated in FIG. 4, during the carriage 38 is slid and moved to the flashing position from the capping position, each of the ink tubes 41 and the flat cable 85 follows the movement of the carriage 38 while changing the shape thereof to reduce the diameter of the U-shaped curved portion. As shown in FIG. 13, when the carriage 38 is placed at the flashing position, the diameter of the U-shaped curved portion of each of the ink tubes 41 and the flat cable 85 is minimized. The fixing clips 36 and 86 fix the ink tubes 41 and the flat cable 85 by pushing the ink tubes 41 and the flat cable 85 against the wall surface of the regulating wall 37. Thus, the ink tubes 41 and the flat cable 85 are pushed against along the regulating wall 37 in the range in which the carriage 38 reciprocates. Such pushed parts of the ink tubes 41 and the flat cable 85, which extend along the wall surface of the regulating wall 37, are prevented from being disengaged from the regulating wall 37. Consequently, a region, in which the part extending to the carriage 38 from the curved portion of each of the ink tubes 41 and the flat cable 85 expands toward the carriage 38, can be decreased. Also, the space needed to route the ink tubes 41 and the flat cable 85 can be reduced, because the expansion of each of the ink tubes 41 and the flat cable 85 in the direction away from the carriage 38 is regulated by the regulating wall 37.

As illustrated in FIG. 13, the flat cable 85 disposed inside the curved portion of each of the ink tubes 41 sometimes touches the ink tube 41 when following the reciprocating movement of the carriage 38. At that time, the flat cable 85 abuts against the uppermost ink tube 41 placed closest thereto at the U-shaped curved portion thereof. As described above, the four ink tubes 41 are substantially equal to one another in the length from the carriage 38 to the fixing clip 36. The ink tube 41 disposed at the most upstream side in the recording paper conveying direction is placed at the uppermost place in the fixing clip 36. Another of the ink tubes 41, which is disposed at the immediately downstream side of the carriage 38, is placed just under the fixing clip 36. This process is repeated, so that the ink tubes 41 horizontally arranged at the carriage 38 are vertically arranged at the fixing clip 36.

Figure 14:
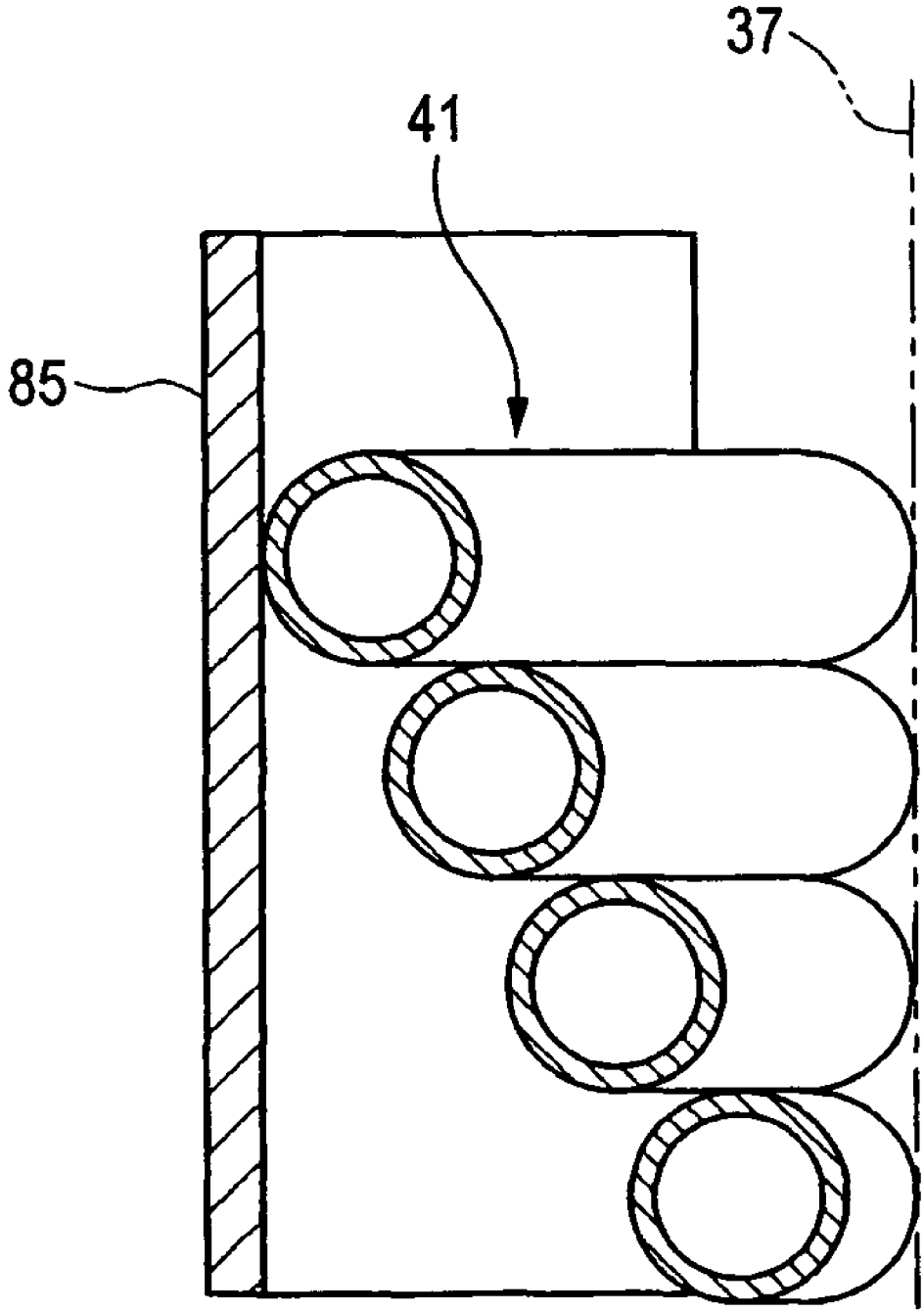
FIG. 14 is a cross-sectional view taken along line XIV-XIV shown in FIG. 13.

FIG. 14 is a cross-sectional view taken along line XIV-XIV shown in FIG. 13. As shown in FIG. 14, the four ink tubes 41 are arranged downwardly and obliquely at the curved portion. Thus, in a case where the ink tubes 41 change the shapes during following the carriage 38, the possibility of occurrence of interference between the ink tubes 41 is reduced. Also, the flat cable 85 is configured so that the bottom of the flat cable 85 is maintained by the turn supporting member 100 at a height which is substantially equal to the height of the lowermost one of the ink tubes 41 disposed at the fixing clip 36. One of the front surface and the rear surface of the flat cable 85 abuts against the uppermost one of the ink tubes 41 disposed at the fixing clip 36. Therefore, the flat cable 85 neither gets into under the four ink tubes 41 nor runs aground the ink tubes 41. Thus, the configurations of the ink tubes 41 and the flat cable 85 outside and inside the ink tubes 41 and the flat cable 85 are maintained. The ink tubes 41 and the flat cable 85 follow the movement of the carriage 38 and change the shapes thereof.

Each of the ink tubes 41 and the flat cable 85, which change the shapes thereof in this manner, is supported at a predetermined height by the turn supporting member 100. As described above, the ink tubes 41 are held by the holding portion 105. The flat cable 85 is supported on the carrying portion 104. When the ink tubes 41 follow the reciprocating movement of the holding portion 38 and change the shapes thereof, change in the shape of the ink tubes 41 is transmitted to the arm 103 through the holding portion 105, so that the arm 103 turns by employing the axis portion 102 as the turn supporting point.

As shown in FIGS. 4, 12, and 13, the flat cable 85 slides on the carrying portion 104 during changing the shape thereof while following the reciprocating movement of the carriage 38. In a case where the flat cable 85 is supported at a predetermined height by grasping the predetermined part, the locus of a turn of the predetermined part may be limited to a predetermined circular arc, and an excessive load may be applied to the predetermined part. The carrying portion 104 slidably supports the flat cable 85 thereon. Thus, regardless of the locus of a turn of the arm 103, the flat cable 85 can freely change the shape thereof in a range in which the carrying portion 104 slides. Consequently, no excessive load on the flat cable occurs. Thus, the flat cable 85 is prevented from being damaged and being broken.

Also, as described above, the arm 103 is turned, so that at the flashing position, the entire arm 103 including the holding portion 105 is accommodated within the top surface of the support board 100, as shown in FIG. 13, and that at the capping position, the holding portion 105 goes away from the support board 110, as shown in FIG. 12. In a case where the arm 103 further turns the position indicated by FIG. 4 to the capping position, the holding portion 105 goes away from the top surface of the support board 110. Conversely, in a case where the arm 103 turns from the capping position to the position indicated in FIG. 4, the holding portion 105 is accommodated within the top surface of the support board 110.

As described above, the ring 107 of the holding portion 105 is configured so that the axis line 112 of the part 107*a* erected from the arm 103 (see FIG. 9) is inclined to the axis line 113 of the axis portion 102. The bottom portion 108 of the ring 107 is placed at a position whose height is equal to or higher than the height position of the arm 103. Accordingly, when the holding portion 105 is accommodated within the top surface of the support board 110, the bottom portion 108 does not abut against the edge portion 116 of the support board. Consequently, no sound of a collision between the holding portion 105 and the support board 110 is generated.

Also, the erected part 107*a* of the ring 107 of the holding portion 105 is inclined to the axis portion 102, so that the bottom portion 108 of the ring 107 has a height which is equal to or larger than the height of the arm 103. Therefore, it is unnecessary to set the position of the ring 107 to be higher than that of the arm 103. In a case where the height position of the ring 107 is set to be higher than that of the arm 103, the position of each of the ink tubes 41, each of which is surrounded by the rig 107, becomes high. Thus, it is necessary for preventing the interference between the ink tube 41 and another member, such as a cover disposed above the range, in which the ink tube 41 changes the shape, to increase the height position of the another member. Consequently, the height of the entire apparatus is increased. According to the present aspect, the ring 107 of the holding portion 105 does not excessively extend above the arm 103. Thus, the bottom portion 108 of the ring 107 is prevented from abutting against the edge portion 116 of the support board 110. Consequently, the height of the position of the top end of each of the ink tubes 41 vertically disposed can be suppressed to be low.

Also, as described above, the first support rib 117 supporting the arm 103, and the second support rib 118 supporting the auxiliary arm 106 are formed to extend around the shaft hole 111 of the support board 110. The holding portion 105 of the arm 103 is maintained by these ribs in a state in which the holding portion 105 is floated above the top surface of the support board 110. Consequently, the bottom portion 108 of the ring 107 of the holding portion 105 is surely prevented from colliding with the edge portion 116 of the support board 110.

In a case where the carriage 38 is placed at the flashing position, as illustrated in FIG. 13, the ink tubes 41 abut against the regulating wall 37 and are pushes there against, the holding portion 105 of the turn supporting member 110 is turned toward the regulating wall 37. As described above, the concave cutout portion 120 used to prevent the holding portion 105 of the turn supporting member 110 from abutting against the regulating wall 37. Thus, even when the ink tube 41 abuts against the regulating wall 37, the holding portion 105 of the turn supporting member 110 does not abut against the regulating wall 37. Consequently, sounds of the collimation between the holding portion 105 and the regulating wall 37 are prevented from being generated. Consequently, operation sounds of the carriage 38 are turned down. Also, the collision between the holding portion 105 and the regulating wall 37 is prevented. Thus, the ink tubes 41 uniformly abut against the wall surface of the regulating wall 37. Consequently, the linear steel materials of the ring 107 of the holding portion 105 do not apply local stress to the ink tubes 41.

Thus, according to the multifunction apparatus 1, the carrying portion 104 of the turn supporting member 110 adapted to turn by employing the inner part of each of the U-shaped curved portions as the turn supporting point supports the flat cable 85 slidably. The holding portion 105 slidably holds the predetermined part of each of the ink tubes 41. Consequently, as the ink tubes 41 change the shapes thereof, the arm 103 is turned. The carrying portion 104 and the holding portion 105, which are turned together with the arm 103, support the flat cable 85 and the ink tubes 41 following the reciprocating movement of the carriage 38. Accordingly, the flat cable 85 is prevented from hanging down. Also, the ink tubes 41 are prevented from acting violently and from hanging down. Additionally, these constituents do not touch other members. Thus, the ink tubes 41 and the flat cable 85 are prevented from being damaged. Also, the ink tubes 41 and the flat cable 85 do not touch other members. Thus, the reciprocating movement of the carriage 38 is stabilized. The carrying portion 104 slidably supports the flat cable 85 thereon. Thus, an excessive load applied on the flat cable 85 is not generated. Consequently, the flat cable 85 is prevented from being damaged.

Hereinafter, a first modification of the above aspect is described. The above aspect is adapted so that the flat cable 85 is disposed inside the U-shape curve of each of the ink tubes 41. However, the flat cable 85 may be disposed outside the U-shape curve of each of the ink tubes 41 by reversing the disposition of these constituents. In this arrangement of the ink tubes 41 and the flat cable 85, it is preferable that a flexible one of these constituents, that is, each of the ink tubes 41 or the flat cable 85 is disposed inside the U-shaped curve. Generally, the flat cable 85 is considered to be more flexible than the four ink tubes 41. However, in a case where the number of ink tubes 41 is small, where the material of the insulating coating of the flat cable 85 is selected, or where a plurality of flat cables 85 are bundled, the ink tubes 41 can be considered to be more flexible than the flat cable 85. The curved portion is formed in each of the ink tubes 41 and the flat cable 85 to have a diameter to the extent that no buckling occurs. In a case where the ink tubes 41 or the flat cable 85 is more flexible, the flat cable or tubes can be routed so that the diameter of the curved portion of the flat cable 85 or each of the ink tubes 41 is smaller than the diameter of the curved portion of the other. A space needed to change the shape of each of the ink tubes 41 or of the flat cable 85 is reduced by disposing the flexible one of the flat cable 85 or each of the ink tubes 41 inside the curved portion thereof. Consequently, the miniaturization of the apparatus is achieved.

Figure 15:
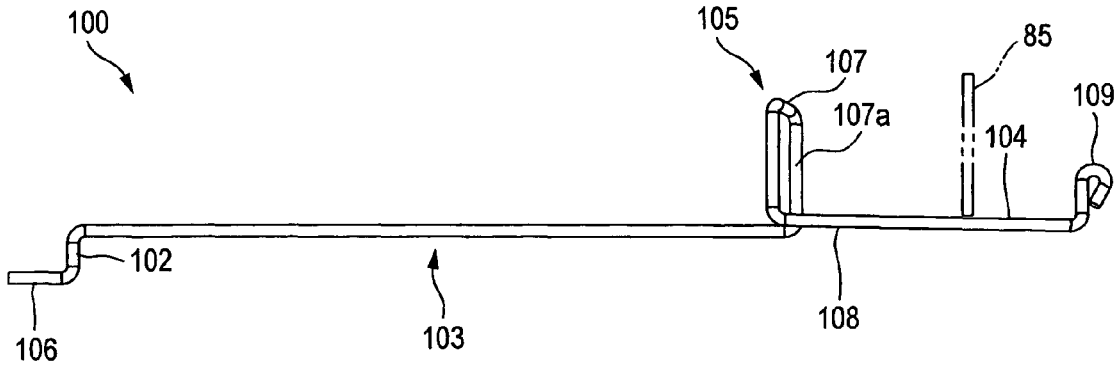
FIG. 15 is a front view illustrating a turn supporting member according to a first modification.

In a case where the flat cable 85 is disposed outside the curved portions of the ink tubes 41, the carrying portion 104 is formed continuously to the bottom portion 108 of the ring 107 of the turn supporting member 110, as shown in FIG. 15. That is, the carrying portion 104 is formed by making a linear steel member rectilinearly extend from the bottom portion 108 in the direction, in which the arm 103 extends. Also, the linear steel member is upwardly erected from the carrying portion 104 to form the curved portion 109. The length in an extending direction of the carrying portion 104, in which the arm 103 extends, is set according to the range in which the flat cable 85 is slidable. Consequently, the bottom of the flat cable 85 is slidably supported on the carrying portion 104. The curved portions 109 prevent an end of the linear steel member from touching the flat cable 85. Also, the flat cable 85 is prevented from being damaged or broken.

Figure 16:
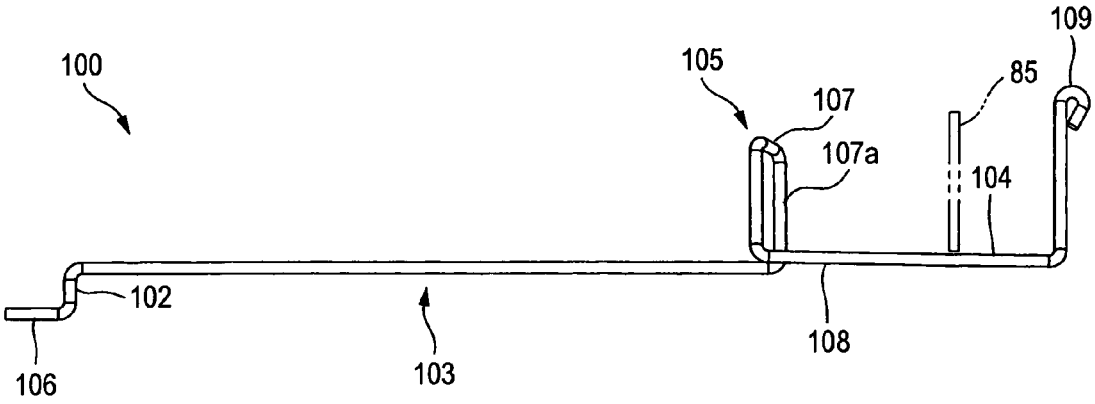
FIG. 16 is another front view illustrating the turn supporting member according to the first modification.

The curved portions 109 may be formed to upwardly extend so that the height of the top end of each of the curved portions 109 is higher than the height of the flat cable 85, as shown in FIG. 16. Consequently, an end of the linear steel member is prevented from touching the flat cable 85. Also, the curved portion 109 abuts against the entirety of one of the front and rear surfaces of the flat cable 85, instead of a specific part in the vicinity of the bottom end of the flat cable 85. Thus, the flat cable 85 is also prevented from being damaged and broken.

In a case where the flat cable 85 is disposed outside the curved portion of each of the ink tubes 41, the arrangement of the ink tubes 41 at the side of the carriage 38 and that of the ink tubes 41 at the side of the fixing clip 36 are adapted as follows. The above aspect is adapted so that the ink tube 41 disposed at the most upstream side in the recording paper conveying direction at the carriage 38 is placed at the uppermost position at the fixing clip 36. However, in the case where the flat cable 85 is disposed outside the curved portion of each of the ink tubes 41, the ink tube 41 disposed at the most downstream side in the recording paper conveying direction at the carriage 38 is placed at the uppermost position at the fixing clip 36. Also, the ink tube 41 disposed at the second most downstream side in the recording paper conveying direction at the carriage 38 is placed at the second uppermost position at the fixing clip 36.

Figure 17:
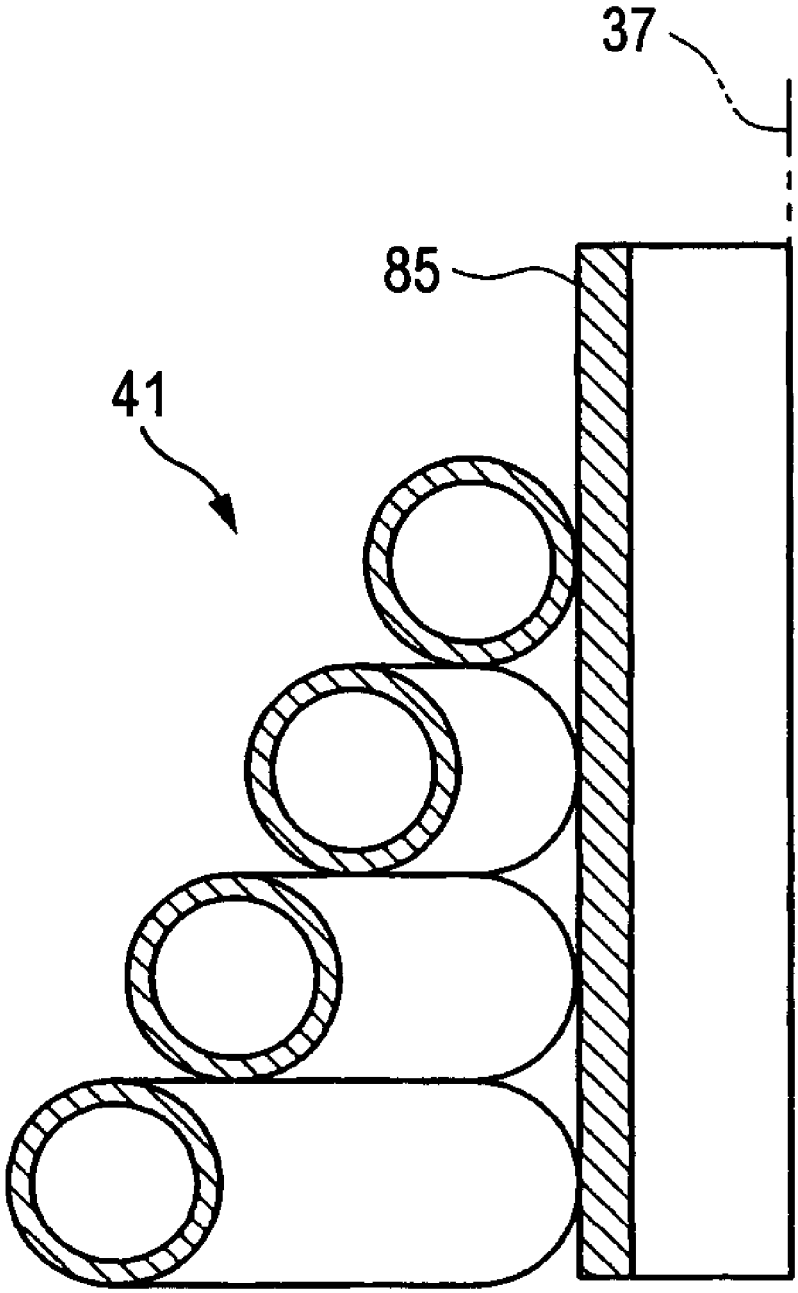
FIG. 17 is a cross-sectional view illustrating a state in which a flat cable is disposed outside a curved portion.

Consequently, as shown in FIG. 17, the four ink tubes 41 are arranged downwardly in an oblique direction at the U-shaped curved portion routed from the carriage 38. The flat cable 85 is configured so that the bottom end thereof is maintained by the turn supporting member 100 at a height substantially equal to the height of the lowermost ink tube 41 disposed at the fixing clip 36, and that one of the front and rear surfaces of the flat cable 85 abuts against the uppermost ink tube 41 at the fixing clip 36. Therefore, the flat cable 85 neither gets into under the four ink tubes 41 nor runs aground the ink tubes 41. Thus, the configurations of the ink tubes 41 and the flat cable 85 outside and inside the ink tubes 41 and the flat cable 85 are maintained. The ink tubes 41 and the flat cable 85 follow the movement of the carriage 38 and change the shapes thereof.

That is, in both of a case where the flat cable 85 is disposed inside the curved portion of each of the ink tubes 41, and where in which the flat cable 85 is disposed outside the curved portion of each of the ink tubes 41, it is sufficient that the ink tube 41 placed furthest from a position (at the upstream side or the downstream side from the ink tube 41), to which the flat cable 85 is fixed, is placed at the uppermost position at the fixing clip 36. In a case where the flat cable 85 is disposed inside the curved portion of each of the ink tubes 41, the fixing position, to which the flat cable 85 is fixed, at the carriage 38 is at the downstream side from the ink tubes 41 in the recording paper conveying direction. Accordingly, the ink tube 41 disposed furthest from the fixing position, to which the flat cable 85 is fixed, at the carriage 38 is the ink tube 41 placed at the most upstream side in the recording paper conveying direction. Conversely, in a case where the flat cable 85 is disposed outside the curved portion of each of the ink tubes 41, the fixing position, to which the flat cable 85 is fixed, at the carriage 38 is at the upstream side from the ink tubes 41 in the recording paper conveying direction. Accordingly, the ink tube 41 disposed furthest from the fixing position, to which the flat cable 85 is fixed, at the carriage 38 is the ink tube 41 placed at the most downstream side in the recording paper conveying direction.

A place, at which the ink tubes 41, which are substantially equal to one another in the length of a part extending from the carriage 38 to the fixing clip 36, are positioned, becomes a more inner position inside the curved portion, as the diameter of the curved portion increases. The ink tube 41 disposed furthest from the fixing position, to which the flat cable 85 is fixed, at the carriage 38 is the ink tube 41 placed at the most upstream side in the recording paper conveying direction at the fixing clip 36. Thus, regardless of the placement of the ink tubes 41 and the flat cable 85, between the four ink tubes 41, the uppermost ink tube 41 becomes closer to the flat cable 85 at the curved portion.

That is, the uppermost ink tube 41 at the fixing clip 36 is placed furthest from the flat cable 85 at the carriage 38. Thus, in a case where the flat cable 85 is placed inside the curved portion of the ink tubes 41, the uppermost ink tube 41 is disposed furthest from the fixing clip 36, so that the diameter of the curved portion is increased. This ink tube is placed at the innermost position in the curved portion. In a case where the flat cable 85 is placed outside the curved portion of the ink tubes 41, the uppermost ink tube 41 at the fixing clip 36 is disposed closest to the fixing clip 36 at the carriage 38, so that the diameter of the curved portion is decreased. Thus, this ink tube 41 is positioned at the most outer side of the curved portion. A flat cable 85 is disposed so that one of the front surface and the rear surface thereof can abut against the uppermost ink tube 41 at the fixing clip 36. Therefore, even when the bottom end of the flat cable 85 is set at a height substantially equal to the height of the lowermost ink tube 41 at the fixing clip 36, the flat cable 85 does not run aground the arrangement of the ink tube 41. Consequently, the bottom end of the flat cable 85 is prevented from touching the ink tube 41 and being damaged or broken.

Although not shown, the top end of the flat cable 85 is placed at a height that is substantially equal to or lower than the height of the uppermost ink tube 41 at the fixing clip 36. Similarly, even in a case where the flat cable 85 gets into under the arrangement of the four ink tubes 41, it is sufficient to dispose the ink tubes 41 so that one of the front surface and the rear surface of the flat cable 85 abuts against the ink tube 41 closest to the flat cable 85 at the curved portion. Consequently, the flat cable 85 does not get into under the arrangement of the ink tube 41 in the vicinity of the curved portion. Consequently, the top end of the flat cable 85 is prevented from being in contact with and damaged and from being broken.

Figure 18:
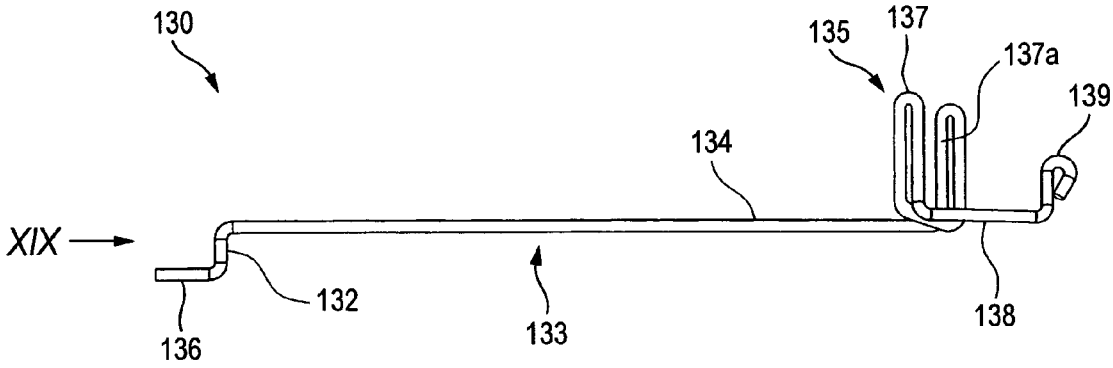
FIG. 18 is a front view illustrating the configuration of the turn supporting member.
Figure 19:
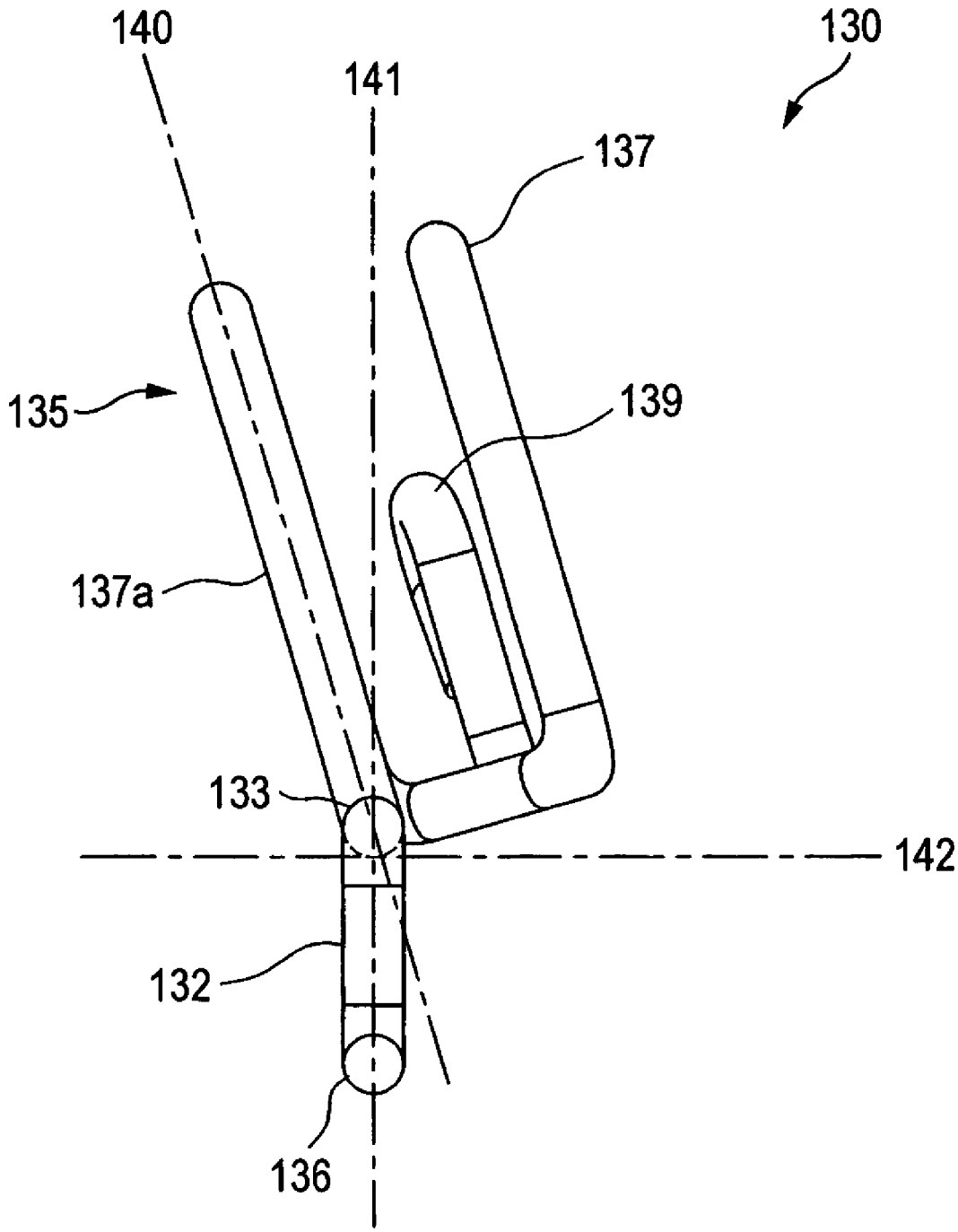
FIG. 19 is a side view which is taken in the direction of an arrow XIX shown in FIG. 18 and which illustrates the configuration of the turn supporting member.

Hereinafter, a second modification of the above aspect is described. Although the holding portion 105 of the turn supporting member 100 is formed in the above aspect to surround the ink tubes 41 by the ring 107, it is sufficient that the holding portion according to the invention supports the ink tubes 41 at least from three directions. FIG. 18 is a front view illustrating the configuration of the turn supporting member 130. FIG. 19 is a side view, which is taken in the direction of an arrow XIX shown in FIG. 18 and which illustrates the configuration of the turn supporting member 130.

The turn supporting member 130 includes an axis portion 132 serving as a turn supporting point, an arm 133 extending horizontally from the axis portion 132, a carrying portion 134 formed at the base end side of the arm 133, a holding portion 135 formed at a leading end side of the arm 133, and an auxiliary arm 103 extending from the axis portion 132 to be formed into a crank shape with respect to the axis portion 132 and the arm 133. These components of the turn supporting member 130 are integrally formed by bending linear steel materials. The axis portion 132, the arm 133, the carrying portion 134, and the auxiliary arm 136 respectively correspond to the axis portion 102, the arm 103, the carrying portion 104, and the auxiliary arm 106.

The holding portion 135 formed at the end side of the arm 133 is configured so that the ink tubes 41 are held from three directions. The holding portion 135 includes a U-shape portion 137 which is opened in the top side thereof and is substantially U-shaped as shown in the direction of the arrow XIX, a bottom portion 138 protruded to the end side from the U-shape portion, and the curved portion 139 formed at the end of the bottom portion 138. The relationship between the inside dimension width, the inside dimension height of the u-shape portion 137, and the outside diameter of each of the ink tubes 41 is similar to that described. The relationship holds good on condition that the arrangement of the ink tubes 41 is not changed in the U-shape portion 137, and that the ink tubes 41 can freely slide in a direction in which the ink tubes 41 extend. The bottom portion 138 of the U-shape portion 137 is separated therefrom in a direction intersecting with an extending direction, in which the arm 133 extends, and extends in substantially the same direction as that in which the arm 133 extends. The curved portion 139 is formed by upwardly bending an end part of the bottom portion 138 and then bending this end part like a circular arc outwardly in the direction, in which the arm 133 extends.

As shown in FIG. 19, an axis line 132 (the center line of the linear steel member) of the erected part 137*a* of the U-shape portion 137, which is erected from the arm 133, is inclined to an axis line 141 of the axis portion 132. That is, the axis line 141 of the axis portion 132 extends in a vertical direction, while the axis line 140 of the erected part 137*a* of the U-shape portion 137 is inclined to the vertical direction. A side in the direction of inclination of the erected part 137*a* is opposite to a side, at which the bottom portion 138 is disposed, with respect to the arm 133. The U-shape portion 137 is formed like a rectangle longitudinally elongated in the direction of the axis line 140 so that the sides of the rectangle are substantially perpendicular to each other. Thus, the bottom portion 138 is placed at a position, whose height is equal to or higher than that of the arm 133, by inclining the axis line 140 toward the side opposite to the bottom portion 138. That is, the bottom portion 138 is positioned at a place higher than the arm 133. Also, the bottom portion 138 is positioned at a place opposite to the support board 110 with respect to a turning surface 142 of the arm 133.

According to such a second modification, advantages similar to those of the above aspect can be obtained. The flat cable 85 is prevented from hanging down. The ink tubes 41 are prevented from acting violently and from hanging down. These constituents do not touch other members. Thus, the ink tubes 41 and the flat cable 85 are prevented from being damaged. Additionally, because the ink tubes 41 and the flat cable 85 are not in contact with other members, the reciprocating movement of the carriage 38 is stabilized. Also, the carrying portion 134 slidably supports the flat cable 85. Thus, no excessive load on the flat cable 85 is generated. Further, the flat cable 85 is prevented from being damaged.

The above aspect and the first and second modifications are adapted so that the turn supporting member 100 and 130 are turned by being supported on the support board 110, and that the ink tubes 41 held by the holding portions 103 and 135 are supported from below by the arms 103 or 133. The holding portion according to the invention may be formed to hang from the arm.

Figure 20:
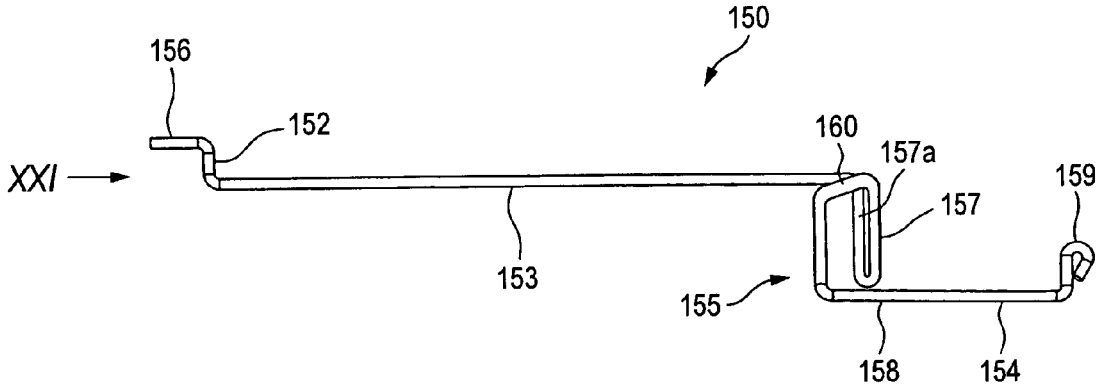
FIG. 20 is a front view illustrating the configuration of a turn supporting member.
Figure 21:
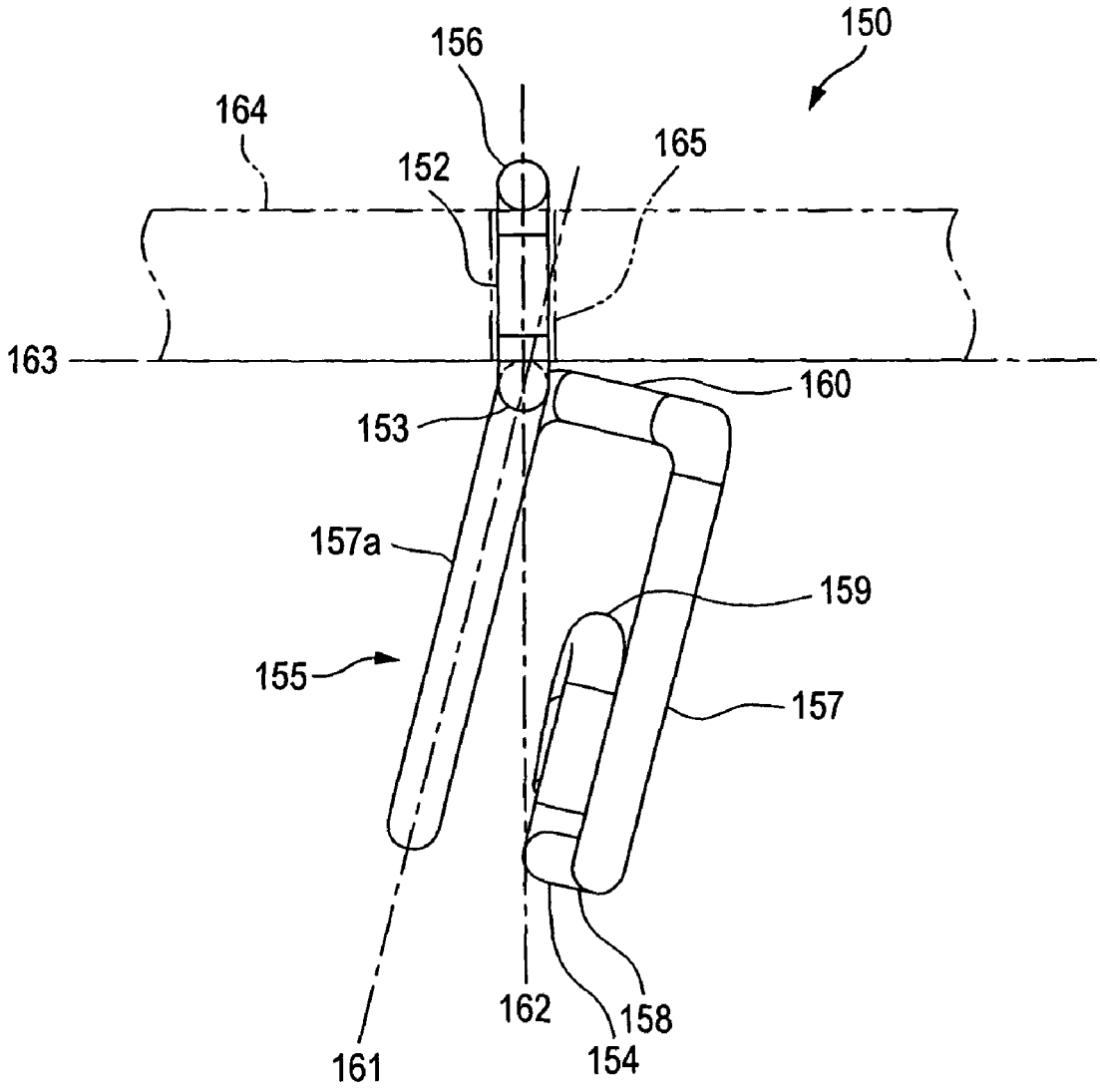
FIG. 21 is a side view which is taken in the direction of an arrow XXI shown in FIG. 20 and which illustrates the configuration of the turn supporting member.

Hereinafter, a third modification of the above aspect is described. FIG. 20 is a front view illustrating the configuration of a turn supporting member 150 according to the third modification. FIG. 21 is a side view which is taken in the direction of an arrow XXI shown in FIG. 20 and which illustrates the configuration of the turn supporting member 150.

The turn supporting member 150 includes an axis portion 152 serving as a turn supporting point, an arm 153 extending horizontally from the axis portion 152, a holding portion 153 formed at a leading end side of the arm 153, and an auxiliary arm 153 extending from the axis portion 152 to be formed into a crank shape with respect to the axis portion 152 and the arm 153. These components of the turn supporting member 150 are integrally formed by bending linear steel materials. The axis portion 152, the arm 153, and the auxiliary arm 156 respectively correspond to the axis portion 102, the arm 103, the carrying portion 104, and the auxiliary arm 106.

The holding portion 155 formed at the end of the arm 153 holds the ink tubes 41 by surrounding the ink tubes 41. The holding portion 155 includes a ring 157, a bottom portion 158 projected to the leading end from the ring 157, and a curved portion 159 formed at the end of the bottom portion 158. In a turn supporting member 150 according to the third modification, the flat cable 85 is disposed outside the U-shaped curve of each of the ink tubes 41, similarly to the first modification. The carrying portion 154 is formed continuously to the bottom portion 158 of the turn supporting member 150. The relationship between the inside dimension width, the inside dimension height of the ring 157, and the outside diameter of each of the ink tubes 41 is similar to that described. The relationship is such that the arrangement of the ink tubes 41 is not changed in the ring 157, and that the ink tubes 41 can freely slide in a direction in which the ink tubes 41 extend. The bottom portion 158 of the ring 157 is separated therefrom in a direction intersecting with an extending direction, in which the arm 153 extends, and extends in substantially the same direction as that in which the arm 153 extends. The curved portion 159 is formed by upwardly bending an end part of the bottom portion 158 and then bending this end part like a circular arc outwardly in the direction, in which the arm 153 extends. A top end portion 160 constituting the top end of the ring 157 is upwardly bent from the bottom portion 158 and is subsequently and additionally bent to the arm 153. That is, the top portion 160 extends in a direction intersecting with the direction in which the arm 153 extends.

As shown in FIG. 21, an axis line 161 (the center line of the linear steel member) of the hanging part 157*a* of the ring 157, which hangs down from the arm 153, is inclined to an axis line 162 of the axis portion 152. That is, the axis line 162 of the axis portion 152 extends in a vertical direction, while the axis line 161 of the hanging part 157*a* of the ring 157 is inclined to the vertical direction. A side in the direction of inclination of the hanging part 157*a* is opposite to a side, at which the top portion 160 is disposed, with respect to the arm 153. The ring 157 is formed like a rectangle longitudinally elongated in the direction of the axis line 161 so that the sides of the rectangle are substantially perpendicular to each other. Thus, the top portion 160 is placed at a position, whose height is equal to or lower than that of the arm 153, by inclining the axis line 161 toward the side opposite to the top portion 160. That is, the top portion 160 is positioned at a place lower than the arm 153. Also, the top portion 160 is positioned at a place opposite to the support board 164 with respect to a turning surface 163 of the arm 153.

The support board 164 is a flat-plate-like member, in which a shaft hole 165 supporting the axis portion 152 is formed, and is fixed to the apparatus body. The arm 153 is turned along the bottom surface of the support board 164. The holding portion 155 is accommodated in a part of the range, in which the arm 153 turns, in the bottom surface portion. That is, the turn support member 150 is turnably supported to be hung by the support board 164.

Such a third modification obtains advantages similar to those of the above aspect. The flat cable 85 is prevented from hanging down. The ink tubes 41 are prevented from acting violently and from hanging down. These constituents do not touch other members. Thus, the ink tubes 41 and the flat cable 85 are prevented from being damaged. Additionally, because the ink tubes 41 and the flat cable 85 are not in contact with other members, the reciprocating movement of the carriage 38 is stabilized. Also, the carrying portion 134 slidably supports the flat cable 85. Thus, no excessive load on the flat cable 85 is generated. Further, the flat cable 85 is prevented from being damaged.

Figure 22:
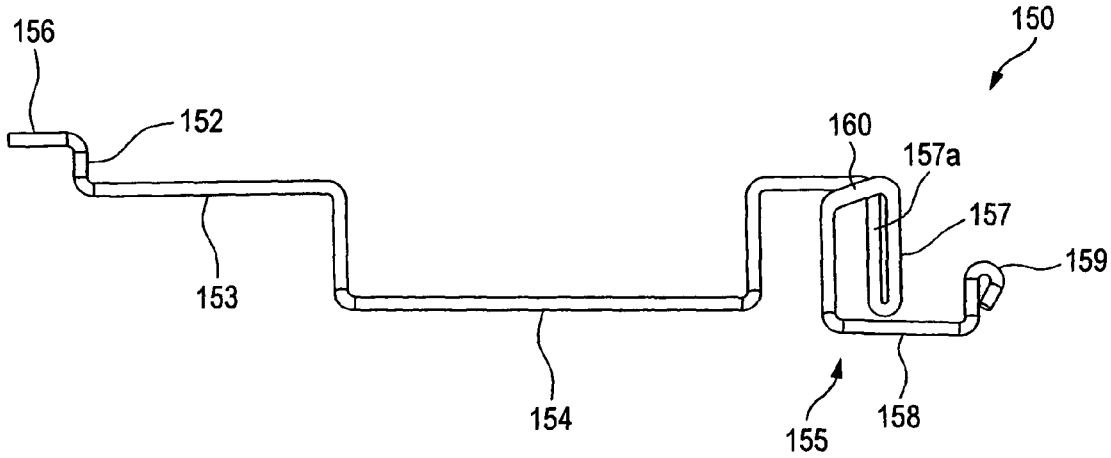
FIG. 22 is a front view illustrating the turn supporting member having a carrying portion formed inside a holding portion thereof.
Figure 23:
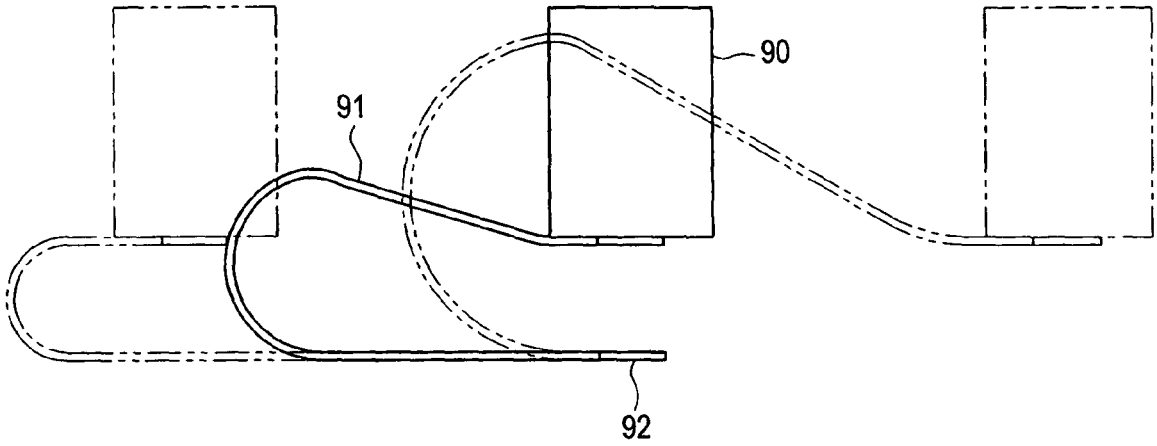
FIG. 23 is a schematic view illustrating a carriage and a flat cable in a conventional image recording apparatus.

In a case where the flat cable 85 is disposed in the U-shaped curve of each of the ink tubes 41 in the third modification, the arm 153 is vertically downwardly bent, as shown in FIG. 22. Further, the arm 153 is horizontally bent at a predetermined height position. Thus, a carrying portion 154 is formed. Similarly to the above aspect, the flat cable 85 is slidably supported by the carrying portion 154 inside the curved portion of each of the ink tubes 41.

Thus, according to the multifunction apparatus 1, the concave cutout portion 120 adapted to prevent the holding portion 105 from abutting against the regulating wall 37 is formed in the regulating wall 37 which abuts against the predetermined part of the ink tube 41 slidably held by the holding portion 105 of the turn supporting member 100. Thus, even when the predetermined part of the ink tube 41 abuts against the regulating wall 37 the holding portion 105 of the turn supporting member 100 does not abut against the regulating wall 37. Consequently, no sounds of the collision between the holding portion 105 and the regulating wall 37 are prevented from being generated when the ink tube 41 changes the shape thereof. Also, local stress to be applied to the ink tube 41 is prevented from being generated by the holding portion 105.

Hereinafter, a first modification of the above aspect is described. Although the holding portion 105 of the turn supporting member 100 is formed in the above aspect to surround the ink tubes 41 by the ring 107, it is sufficient that the holding portion according to the invention supports the ink tubes 41 at least from three directions. FIG. 15 is a front view illustrating the configuration of the turn supporting member 130. FIG. 16 is a side view, which is taken in the direction of an arrow 131 shown in FIG. 15 and which illustrates the configuration of the turn supporting member 130.

The turn supporting member 130 includes an axis portion 132 serving as a turn supporting point, an arm 133 extending horizontally from the axis portion 132, a carrying portion 134 formed at the base end side of the arm 133, a holding portion 135 formed at a leading end side of the arm 133, and an auxiliary arm 103 extending from the axis portion 132 to be formed into a crank shape with respect to the axis portion 132 and the arm 133. These components of the turn supporting member 130 are integrally formed by bending linear steel materials. The axis portion 132, the arm 133, the carrying portion 134, and the auxiliary arm 136 respectively correspond to the axis portion 102, the arm 103, the carrying portion 104, and the auxiliary arm 106.

The holding portion 135 formed at the end side of the arm 133 is configured so that the ink tubes 41 are held from three directions. The holding portion 135 includes a U-shape portion 137 which is opened in the top side thereof and is substantially U-shaped as shown in the direction of the arrow 131, a bottom portion 138 protruded to the end side from the U-shape portion, and the curved portion 139 formed at the end of the bottom portion 138. The relationship between the inside dimension width, the inside dimension height of the u-shape portion 137, and the outside diameter of each of the ink tubes 41 is similar to that described. The relationship holds good on condition that the arrangement of the ink tubes 41 is not changed in the U-shape portion 137, and that the ink tubes 41 can freely slide in a direction in which the ink tubes 41 extend. The bottom portion 138 of the U-shape portion 137 is separated therefrom in a direction intersecting with an extending direction, in which the arm 133 extends, and extends in substantially the same direction as that in which the arm 133 extends. The curved portion 139 is formed by upwardly bending an end part of the bottom portion 138 and then bending this end part like a circular arc outwardly in the direction, in which the arm 133 extends.

As shown in FIG. 16, an axis line 132 (the center line of the linear steel member) of the erected part 137*a* of the U-shape portion 137, which is erected from the arm 133, is inclined to an axis line 141 of the axis portion 132. That is, the axis line 141 of the axis portion 132 extends in a vertical direction, while the axis line 140 of the erected part 137*a* of the U-shape portion 137 is inclined to the vertical direction. A side in the direction of inclination of the erected part 137*a* is opposite to a side, at which the bottom portion 138 is disposed, with respect to the arm 133. The U-shape portion 137 is formed like a rectangle longitudinally elongated in the direction of the axis line 140 so that the sides of the rectangle are substantially perpendicular to each other. Thus, the bottom portion 138 is placed at a position, whose height is equal to or higher than that of the arm 133, by inclining the axis line 140 toward the side opposite to the bottom portion 138. That is, the bottom portion 138 is positioned at a place higher than the arm 133. Also, the bottom portion 138 is positioned at a place opposite to the support board 110 with respect to a plane of rotation 142 of the arm 133.

The holding portion 135 has an outer shape substantially similar to the holding portion 105 of the above aspect. Thus, in a state in which the ink tubes 41 abut against the wall surface of the regulating wall 37, the holding portion 135 and its peripheral part go into the concave cutout portion 120 of the above aspect and do not abut against the regulating wall 37. Consequently, no sounds of the collision between the holding portion 135 and the regulating wall 37 are prevented from being generated when the ink tube 41 changes the shape thereof. Also, local stress to be applied to the ink tube 41 is prevented from being generated by the holding portion 135.

The above aspect and the first modification are adapted so that the turn supporting member 100 and 130 are turned by being supported on the support board 110, and that the ink tubes 41 held by the holding portions 103 and 135 are supported from below by the arms 103 or 133. The holding portion according to the invention may be formed to hang from the arm.

Hereinafter, a second modification of the above aspect is described. FIG. 17 is a front view illustrating the configuration of a turn supporting member 150 according to the second modification. FIG. 16 is a side view which is taken in the direction of an arrow 151 shown in FIG. 17 and which illustrates the configuration of the turn supporting member 150.

The turn supporting member 150 includes an axis portion 152 serving as a turn supporting point, an arm 153 extending horizontally from the axis portion 152, a holding portion 153 formed at a leading end side of the arm 153, and an auxiliary arm 153 extending from the axis portion 152 to be formed into a crank shape with respect to the axis portion 152 and the arm 153. These components of the turn supporting member 150 are integrally formed by bending linear steel materials. The axis portion 152, the arm 153, and the auxiliary arm 156 respectively correspond to the axis portion 102, the arm 103, the carrying portion 104, and the auxiliary arm 106. Additionally, the turn supporting member 150 according to the second modification has no part corresponding to the carrying portion 104 of the above aspect, which supports the flat cable 85 thereon.

The holding portion 155 formed at the end of the arm 153 holds the ink tubes 41 by surrounding the ink tubes 41. The holding portion 155 includes a ring 157, a bottom portion 158 projected to the leading end from the ring 157, and a curved portion 159 formed at the end of the bottom portion 158. The relationship between the inside dimension width, the inside dimension height of the ring 157, and the outside diameter of each of the ink tubes 41 is similar to that described. The relationship holds good on condition that the arrangement of the ink tubes 41 is not changed in the ring 157, and that the ink tubes 41 can freely slide in a direction in which the ink tubes 41 extend. The bottom portion 158 of the ring 157 is separated therefrom in a direction intersecting with an extending direction, in which the arm 153 extends, and extends in substantially the same direction as that in which the arm 153 extends. The curved portion 159 is formed by upwardly bending an end part of the bottom portion 158 and then bending this end part like a circular arc outwardly in the direction, in which the arm 153 extends. A top end portion 160 constituting the top end of the ring 157 is upwardly bent from the bottom portion 158 and is subsequently and additionally bent to the arm 153. That is, the top portion 160 extends in a direction intersecting with the direction in which the arm 153 extends.

As shown in FIG. 18, an axis line 161 (the center line of the linear steel member) of the hanging part 157*a* of the ring 157, which hangs down from the arm 153, is inclined to an axis line 162 of the axis portion 152. That is, the axis line 162 of the axis portion 152 extends in a vertical direction, while the axis line 161 of the hanging part 157*a* of the ring 157 is inclined to the vertical direction. A side in the direction of inclination of the hanging part 157*a* is opposite to a side, at which the top portion 160 is disposed, with respect to the arm 153. The ring 157 is formed like a rectangle longitudinally elongated in the direction of the axis line 161 so that the sides of the rectangle are substantially perpendicular to each other. Thus, the top portion 160 is placed at a position, whose height is equal to or lower than that of the arm 153, by inclining the axis line 161 toward the side opposite to the top portion 160. That is, the top portion 160 is positioned at a place lower than the arm 153. Also, the top portion 160 is positioned at a place opposite to the support board 164 with respect to a plane of rotation 163 of the arm 153.

The support board 164 is a flat-plate-like member, in which a shaft hole 165 supporting the axis portion 152 is formed, and is fixed to the apparatus body. The arm 153 is turned along the bottom surface of the support board 164. The holding portion 155 is accommodated in a part of the range, in which the arm 153 turns, in the bottom surface portion. That is, the turn support member 150 is turnably supported to be hung by the support board 164.

The shape of the concave cutout portion 102 is changed so that the holding portion 155 does not abut against the regulating wall 37. Thus, the holding portion 155 and its peripheral part go into the modified concave cutout portion 120, so that the holding portion 155 does not abut against the regulating wall 37. Consequently, no sounds of the collision between the holding portion 155 and the regulating wall 37 are prevented from being generated when the ink tube 41 changes the shape thereof. Also, local stress to be applied to the ink tube 41 is prevented from being generated by the holding portion 155.

Thus, the multifunction apparatus 1 is configured so that one end sides of a plurality of ink tubes 41 are fixed to the carriage 38 and are arranged horizontally along the recording medium conveying direction, that the other end sides of the plurality of ink tubes 41 are fixed to the fixing clip 36 of the apparatus body are vertically arranged, that the curved portions adapted to turn around in the direction, in which the carriage 38 reciprocates, are formed. Also, the flat cable 85 is configured to extend in the same direction as the direction, in which the ink tubes 41 extend, so that one of the front and rear surfaces of the flat cable 85 is able to abut against the closest one of the plurality of ink tubes 41 at the curved portion. Thus, the flat cable 85 does not run aground or get into under the plurality of ink tubes 41 in the vicinity of the curved portion thereof. Consequently, the top or bottom end of the flat cable 85 is prevented from touching the ink tube 41 and from being damaged or broken.

Hereinafter, a first modification of the above aspect is described. The above aspect is adapted so that the flat cable 85 is disposed inside the U-shape curve of each of the ink tubes 41. However, the flat cable 85 may be disposed outside the U-shape curve of each of the ink tubes 41 by reversing the disposition of these constituents. In this arrangement of the ink tubes 41 and the flat cable 85, it is preferable that a flexible one of these constituents, that is, each of the ink tubes 41 or the flat cable 85 is disposed inside the U-shaped curve. Generally, the flat cable 85 is considered to be more flexible than the four ink tubes 41. However, in a case where the number of ink tubes 41 is small, where the material of the insulating coating of the flat cable 85 is selected, or where a plurality of flat cables 85 are bundled, the ink tubes 41 can be considered to be more flexible than the flat cable 85. The curved portion is formed in each of the ink tubes 41 and the flat cable 85 to have a diameter to the extent that no buckling occurs. In a case where the ink tubes 41 or the flat cable 85 is more flexible, the flat cable or tubes can be routed so that the diameter of the curved portion of the flat cable 85 or each of the ink tubes 41 is smaller than the diameter of the curved portion of the other. A space needed to change the shape of each of the ink tubes 41 or of the flat cable 85 is reduced by disposing the flexible one of the flat cable 85 or each of the ink tubes 41 inside the curved portion thereof. Consequently, the miniaturization of the apparatus is achieved.

In a case where the flat cable 85 is disposed outside the curved portions of the ink tubes 41, the carrying portion 104 is formed continuously to the bottom portion 108 of the ring 107 of the turn supporting member 110, as shown in FIG. 15. That is, the carrying portion 104 is formed by making a linear steel member rectilinearly extend from the bottom portion 108 in the direction, in which the arm 103 extends. Also, the linear steel member is upwardly erected from the carrying portion 104 to form the curved portion 109. The length in an extending direction of the carrying portion 104, in which the arm 103 extends, is set according to the range in which the flat cable 85 is slidable. Consequently, the bottom of the flat cable 85 is slidably supported on the carrying portion 104. The curved portions 109 prevent an end of the linear steel member from touching the flat cable 85. Also, the flat cable 85 is prevented from being damaged or broken.

The curved portions 109 may be formed to upwardly extend so that the height of the top end of each of the curved portions 109 is higher than the height of the flat cable 85, as shown in FIG. 16. Consequently, an end of the linear steel member is prevented from touching the flat cable 85. Also, the curved portion 109 abuts against the entirety of one of the front and rear surfaces of the flat cable 85, instead of a specific part in the vicinity of the bottom end of the flat cable 85. Thus, the flat cable 85 is also prevented from being damaged and broken.

In a case where the flat cable 85 is disposed outside the curved portion of each of the ink tubes 41, the arrangement of the ink tubes 41 at the side of the carriage 38 and that of the ink tubes 41 at the side of the fixing clip 36 are adapted as follows. The above aspect is adapted so that the ink tube 41 disposed at the most upstream side in the recording paper conveying direction at the carriage 38 is placed at the uppermost position at the fixing clip 36. However, in the case where the flat cable 85 is disposed outside the curved portion of each of the ink tubes 41, the ink tube 41 disposed at the most downstream side in the recording paper conveying direction at the carriage 38 is placed at the uppermost position at the fixing clip 36. Also, the ink tube 41 disposed at the second most downstream side in the recording paper conveying direction at the carriage 38 is placed at the second uppermost position at the fixing clip 36.

Consequently, as shown in FIG. 17, the four ink tubes 41 are arranged downwardly in an oblique direction at the U-shaped curved portion routed from the carriage 38. The flat cable 85 is configured so that the bottom end thereof is maintained by the turn supporting member 100 at a height substantially equal to the height of the lower most ink tube 41 disposed at the fixing clip 36, and that one of the front and rear surfaces of the flat cable 85 abuts against the uppermost ink tube 41 at the fixing clip 36. Therefore, the flat cable 85 neither gets into under the four ink tubes 41 nor runs aground the ink tubes 41. Thus, the configurations of the ink tubes 41 and the flat cable 85 outside and inside the ink tubes 41 and the flat cable 85 are maintained. The ink tubes 41 and the flat cable 85 follow the movement of the carriage 38 and change the shapes thereof.

That is, in both of a case where the flat cable 85 is disposed inside the curved portion of each of the ink tubes 41, and where in which the flat cable 85 is disposed outside the curved portion of each of the ink tubes 41, it is sufficient that the ink tube 41 placed furthest from a position (at the upstream side or the downstream side from the ink tube 41), to which the flat cable 85 is fixed, is placed at the uppermost position at the fixing clip 36. In a case where the flat cable 85 is disposed inside the curved portion of each of the ink tubes 41, the fixing position, to which the flat cable 85 is fixed, at the carriage 38 is at the downstream side from the ink tubes 41 in the recording paper conveying direction. Accordingly, the ink tube 41 disposed furthest from the fixing position, to which the flat cable 85 is fixed, at the carriage 38 is the ink tube 41 placed at the most upstream side in the recording paper conveying direction. Conversely, in a case where the flat cable 85 is disposed outside the curved portion of each of the ink tubes 41, the fixing position, to which the flat cable 85 is fixed, at the carriage 38 is at the upstream side from the ink tubes 41 in the recording paper conveying direction. Accordingly, the ink tube 41 disposed furthest from the fixing position, to which the flat cable 85 is fixed, at the carriage 38 is the ink tube 41 placed at the most downstream side in the recording paper conveying direction.

A place, at which the ink tubes 41, which are substantially equal to one another in the length of a part extending from the carriage 38 to the fixing clip 36, are positioned, becomes a more inner position inside the curved portion, as the diameter of the curved portion increases. The ink tube 41 disposed furthest from the fixing position, to which the flat cable 85 is fixed, at the carriage 38 is the ink tube 41 placed at the most upstream side in the recording paper conveying direction at the fixing clip 36. Thus, regardless of the placement of the ink tubes 41 and the flat cable 85, between the four ink tubes 41, the uppermost ink tube 41 becomes closer to the flat cable 85 at the curved portion.

That is, the uppermost ink tube 41 at the fixing clip 36 is placed furthest from the flat cable 85 at the carriage 38. Thus, in a case where the flat cable 85 is placed inside the curved portion of the ink tubes 41, the uppermost ink tube 41 is disposed furthest from the fixing clip 36, so that the diameter of the curved portion is increased. This ink tube is placed at the innermost position in the curved portion. In a case where the flat cable 85 is placed outside the curved portion of the ink tubes 41, the uppermost ink tube 41 at the fixing clip 36 is disposed closest to the fixing clip 36 at the carriage 38, so that the diameter of the curved portion is decreased. Thus, this ink tube 41 is positioned at the most outer side of the curved portion. A flat cable 85 is disposed so that one of the front surface and the rear surface thereof can abut against the uppermost ink tube 41 at the fixing clip 36. Therefore, even when the bottom end of the flat cable 85 is set at a height substantially equal to the height of the lowermost ink tube 41 at the fixing clip 36, the flat cable 85 does not run aground the arrangement of the ink tube 41. Consequently, the bottom end of the flat cable 85 is prevented from touching the ink tube 41 and being damaged or broken.

Although not shown, the top end of the flat cable 85 is placed at a height that is substantially equal to or lower than the height of the uppermost ink tube 41 at the fixing clip 36. Similarly, even in a case where the flat cable 85 gets into under the arrangement of the four ink tubes 41, it is sufficient to dispose the ink tubes 41 so that one of the front surface and the rear surface of the flat cable 85 abuts against the ink tube 41 closest to the flat cable 85 at the curved portion. Consequently, the flat cable 85 does not get into under the arrangement of the ink tube 41 in the vicinity of the curved portion. Consequently, the top end of the flat cable 85 is prevented from being in contact with and damaged and from being broken.

Hereinafter, a second modification of the above aspect is described. Although the holding portion 105 of the turn supporting member 100 is formed in the above aspect to surround the ink tubes 41 by the ring 107, it is sufficient that the holding portion according to the invention supports the ink tubes 41 at least from three directions. FIG. 18 is a front view illustrating the configuration of the turn supporting member 130. FIG. 19 is a side view, which is taken in the direction of an arrow 131 shown in FIG. 18 and which illustrates the configuration of the turn supporting member 130.

The turn supporting member 130 includes an axis portion 132 serving as a turn supporting point, an arm 133 extending horizontally from the axis portion 132, a carrying portion 134 formed at the base end side of the arm 133, a holding portion 135 formed at a leading end side of the arm 133, and an auxiliary arm 103 extending from the axis portion 132 to be formed into a crank shape with respect to the axis portion 132 and the arm 133. These components of the turn supporting member 130 are integrally formed by bending linear steel materials. The axis portion 132, the arm 133, the carrying portion 134, and the auxiliary arm 136 respectively correspond to the axis portion 102, the arm 103, the carrying portion 104, and the auxiliary arm 106.

The holding portion 135 formed at the end side of the arm 133 is configured so that the ink tubes 41 are held from three directions. The holding portion 135 includes a U-shape portion 137 which is opened in the top side thereof and is substantially U-shaped as shown in the direction of the arrow 131, a bottom portion 138 protruded to the end side from the U-shape portion, and the curved portion 139 formed at the end of the bottom portion 138. The relationship between the inside dimension width, the inside dimension height of the u-shape portion 137, and the outside diameter of each of the ink tubes 41 is similar to that described. The relationship holds good on condition that the arrangement of the ink tubes 41 is not changed in the U-shape portion 137, and that the ink tubes 41 can freely slide in a direction in which the ink tubes 41 extend. The bottom portion 138 of the U-shape portion 137 is separated therefrom in a direction intersecting with an extending direction, in which the arm 133 extends, and extends in substantially the same direction as that in which the arm 133 extends. The curved portion 139 is formed by upwardly bending an end part of the bottom portion 138 and then bending this end part like a circular arc outwardly in the direction, in which the arm 133 extends.

As shown in FIG. 18, an axis line 132 (the center line of the linear steel member) of the erected part 137*a* of the U-shape portion 137, which is erected from the arm 133, is inclined to an axis line 141 of the axis portion 132. That is, the axis line 141 of the axis portion 132 extends in a vertical direction, while the axis line 140 of the erected part 137*a* of the U-shape portion 137 is inclined to the vertical direction. A side in the direction of inclination of the erected part 137*a* is opposite to a side, at which the bottom portion 138 is disposed, with respect to the arm 133. The U-shape portion 137 is formed like a rectangle longitudinally elongated in the direction of the axis line 140 so that the sides of the rectangle are substantially perpendicular to each other. Thus, the bottom portion 138 is placed at a position, whose height is equal to or higher than that of the arm 133, by inclining the axis line 140 toward the side opposite to the bottom portion 138. That is, the bottom portion 138 is positioned at a place higher than the arm 133. Also, the bottom portion 138 is positioned at a place opposite to the support board 110 with respect to a plane of rotation 142 of the arm 133.

According to such a second modification, advantages similar to those of the above aspect can be obtained. The flat cable 85 is prevented from running aground and getting into under a plurality of ink tubes 41 in the vicinity of the curved portion. Thus, the top end and the bottom end of the flat cable 85 are prevented from touching the ink tubes 41. Consequently, the flat cable 85 is prevented from being damaged and broken.

The above aspect and the first and second modifications are adapted so that the turn supporting member 100 and 130 are turned by being supported on the support board 110, and that the ink tubes 41 constrained by the holding portions 105 and 135 are supported from below by the arms 103 or 133. The constraining portion according to the invention may be formed to hang from the arm.

Hereinafter, a third modification of the above aspect is described. FIG. 20 is a front view illustrating the configuration of a turn supporting member 150 according to the third modification. FIG. 21 is a side view which is taken in the direction of an arrow 151 shown in FIG. 20.

The turn supporting member 150 includes an axis portion 152 serving as a turn supporting point, an arm 153 extending horizontally from the axis portion 152, a holding portion 153 formed at a leading end side of the arm 153, and an auxiliary arm 153 extending from the axis portion 152 to be formed into a crank shape with respect to the axis portion 152 and the arm 153. These components of the turn supporting member 150 are integrally formed by bending linear steel materials. The axis portion 152, the arm 153, and the auxiliary arm 156 respectively correspond to the axis portion 102, the arm 103, the carrying portion 104, and the auxiliary arm 106.

The holding portion 155 formed at the end of the arm 153 holds the ink tubes 41 by surrounding the ink tubes 41. The holding portion 155 includes a ring 157, a bottom portion 158 projected to the leading end from the ring 157, and a curved portion 159 formed at the end of the bottom portion 158. In a turn supporting member 150 according to the third modification, the flat cable 85 is disposed outside the U-shaped curve of each of the ink tubes 41, similarly to the first modification. The carrying portion 154 is formed continuously to the bottom portion 158 of the turn supporting member 150. The holding portion 135 formed at the end side of the arm 133 is configured so that the ink tubes 41 are held from three directions. The holding portion 135 includes a U-shape portion 137 which is opened in the top side thereof and is substantially U-shaped as shown in the direction of the arrow 131, a bottom portion 138 protruded to the end side from the U-shape portion, and the curved portion 139 formed at the end of the bottom portion 138. The relationship between the inside dimension width, the inside dimension height of the ring 157, and the outside diameter of each of the ink tubes 41 is similar to that described. The relationship holds good on condition that the arrangement of the ink tubes 41 is not changed in the ring 157, and that the ink tubes 41 can freely slide in a direction in which the ink tubes 41 extend. The bottom portion 158 of the ring 157 is separated therefrom in a direction intersecting with an extending direction, in which the arm 153 extends, and extends in substantially the same direction as that in which the arm 153 extends. The curved portion 159 is formed by upwardly bending an end part of the bottom portion 158 and then bending this end part like a circular arc outwardly in the direction, in which the arm 153 extends. A top end portion 160 constituting the top end of the ring 157 is upwardly bent from the bottom portion 158 and is subsequently and additionally bent to the arm 153. That is, the top portion 160 extends in a direction intersecting with the direction in which the arm 153 extends.

As shown in FIG. 21, an axis line 161 (the center line of the linear steel member) of the hanging part 157*a* of the ring 157, which hangs down from the arm 153, is inclined to an axis line 162 of the axis portion 152. That is, the axis line 162 of the axis portion 152 extends in a vertical direction, while the axis line 161 of the hanging part 157*a* of the ring 157 is inclined to the vertical direction. A side in the direction of inclination of the hanging part 157*a* is opposite to a side, at which the top portion 160 is disposed, with respect to the arm 153. The ring 157 is formed like a rectangle longitudinally elongated in the direction of the axis line 161 so that the sides of the rectangle are substantially perpendicular to each other. Thus, the top portion 160 is placed at a position, whose height is equal to or lower than that of the arm 153, by inclining the axis line 161 toward the side opposite to the top portion 160. That is, the top portion 160 is positioned at a place lower than the arm 153. Also, the top portion 160 is positioned at a place opposite to the support board 164 with respect to a plane of rotation 163 of the arm 153.

The support board 164 is a flat-plate-like member, in which a shaft hole 165 supporting the axis portion 152 is formed, and is fixed to the apparatus body. The arm 153 is turned along the bottom surface of the support board 164. The holding portion 155 is accommodated in a part of the range, in which the arm 153 turns, in the bottom surface portion. That is, the turn support member 150 is turnably supported to be hung by the support board 164.

Such a third modification obtains advantages similar to those of the above aspect. The flat cable 85 is prevented from running aground and getting into under a plurality of ink tubes 41 in the vicinity of the curved portion. Thus, the top end and the bottom end of the flat cable 85 are prevented from touching the ink tubes 41. Consequently, the flat cable 85 is prevented from being damaged and broken.

Hereinafter, the support board 110 adapted to support the turn supporting member 100 is described in detail. FIG. 10 is a cross-sectional view taken along line X-X shown in FIG. 12. FIG. 11 is an enlarged view taken in the direction of an arrow 115 shown in FIG. 13. In FIG. 10, the drawing of the holding portion 105 provided at the leading end side of the turn supporting member 100 is omitted. In the present aspect, the support board 110 is attached to the apparatus body as a separate member. However, the support board 110 may be formed integral with the apparatus body. In this case, the support board 110 is not necessarily a flat-plate-like member. It is sufficient that the support board 110 has at least parts supporting and guiding a turn supporting member 100.

As shown in FIG. 4, the support board 110 is fixed to the apparatus body at a part closer to the apparatus rear side than the regulating wall 37, that is, at the side of the carriage 38. The support board 110 is a flat plate, whose is substantially equal in the length in the direction of width of the apparatus to the regulating wall 37. The support board 110 has a width in the direction of depth of the apparatus, which is within a range of width of a space extending from the regulating wall 37 to the guide rail 44. The shaft hole 111 adapted to axially support the axis portion 102 of the turn supporting member 100 is vertically bored in the support board 110. The shaft hole 111 is disposed inside the curves U-shaped in plan view, along which the ink tubes 41 and the flat cable 85 are routed. The axis portion 102 of the turn supporting member 100 is axially supported in the shaft hole 111. The arm 103 extends substantially horizontally toward the ink tubes 41 and the flat cable 85. The distance from the shaft hole 111 to an edge portion 116 of the support board 110, which extends in the direction of depth of the apparatus is shorter than the length from the base end (at the side of the axis portion 102) to the holding portion 105. Thus, as a result of turning the arm 103, a state, in which the entire arm 103 including the holding portion 105 is accommodated within the top surface of the support board 110 (see FIG. 13), is changed to a state in which the holding portion 105 goes away from the top surface of the support board 110 (see FIG. 12).

As shown in FIGS. 4 and 10, a first support rib 117 supporting the arm 103 is formed to extend around the shaft hole 111 in the top surface of the support board 110. The first support rib 117 is formed like a circular arc extending around the shaft hole 111. The first support rib 117 is formed over a range in which the arm 103 turns. The distance from the shaft hole 111 to the first support rib 111 is not limited to a specific value. Preferably, the first support rib 117 is formed close to the holding portion 105 as much as possible. This is because the height position of the holding portion 105 can accurately be determined. An end surface of the first support rib 117 abuts against the arm 103 within a range in which the arm 103 turns. The height of the end surface of the first support rib 117 is set at a certain value from the top surface of the support board 110 so that the height of the end surface of the first support rib 117 does not change within the range in which the arm 103 turns. The height of the first support rib 117 has a value at which the holding portion 105 can be maintained in a state in which, especially, the bottom portion 108 floats above the top surface of the support board 110.

A second support rib 118 supporting the auxiliary arm 106 is formed to extend around the shaft hole 111 in the bottom surface (a surface at the side of the auxiliary arm 106) of the support board 110. Although not shown in the figures, the second support rib 118 is shaped like a circular arc extending around the shaft hole 111, similarly to the first support rib 117. The second support rib 118 is formed over the range in which the arm 103 turns. The distance from the shaft hole 111 to the second support rib 118 is not limited to a specific value. However, when the second support rib 118 is distant from the shaft hole 111, a supporting force of the auxiliary arm 106 is increased. An end surface of the second support rib 117 abuts against the auxiliary arm 106 within the range in which the arm 103 turns. The height of the second support rib 118 is set at a certain value from the support board 100 to prevent the height of the end surface of the second support rib 118 from changing within the range in which the arm 103 turns. The height of the second support rib 118 has a value at which the holding portion 105 can be maintained in a state in which, especially, the bottom portion 108 floats above the top surface of the support board 110.

The arm 103 is supported at a predetermined height by the first support rib 117 formed on the support board 110, so that the holding portion 105 is maintained in a state in which the holding portion 105 is floated above the top surface of the support board 110. Thus, the bottom portion 108 of the holding portion 105 does not abut against the top surface of the support board 110. Also, the holding portion 105 is maintained in a state, in which the holding portion 105 is floated above the top surface of the support board 110, by supporting the auxiliary arm 106 at a predetermined height with the second support rib 118. Consequently, the holding portion 105 is maintained in a state, in which the holding portion 105 is surely floated above the top surface of the support board 110, within the range in which the arm 103 turns, by utilizing the combination of the first support rib 117 and the second support rib 118.

As shown in FIGS. 4 and 10, a guide plate 119 is erected in the vicinity of the shaft hole 111 of the support board 110 by being separated from the regulating wall 37 toward the carriage 38. The guide plate 119 is formed only within a predetermined range in the vicinity of the shaft hole 111. The guide plates performs functions only when the carriage 38 is moved to a side at which the U-shaped curved portion of the flat cable 85 is largely formed (see FIG. 12). The ink tubes 41 and the flat cable 85 are passed through between the guide plate 119 and the regulating wall 37. The ink tubes 41 and the flat cable 85 are caused to abut against the wall surface of the guide plate 119. Consequently, the ink tubes 41 and the flat cable 85 are inhibited from bending to the side of the carriage 38 from the fixing clips 36 and 86. Accordingly, the center of the U-shaped curved portion can be shifted toward the regulating wall 37 without causing buckling in the ink tubes 41 and the flat cable 85. The U-shaped curved portions of the ink tubes 41 and the flat cable 85 are prevented from being enlarged. Also, the length of each of the ink tubes 41 and the flat cable 85 from the fixing clip 36 or 86 to the carriage 38 can be minimized.

As shown in FIG. 11, the concave cutout portion 120 is formed in the regulating wall 37 to prevent the holding portion 105 of the turn supporting member 110, which holds the predetermined part of each of the ink tubes 41, from abutting against the regulating wall 37. In the present aspect, the concave cutout portion 120 is formed as a through hole passed through in the direction of thickness of the regulating wall 37. However, in a case where the regulating wall 37 is thick, the wall surface of the regulating wall 37 may be formed to be depressed. Alternatively, the regulating wall 37 may be separated into two parts by the concave cutout portion 120. The concave cutout portion 120 has a shape corresponding to a part of the arm 103, which is located in the neighborhood of the holding portion 105, and the ring 107, the bottom portion 108, and the curved portion 109 of the holding portion 105. However, in a case where all of these constituents do not abut against the regulating wall 37, the shape of the concave cutout portion 120 is not limited to a specific one. Consequently, in a state in which the ink tubes 41 abut against the wall surface of the regulating wall 37, a part of the turn supporting member 100, which is located in the vicinity of the holding portion 105, goes into the concave cutout portion 120, so that the holding portion 105 does not abut against the regulating wall 37. This advantage will be described in detail later.

Hereinafter, operations performed by the ink tubes 41, the flat cable 85, and the turn supporting member 100 in an image recording operation of the printer portion 2 are described. The carriage 38, on which the recording head 39 is mounted, is guided by transmitting a driving force of the CR motor 73 thereto through the belt drive mechanism 46. Also, the carriage 38 is guided by the guide rails 43 and 44, so that the carriage 38 reciprocates in a direction intersecting with the recording paper conveying direction. The recording head 39 ejects ink droplets of each of the colors, which are supplied from the ink tubes 41, on recording paper placed on the platen 42 with predetermined timing according to a signal transmitted from the control portion 64 through the flat cable 85. The intermittent conveyance of recording paper by the conveying roller 60 and the paper discharge roller 62, and the reciprocating movement of the carriage 38 are alternately repeated. Thus, a desired image is recorded on the recording paper.

The ink tubes 41 and the flat cable 85, one end of each of which is connected to the carriage 38, change shapes while following the reciprocating movement of the carriage 38 to change the curvature of the U-shaped curved portion. FIG. 12 illustrates a case where the carriage 38 is placed at the capping position on the cap 52 (at the right side, as viewed in FIG. 12). FIG. 13 illustrates a case where the carriage 38 is placed at a flashing position (at the left side, as viewed in FIG. 13) on the waste ink tray 84. In the present aspect, the capping position is an initial position of the carriage 38.

In a case where the carriage 38 is placed at the capping position, as illustrated in FIG. 12, each of the ink tubes 41 and the flat cable 85 has a curved U-shape formed so that each of the ink tubes 41 and the flat cable 85 extends to the flashing position in the reciprocating direction in which the carriage 38 reciprocates, and is immediately reversed at that point. Each of the ink tubes 41 and the flat cable 85 has flexibility, and also has a certain degree of bending stiffness. Although elasticity of each of the ink tubes 41 and the flat cable 85 causes the U-shaped curved portion to largely expand onto the guide rail 44, the U-shaped curved portion abuts against the wall surface of the guide plate 119. Thus, each of the ink tubes 41 and the flat cable 85 is prevented from bending toward the carriage 38 at an acute angle. Also, the center of the U-shape curved portion is shifted to the regulating wall 37. Consequently, the curved portion of each of the ink tubes 41 and the flat cable 85 can be prevented from being enlarged. A space needed to route the ink tubes 41 and the flat cable 85 can be reduced. Thus, the miniaturization of the apparatus can be achieved. The length of each of the ink tubes 41 and the flat cable 85 from the fixing clip 36 or 86 to the carriage 38 can be minimized.

As illustrated in FIG. 4, during the carriage 38 is slid and moved to the flashing position from the capping position, each of the ink tubes 41 and the flat cable 85 follows the movement of the carriage 38 while changing the shape thereof to reduce the diameter of the U-shaped curved portion. As shown in FIG. 13, when the carriage 38 is placed at the flashing position, the diameter of the U-shaped curved portion of each of the ink tubes 41 and the flat cable 85 is minimized. The fixing clips 36 and 86 fix the ink tubes 41 and the flat cable 85 by pushing the ink tubes 41 and the flat cable 85 against the wall surface of the regulating wall 37. Thus, the ink tubes 41 and the flat cable 85 are pushed against along the regulating wall 37 in the range in which the carriage 38 reciprocates. Such pushed parts of the ink tubes 41 and the flat cable 85, which extend along the wall surface of the regulating wall 37, are prevented from being disengaged from the regulating wall 37. Consequently, a region, in which the part extending to the carriage 38 from the curved portion of each of the ink tubes 41 and the flat cable 85 expands toward the carriage 38, can be decreased. Also, the space needed to route the ink tubes 41 and the flat cable 85 can be reduced, because the expansion of each of the ink tubes 41 and the flat cable 85 in the direction away from the carriage 38 is regulated by the regulating wall 37.

As illustrated in FIG. 13, the flat cable 85 disposed inside the curved portion of each of the ink tubes 41 sometimes touches the ink tube 41 when following the reciprocating movement of the carriage 38. At that time, the flat cable 85 abuts against the uppermost ink tube 41 placed closest thereto at the U-shaped curved portion thereof. As described above, the four ink tubes 41 are substantially equal to one another in the length from the carriage 38 to the fixing clip 36. The ink tube 41 disposed at the most upstream side in the recording paper conveying direction is placed at the uppermost place in the fixing clip 36. Another of the ink tubes 41, which is disposed at the immediately downstream side of the carriage 38, is placed just under the fixing clip 36. This process is repeated, so that the ink tubes 41 horizontally arrange at the carriage 38 are vertically arranged at the fixing clip 36.

FIG. 14 is a cross-sectional view taken along line XIV-XIV shown in FIG. 13. As shown in FIG. 14, the four ink tubes 41 are arranged downwardly and obliquely at the curved portion. Thus, in a case where the ink tubes 41 change the shapes during following the carriage 38, the possibility of occurrence of interference between the ink tubes 41 is reduced. Also, the flat cable 85 is configured so that the bottom of the flat cable 85 is maintained by the turn supporting member 100 at a height which is substantially equal to the height of the lowermost one of the ink tubes 41 disposed at the fixing clip 36. One of the front surface and the rear surface of the flat cable 85 abuts against the uppermost one of the ink tubes 41 disposed at the fixing clip 36. Therefore, the flat cable 85 neither gets into under the four ink tubes 41 nor runs aground the ink tubes 41. Thus, the configurations of the ink tubes 41 and the flat cable 85 outside and inside the ink tubes 41 and the flat cable 85 are maintained. The ink tubes 41 and the flat cable 85 follow the movement of the carriage 38 and change the shapes thereof.

Each of the ink tubes 41 and the flat cable 85, which change the shapes thereof in this manner, is supported at a predetermined height by the turn supporting member 100. As described above, the ink tubes 41 are held by the holding portion 105. The flat cable 85 is supported on the carrying portion 104. When the ink tubes 41 follow the reciprocating movement of the holding portion 38 and change the shapes thereof, change in the shape of the ink tubes 41 is transmitted to the arm 103 through the holding portion 105, so that the arm 103 turns by employing the axis portion 102 as the turn supporting point.

As shown in FIGS. 4, 12, and 13, the flat cable 85 slides on the carrying portion 104 during changing the shape thereof during following the reciprocating movement of the carriage 38. In a case where the flat cable 85 is supported at a predetermined height by grasping the predetermined part, the locus of a turn of the predetermined part may be limited to a predetermined circular arc, and an excessive load may be applied to the predetermined part. The carrying portion 104 slidably supports the flat cable 85 thereon. Thus, regardless of the locus of a turn of the arm 103, the flat cable 85 can freely change the shape thereof in a range in which the carrying portion 104 slides. Consequently, no excessive load on the flat cable occurs. Thus, the flat cable 85 is prevented from being damaged and being broken.

Also, as described above, the arm 103 is turned, so that at the flashing position, the entire arm 103 including the holding portion 105 is accommodated within the top surface of the support board 100, as shown in FIG. 13, and that at the capping position, the holding portion 105 goes away from the support board 110, as shown in FIG. 12. In a case where the arm 103 further turns the position indicated by FIG. 4 to the capping position, the holding portion 105 goes away from the top surface of the support board 110. Conversely, in a case where the arm 103 turns from the capping position to the position indicated in FIG. 4, the holding portion 105 is accommodated within the top surface of the support board 110.

As described above, the ring 107 of the holding portion 105 is configured so that the axis line 112 of the part 107*a* erected from the arm 103 (see FIG. 9) is inclined to the axis line 113 of the axis portion 102. The bottom portion 108 of the ring 107 is placed at a position whose height is equal to or higher than the height position of the arm 103. Accordingly, when the holding portion 105 is accommodated within the top surface of the support board 110, the bottom portion 108 does not abut against the edge portion 116 of the support board. Consequently, no sound of a collision between the holding portion 105 and the support board 110 is generated.

Also, the erected part 107*a* of the ring 107 of the holding portion 105 is inclined to the axis portion 102, so that the bottom portion 108 of the ring 107 has a height which is equal to or larger than the height of the arm 103. Therefore, it is unnecessary to set the position of the ring 107 to be higher than that of the arm 103. In a case where the height position of the ring 107 is set to be higher than that of the arm 103, the position of each of the ink tubes 41, each of which is surrounded by the rig 107, becomes high. Thus, it is necessary for preventing the interference between the ink tube 41 and another member, such as a cover disposed above the range, in which the ink tube 41 changes the shape, to increase the height position of the another member. Consequently, the height of the entire apparatus is increased. According to the present aspect, the ring 107 of the holding portion 105 does not excessively extend above the arm 103. Thus, the bottom portion 108 of the ring 107 is prevented from abutting against the edge portion 116 of the support board 110. Consequently, the height of the position of the top end of each of the ink tubes 41 vertically disposed can be suppressed to be low.

Also, as described above, the first support rib 117 supporting the arm 103, and the second support rib 118 supporting the auxiliary arm 106 are formed to extend around the shaft hole 111 of the support board 110. The holding portion 105 of the arm 103 is maintained by these ribs in a state in which the holding portion 105 is floated above the top surface of the support board 110. Consequently, the bottom portion 108 of the ring 107 of the holding portion 105 is surely prevented from colliding with the edge portion 116 of the support board 110.

In a case where the carriage 38 is placed at the flashing position, as illustrated in FIG. 13, the ink tubes 41 abut against the regulating wall 37 and are pushes there against, the holding portion 105 of the turn supporting member 110 is turned toward the regulating wall 37. As described above, the concave cutout portion 120 used to prevent the holding portion 105 of the turn supporting member 110 from abutting against the regulating wall 37. Thus, even when the ink tube 41 abuts against the regulating wall 37, the holding portion 105 of the turn supporting member 110 does not abut against the regulating wall 37. Consequently, sounds of the collimation between the holding portion 105 and the regulating wall 37 are prevented from being generated. Consequently, operation sounds of the carriage 38 are turned down. Also, the collision between the holding portion 105 and the regulating wall 37 is prevented. Thus, the ink tubes 41 uniformly abut against the wall surface of the regulating wall 37. Consequently, the linear steel materials of the ring 107 of the holding portion 105 do not apply local stress to the ink tubes 41.

Thus, according to the multifunction apparatus 1, the bottom portion 108 constituting a part of the holding portion 105 of the turn supporting member 100 is formed opposite to the support board 110 with respect to the plane of rotation of the arm 103. Accordingly, when the vicinity of the holding portion 105 of the arm 103 is accommodated in the support board 110, the bottom portion 108, which is a part of the holding portion 105, does not abut against the support board 110. Consequently, the generation of sounds of a collision between the holding portion 105 of the turn supporting member 100 and the support board 110 is prevented.

Incidentally, the flat cable 85 is disposed inside the U-shape curve of each of the ink tubes 41. However, the flat cable 85 may be disposed outside the U-shape curve of each of the ink tubes 41 by reversing the disposition of these constituents. In this arrangement of the ink tubes 41 and the flat cable 85, it is preferable that a flexible one of these constituents, that is, each of the ink tubes 41 or the flat cable 85 is disposed inside the U-shaped curve. Generally, the flat cable 85 is considered to be more flexible than the four ink tubes 41. However, in a case where the number of ink tubes 41 is small, where the material of the insulating coating of the flat cable 85 is selected, or where a plurality of flat cables 85 are bundled, the ink tubes 41 can be considered to be more flexible than the flat cable 85. The curved portion is formed in each of the ink tubes 41 and the flat cable 85 to have a diameter to the extent that no buckling occurs. In a case where the ink tubes 41 or the flat cable 85 is more flexible, the flat cable or tubes can be routed so that the diameter of the curved portion of the flat cable 85 or each of the ink tubes 41 is smaller than the diameter of the curved portion of the other. A space needed to change the shape of each of the ink tubes 41 or of the flat cable 85 is reduced by disposing the flexible one of the flat cable 85 or each of the ink tubes 41 inside the curved portion thereof. Consequently, the miniaturization of the apparatus is achieved.

Also, the present aspect is adapted so that the ink tubes 41 and the flat cable 85 are routed in the same direction like a letter "U" and follow the reciprocating movement of the carriage 38. However, the machine may be adapted so that the turn supporting member 100 supports only the ink tubes 41, and that the flat cable 85 is routed in a direction different from the direction in which the ink tubes 41 are routed. Alternatively, for example, the machine may be adapted so that the flat cable 85 extends from the carriage 38 in a direction, in which the carriage 38 reciprocates, opposite to the direction in which the ink tubes 41 are routed, and that the flat cable 85 is routed vertically like a letter "U".

Additionally, in the present aspect, the support board 110 is formed of, for example, a synthetic resin as a member that is different from the apparatus frame. Also, the support board 110 is fixed to a predetermined place on the apparatus body by screwing. However, the support board 110 may be formed integrally with another member, such as the apparatus frame or the regulating wall 37.

Hereinafter, a first modification of the above aspect is described. Although the holding portion 105 of the turn supporting member 100 is formed in the above aspect to surround the ink tubes 41 by the ring 107, it is sufficient that the holding portion according to the invention supports the ink tubes 41 at least from three directions. FIG. 15 is a front view illustrating the configuration of the turn supporting member 130. FIG. 16 is a side view, which is taken in the direction of an arrow 131 shown in FIG. 15 and which illustrates the configuration of the turn supporting member 130.

The turn supporting member 130 includes an axis portion 132 serving as a turn supporting point, an arm 133 extending horizontally from the axis portion 132, a carrying portion 134 formed at the base end side of the arm 133, a holding portion 135 formed at a leading end side of the arm 133, and an auxiliary arm 103 extending from the axis portion 132 to be formed into a crank shape with respect to the axis portion 132 and the arm 133. These components of the turn supporting member 130 are integrally formed by bending linear steel materials. The axis portion 132, the arm 133, the carrying portion 134, and the auxiliary arm 136 respectively correspond to the axis portion 102, the arm 103, the carrying portion 104, and the auxiliary arm 106.

The holding portion 135 formed at the end side of the arm 133 is configured so that the ink tubes 41 are held from three directions. The holding portion 135 includes a U-shape portion 137 which is opened in the top side thereof and is substantially U-shaped as shown in the direction of the arrow 131, a bottom portion 138 protruded to the end side from the U-shape portion, and the curved portion 139 formed at the end of the bottom portion 138. The relationship between the inside dimension width, the inside dimension height of the u-shape portion 137, and the outside diameter of each of the ink tubes 41 is similar to that described. The relationship holds good on condition that the arrangement of the ink tubes 41 is not changed in the U-shape portion 137, and that the ink tubes 41 can freely slide in a direction in which the ink tubes 41 extend. The bottom portion 138 of the U-shape portion 137 is separated therefrom in a direction intersecting with an extending direction, in which the arm 133 extends, and extends in substantially the same direction as that in which the arm 133 extends. The curved portion 139 is formed by upwardly bending an end part of the bottom portion 138 and then bending this end part like a circular arc outwardly in the direction, in which the arm 133 extends. The bottom portion 138 corresponds to a part of the holding portion according to the invention.

As shown in FIG. 16, an axis line 132 (the center line of the linear steel member) of the erected part 137*a* of the U-shape portion 137, which is erected from the arm 133, is inclined to an axis line 141 of the axis portion 132. That is, the axis line 141 of the axis portion 132 extends in a vertical direction, while the axis line 140 of the erected part 137*a* of the U-shape portion 137 is inclined to the vertical direction. A side in the direction of inclination of the erected part 137*a* is opposite to a side, at which the bottom portion 138 is disposed, with respect to the arm 133. The U-shape portion 137 is formed like a rectangle longitudinally elongated in the direction of the axis line 140 so that the sides of the rectangle are substantially perpendicular to each other. Thus, the bottom portion 138 is placed at a position, whose height is equal to or higher than that of the arm 133, by inclining the axis line 140 toward the side opposite to the bottom portion 138. That is, the bottom portion 138 is positioned at a place higher than the arm 133. Also, the bottom portion 138 is positioned at a place opposite to the support board 110 with respect to a plane 142 of rotation of the arm 133.

Even in the case of such a first modification, the bottom portion 138 constituting a part of the holding portion 135 of the turn supporting member 130 is formed at a side opposite to the support board 110 with respect to the plane 142 of rotation of the arm 133. Thus, when the vicinity of the holding portion 135 of the arm 133 is accommodated in the support board 110, the bottom portion 138, which is a part of the holding portion 135, does not abut against the support board 110. Consequently, the generation of sounds of a collision between the holding portion 135 of the turn supporting member 130 and the support board 110 is prevented.

The above aspect and the first modification are adapted so that the turn supporting member 100 and 130 are turned by being supported on the support board 110, and that the ink tubes 41 held by the holding portions 103 and 135 are supported from below by the arms 103 or 133. The holding portion according to the invention may be formed to hang from the arm.

Hereinafter, a second modification of the above aspect is described. FIG. 17 is a front view illustrating the configuration of a turn supporting member 150 according to the second modification. FIG. 16 is a side view which is taken in the direction of an arrow 151 shown in FIG. 17 and which illustrates the configuration of the turn supporting member 150.

The turn supporting member 150 includes an axis portion 152 serving as a turn supporting point, an arm 153 extending horizontally from the axis portion 152, a holding portion 153 formed at a leading end side of the arm 153, and an auxiliary arm 153 extending from the axis portion 152 to be formed into a crank shape with respect to the axis portion 152 and the arm 153. These components of the turn supporting member 150 are integrally formed by bending linear steel materials. The axis portion 152, the arm 153, and the auxiliary arm 156 respectively correspond to the axis portion 102, the arm 103, the carrying portion 104, and the auxiliary arm 106. Thus, the detailed description of these constituents is omitted herein. Additionally, the turn supporting member 150 according to the second modification has no part corresponding to the carrying portion 104 of the above aspect, which supports the flat cable 85.

The holding portion 155 formed at the end of the arm 153 holds the ink tubes 41 by surrounding the ink tubes 41. The holding portion 155 includes a ring 157, a bottom portion 158 projected to the leading end from the ring 157, and a curved portion 159 formed at the end of the bottom portion 158. The relationship between the inside dimension width, the inside dimension height of the ring 157, and the outside diameter of each of the ink tubes 41 is similar to that described. The relationship holds good on condition that the arrangement of the ink tubes 41 is not changed in the ring 157, and that the ink tubes 41 can freely slide in a direction in which the ink tubes 41 extend. The bottom portion 158 of the ring 157 is separated therefrom in a direction intersecting with an extending direction, in which the arm 153 extends, and extends in substantially the same direction as that in which the arm 153 extends. The curved portion 159 is formed by upwardly bending an end part of the bottom portion 158 and then bending this end part like a circular arc outwardly in the direction, in which the arm 153 extends. Atop end portion 160 constituting the top end of the ring 157 is upwardly bent from the bottom portion 158 and is subsequently and additionally bent to the arm 153. That is, the top portion 160 extends in a direction intersecting with the direction in which the arm 153 extends. The top portion 160 corresponds to a part of the holding portion according to the invention.

As shown in FIG. 18, an axis line 161 (the center line of the linear steel member) of the hanging part 157*a* of the ring 157, which hangs down from the arm 153, is inclined to an axis line 162 of the axis portion 152. That is, the axis line 162 of the axis portion 152 extends in a vertical direction, while the axis line 161 of the hanging part 157*a* of the ring 157 is inclined to the vertical direction. A side in the direction of inclination of the hanging part 157*a* is opposite to a side, at which the top portion 160 is disposed, with respect to the arm 153. The ring 157 is formed like a rectangle longitudinally elongated in the direction of the axis line 161 so that the sides of the rectangle are substantially perpendicular to each other. Thus, the top portion 160 is placed at a position, whose height is equal to or lower than that of the arm 153, by inclining the axis line 161 toward the side opposite to the top portion 160. That is, the top portion 160 is positioned at a place lower than the arm 153. Also, the top portion 160 is positioned at a place opposite to the support board 164 with respect to the plane 163 of rotation of the arm 153.

The support board 164 is a flat-plate-like member, in which a shaft hole 165 supporting the axis portion 152 is formed, and is fixed to the apparatus body. The arm 153 is turned along the bottom surface of the support board 164. The holding portion 155 is accommodated in a part of the range, in which the arm 153 turns, in the bottom surface portion. That is, the turn support member 150 is turnably supported to be hung by the support board 164.

Even in the case of such a second modification, the top portion 160 constituting a part of the holding portion 155 of the turn supporting member 150 is formed at a side opposite to the support board 164 with respect to the plane 163 of rotation of the arm 153. Thus, when the vicinity of the holding portion 155 of the arm 153 is accommodated in the support board 164, the top portion 160, which is a part of the holding portion 155, does not abut against the support board 164. Consequently, the generation of sounds of a collision between the holding portion 155 of the turn supporting member 150 and the support board 155 is prevented.

What is claimed is:

1. An image recording apparatus, comprising:

a recording head that records an image on a recording medium by ejecting ink droplets;

a carriage that reciprocates in a direction intersecting a recording medium conveying direction, the recording head being mounted on the carriage;

a conductive cable having flexibility to follow a reciprocating movement of the carriage and to change a shape thereof, the conductive cable being fixed to the carriage at one end thereof and to an apparatus body at the other end thereof, the conductive cable being routed to form a curved portion that turns around in a direction in which the carriage reciprocates, the conductive cable being adapted to transmit a recording signal to the recording head;

an ink supply tube having flexibility to follow the reciprocating movement of the carriage and to change a shape thereof, the ink supply tube being fixed to the carriage at one end thereof and to the apparatus body at the other end thereof, the ink supply tube being routed in substantially a same direction as that, in which the conductive cable is routed, to form a curved portion that turns around in the direction in which the carriage reciprocates, the ink supply tube being adapted to supply ink to the recording head; and a turn supporting member including an arm, a carrying portion provided on the arm, and a holding portion provided on the arm, the holding portion being adapted to slidably hold a predetermined part of the ink tube, the flat cable being slidably supported on the carrying portion, the arm being turnably and axially supported on a turn supporting point on the apparatus body located at an inner part of the curved portion of each of the flat cable and the ink tube, the arm being led from the turn supporting point in a substantially horizontal direction.

2. The image recording apparatus according to claim 1, wherein the ink supply tube comprises a plurality of ink supply tubes corresponding to ink colors, respectively, and the holding portion slidably holds the plurality of ink supply tubes in a state in which a predetermined arrangement of the plurality of ink supply tubes is maintained.

3. The image recording apparatus according to claim 1, wherein one of the conductive cable and the ink supply tube, which is more flexible than the other of the conductive cable and the ink supply tube, is disposed inside the curved portion of the other of the conductive cable and the ink supply tube.

4. The image recording apparatus according to claim 1, wherein the conductive cable is disposed outside the curved portion of the ink supply tube, and the arm is bent so that an end of the arm is placed above a top end of the conductive cable supported on the carrying portion.

5. The image recording apparatus according to claim 1, wherein the conductive cable is disposed outside the curved portion of the ink supply tube, and the arm is bent so that an end side part of the arm is curved outwardly toward a direction in which the arm extends.

6. An image recording apparatus, comprising:

a recording head that records an image on a recording medium by ejecting ink droplets;

a carriage that reciprocates in a direction intersecting a recording medium conveying direction, the recording head being mounted on the carriage;

an ink supply tube having flexibility to follow a reciprocating movement of the carriage and to change a shape thereof, the ink supply tube being fixed to the carriage at one end thereof and to a fixing portion of an apparatus body at the other end thereof, the ink supply tube being routed to form a curved portion that turns around in a direction in which the carriage reciprocates, the ink supply tube being adapted to supply ink to the recording head;

a turn supporting member including an arm, and a holding portion provided on the arm, the holding portion being adapted to slidably hold a predetermined part of the ink tube, the arm being turnably and axially supported on a turn supporting point on the apparatus body located at an inner part of the curved portion, the arm being led from the turn supporting point in a substantially horizontal direction; and a regulating wall erected along the direction in which the carriage reciprocates and including a concave cutout portion adapted to prevent the holding portion from abutting against the regulating wall, the regulating wall being adapted to abut against at least a predetermined part of the ink supply tube to thereby regulate the ink supply tube from expanding in a direction away from the carriage.

7. The image recording apparatus according to claim 6, wherein the fixing portion fixes the other end of the ink supply tube such that an extending direction of the ink supply tube and a wall surface of the regulating wall form a predetermined angle so that the predetermined part of the ink supply tube is pushed against the regulating wall.

8. The image recording apparatus according to claim 6, wherein the ink supply tube comprises a plurality of ink supply tubes corresponding to ink colors, respectively, and the holding portion slidably holds the plurality of ink supply tubes in a state in which a predetermined arrangement of the plurality of ink supply tubes is maintained.

9. The image recording apparatus according to claim 8, wherein the fixing portion is adapted to arrange the plurality of ink supply tubes in a substantially vertical direction and to fix the other end of each of the plurality of ink supply tubes, and the holding portion maintains a vertical arrangement of the plurality of ink supply tubes at the predetermined part.

10. An image recording apparatus, comprising:

a recording that records an image on a recording medium by ejecting ink droplets;

a carriage that reciprocates in a direction intersecting a recording medium conveying direction, the recording head being mounted on the carriage;

a flat cable having flexibility to follow a reciprocating movement of the carriage and to change a shape thereof, the flat cable being fixed to the carriage at one end thereof and to a fixing portion of an apparatus body at the other end thereof, the flat cable being routed to form a curved portion that turns around in a direction, in which the carriage reciprocates, the flat cable including front and rear surfaces extending in a substantially vertical direction, the flat cable being adapted to transmit a recording signal to the recording head;

a plurality of ink supply tubes having flexibility to follow the reciprocating movement of the carriage and to change shapes thereof, one end side part of each of the ink supply tubes being horizontally arranged along the recording medium conveying direction and fixed to the carriage, the other end side part of each of the ink supply tubes being vertically arranged and fixed to the apparatus body, each of the ink supply tubes being routed in substantially a same direction as that, in which the flat cable is routed, to form a curved portion that turns around in a direction in which the carriage reciprocates, each of the ink supply tubes being adapted to supply ink to the recording head, wherein one of the front and rear surfaces of the flat cable abuts against a closest one of the plurality of ink supply tubes at the curved portion.

11. The image recording apparatus according to claim 10, wherein the plurality of ink supply tubes are substantially equal to one another in length of a part from the carriage to the fixing portion, at the carriage, one end of the ink supply tube, the other end of which is disposed furthest from a fixing position to which one end of the flat cable is fixed, is placed at an uppermost position at the fixing portion, a bottom end of the flat cable is placed at a height substantially equal to a height of the ink supply tube disposed at a lowermost position at the fixing portion, and one of the front and rear surfaces of the flat cable abuts against the ink supply tube placed at the uppermost position at the fixing portion.

12. The image recording apparatus according to claim 11, wherein the plurality of ink supply tubes at the carriage are arranged such that one end of the ink supply tube, the other end of which is second furthest from the fixing position to which the one end of the flat cable is fixed, is placed at a second uppermost position at the fixing portion.

13. The image recording apparatus according to claim 11, further comprising:

a holding member adapted to hold the bottom end of the flat cable at a height which is substantially equal to that of the ink supply tube placed at the lowermost position at the fixing portion.

14. The image recording apparatus according to claim 10, further comprising:

a regulating wall erected along a direction in which the carriage reciprocates and adapted to regulate the ink supply tube from expanding in a direction away from the carriage.

15. The image recording apparatus according to claim 14, further comprising:

a constraining member adapted to constrain a part of each of the plurality of ink supply tubes, which changes the shape thereof along the regulating wall, to a vertical arrangement that is equivalent to a vertical arrangement at the fixing portion.

16. The image recording apparatus according to claim 10, wherein one of the flat cable and the ink supply tube, which is more flexible than the other of the flat cable and the ink supply tube, is disposed inside the curved portion of the other of the flat cable and the ink supply tube.

17. An image recording apparatus, comprising:

a recording head that records an image on a recording medium by ejecting ink droplets;

a carriage that reciprocates in a direction intersecting a recording medium conveying direction, the recording head being mounted on the carriage;

an ink supply tube having flexibility to follow a reciprocating movement of the carriage and to change a shape thereof, the ink supply tube being fixed to the carriage at one end thereof and to a fixing portion of an apparatus body at the other end thereof, the ink supply tube being routed to form a curved portion that turns around in a direction in which the carriage reciprocates, the ink supply tube being adapted to supply ink to the recording head;

a turn supporting member including an axis portion serving as a turn supporting point, an arm extending substantially horizontally from the axis portion, and a holding portion provided on the arm, the holding portion being adapted to slidably hold a predetermined part of the ink tube; and a support board disposed on the apparatus body such that the entirety of the arm including vicinity of the holding portion is positioned above the support board in a part of a turning range of the turn supporting member, the support board having a shaft hole for supporting the axis portion at an inner part of the curved portion, wherein the holding portion is formed into a shape, in which the ink supply tube is held from at least three directions, by being curved from the arm, and a part of the holding portion is formed at a side opposite to the support board with respect to a plane of rotation of the arm.

18. The image recording apparatus according to claim 17, wherein the holding portion is formed such that an arm-side erected portion thereof curved from the arm is inclined with respect to an axis line of the axis portion.

19. The image recording apparatus according to claim 17, wherein the support board includes a first support rib erected on a surface at the side of the arm around the shaft hole to support the arm.

20. The image recording apparatus according to claim 17, wherein the turn supporting member includes an auxiliary arm extending from the axis portion to be formed into a crank shape with respect to the axis portion and the arm, and the support board includes a second support rib erected on a surface at the side of the auxiliary arm around the shaft hole to support the auxiliary arm.

21. The image recording apparatus according to claim 17, wherein the ink supply tube comprises a plurality of ink supply tubes corresponding to ink colors, respectively, and the holding portion slidably holds the plurality of ink supply tubes in a state in which a predetermined arrangement of the plurality of ink supply tubes is maintained.

22. The image recording apparatus according to claim 21, wherein the fixing portion is adapted to arrange the plurality of ink supply tubes in a substantially vertical direction and to fix the other end of each of the plurality of ink supply tubes, and the holding portion maintains a vertical arrangement of the plurality of ink supply tubes at the predetermined part.

* * * * *